US010563455B2

(12) United States Patent
Chen et al.

(10) Patent No.: US 10,563,455 B2
(45) Date of Patent: Feb. 18, 2020

(54) LOCKING MECHANISM FOR CORD OF WINDOW COVERING

(71) Applicant: NIEN MADE ENTERPRISE CO., LTD., Taichung (TW)

(72) Inventors: Lin Chen, Taichung (CN); Keng-Hao Nien, Taichung (TW); Yu-Che Wen, Taoyuan County (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 255 days.

(21) Appl. No.: 15/585,603

(22) Filed: May 3, 2017

(65) Prior Publication Data

US 2017/0342770 A1 Nov. 30, 2017

(30) Foreign Application Priority Data

May 31, 2016 (CN) ..... 2016 2 0518789 U

(51) Int. Cl.
*E06B 9/324* (2006.01)
*E06B 9/322* (2006.01)

(52) U.S. Cl.
CPC ..... *E06B 9/324* (2013.01); *E06B 9/322* (2013.01); *E06B 2009/3222* (2013.01)

(58) Field of Classification Search
CPC ... E06B 9/324; E06B 9/322; E06B 2009/3222
See application file for complete search history.

(56) References Cited

U.S. PATENT DOCUMENTS 2,557,978 A * 6/1951 Krumm ..... E06B 9/264 160/34
5,709,258 A * 1/1998 Coccoluto ..... E06B 9/326 16/442
6,516,860 B1 * 2/2003 Weaver ..... E06B 9/30 160/168.1 R
6,644,375 B2 * 11/2003 Palmer ..... E06B 9/322 160/170
6,823,925 B2 * 11/2004 Militello ..... E06B 9/262 160/170

(Continued)

FOREIGN PATENT DOCUMENTS

EP 2204528 A2 * 7/2010 ..... E06B 9/324
JP 2008088656 A * 4/2008

*Primary Examiner* — Hanh V Tran
(74) *Attorney, Agent, or Firm* — Muncy, Geissler, Olds & Lowe, P.C.

(57) ABSTRACT

A locking mechanism is disclosed, which is installed in a movable rail of a window covering, and is passed through by a cord. The locking mechanism includes a locking unit and a pressing member, wherein the locking unit includes a stopping member which is movable between a first position and a second position. The stopping member is normally located at the first position to abut against the cord, which prevents the cord from moving relative to the locking mechanism, whereby to maintain the position of the movable rail. By pressing the pressing member, the stopping member is moved to the second position, where the stopping member no longer abuts against the cord. Therefore, when the movable rail is moved in a direction away from a fixed rail of the window covering, the cord can move relative to the locking mechanism. Whereby, the movable rail can be smoothly moved downward.

23 Claims, 45 Drawing Sheets

(56) References Cited

U.S. PATENT DOCUMENTS

| | | | | |
|---|---|---|---|---|
| 7,025,107 | B2 * | 4/2006 | Ciuca | E06B 9/303 160/170 |
| 7,096,917 | B2 * | 8/2006 | Ciuca | E06B 9/322 160/170 |
| 7,690,415 | B2 * | 4/2010 | Cheng | E06B 9/322 160/170 |
| 9,435,154 | B2 * | 9/2016 | Chen | E06B 9/34 |
| 10,138,674 | B2 * | 11/2018 | Hsu | E06B 9/32 |
| 2006/0196612 | A1 * | 9/2006 | Strand | E06B 9/262 160/84.05 |
| 2008/0196843 | A1 * | 8/2008 | Nien | E06B 9/323 160/178.1 R |
| 2010/0206492 | A1 * | 8/2010 | Shevick | E06B 9/30 160/170 |
| 2011/0061823 | A1 * | 3/2011 | Lin | E06B 9/262 160/340 |
| 2012/0285634 | A1 * | 11/2012 | Zhu | E06B 9/326 160/340 |
| 2013/0008616 | A1 * | 1/2013 | Huang | E06B 9/32 160/84.01 |
| 2013/0112353 | A1 * | 5/2013 | Sengelaub | E06B 9/262 160/84.02 |
| 2014/0048220 | A1 * | 2/2014 | Cheng | E06B 9/24 160/368.1 |
| 2014/0076504 | A1 * | 3/2014 | Anthony | A47H 5/032 160/84.04 |
| 2015/0075729 | A1 * | 3/2015 | Anderson | E06B 9/262 160/193 |
| 2017/0107075 | A1 * | 4/2017 | Hung | B65H 75/4405 |
| 2019/0112871 | A1 * | 4/2019 | Huang | E06B 9/322 |

* cited by examiner

LOCKING MECHANISM FOR CORD OF WINDOW COVERING

BACKGROUND OF THE INVENTION

1. Technical Field

The present disclosure relates generally to a window covering, and more particularly to a locking mechanism for a cord of a window covering, regarding the operation of raising and lowering the window covering.

2. Description of Related Art

Typically, a window covering includes a headrail, a shielding structure, and a bottom rail, wherein the shielding structure is disposed between the headrail and the bottom rail. Said shielding structure is composed of slats or a cellular covering material, for example. However, the bottom rail tends to stay at a position other than expected after expanding or collecting the window covering to ascend or descend the bottom rail relative to the headrail.

Take a cordless window blind having a spring box as an example. The bottom rail stays at the required position mainly due to the pulling force provided by a spiral spring inside the spring box. However, a spiral spring may have a potential problem of elastic fatigue. Furthermore, the higher the bottom rail is, the more parts of the covering material (i.e., the components of the shielding structure) will be stacked on the bottom rail, and therefore the greater downward pulling force will be exerted onto the spring box due to the weights of the bottom rail and the covering material. As a result, the bottom rail may sag after arriving at its required position. To solve this problem, some manufacturers choose to use spiral springs with greater rewinding force to avoid elastic fatigue. It turns out that this kind of design is inconvenient and bothersome in use, for the user now has to pull harder to overcome the rewinding force of the spiral spring.

On the other hand, a tension window blind has a cord passing through the bottom rail, and two ends of the cord are respectively connected to the headrail and a window frame. The bottom rail can be pushed and moved along the cord to be stopped at any required position due to the friction created between the cord and the bottom rail. However, the friction would not be sufficient to position the bottom rail unless the cord is taut. In other words, whether the window covering can stay precisely at the required height depends on how taut the cord is. Even for a professional installer, it is still not an easy job to make a cord taut enough to create sufficient friction between the cord and the bottom rail. Furthermore, the pulling force provided by the user has to be greater than the friction created between the cord and the bottom rail, or the bottom rail cannot be moved. For a large window covering which has greater friction, moving the bottom rail requires much more effort. It is obvious that this kind of window covering is not easy to operate.

BRIEF SUMMARY OF THE INVENTION

In view of the above, the primary objective of the present disclosure is to provide a locking mechanism for a cord of a window covering, which could stop the bottom rail of the window covering precisely at any required position.

The present disclosure provides a locking mechanism for a window covering, wherein the window covering includes a fixed rail and a movable rail, and the movable rail is adapted to be moved relative to the fixed rail along at least one cord. The locking mechanism is provided in the movable rail, and includes a base and a locking unit. The base has a first opening and a second opening communicating with each other, wherein the first opening and the second opening are adapted to be passed through by the at least one cord. The locking unit includes at least one stopping member provided in the base, wherein the at least one stopping member is movable between a first position and a second position, and is adapted to be moved along with a movement of the movable rail. More specifically, when the movable rail is not being moved, the stopping member is located at the first position, where the stopping member is adapted to restrict the at least one cord from moving relative to the base; when the movable rail is being moved, the stopping member shifts away from the first position, and is adapted to allow the at least one cord to move relative to the base toward the first opening.

In an embodiment, the locking mechanism further includes a pressing member, which is operable to move the stopping member to the second position, where the stopping member is adapted to allow the at least one cord to move relative to the base toward the second opening when the movable rail is being moved in an opposite direction.

In an embodiment, the locking unit includes a toothed surface, and the stopping member includes a gear. A part of the gear meshes with the toothed surface, and another part of the gear is adapted to contact one of the at least one cord. When the stopping member is located at the first position, the another part of the gear is adapted to tightly abut against one of the at least one cord. The gear is adapted to be rotated along the toothed surface to leave the first position by the corresponding cord which is moving relative to the base toward the first opening when the movable rail is being moved.

In an embodiment, the locking mechanism further includes a reversion member, wherein the base includes an upper member, a lower member engaging with the upper member, a first protrusion, and a second protrusion. The first protrusion and the second protrusion are fixedly located between the upper member and the lower member. The toothed surface of the locking unit is formed on a side of the first protrusion. The gear is located between the upper member and the lower member, and is confined in a space between the first protrusion and the second protrusion. The reversion member exerts a pushing force onto the pressing member through the gear, which urges the pressing member to move toward an original position where the pressing member is when the pressing member is not operated.

In an embodiment, the upper member has a through hole and a blind hole respectively provided on two sides thereof. The pressing member has an extended portion passing through the through hole, wherein an end of the extended portion abuts against the gear, while another end thereof is located outside of the base. The reversion member includes a spring and a pushing member, which are both provided in the blind hole. The spring pushes against the pushing member to move the pushing member outward, so that a part of the pushing member abuts against the gear.

In an embodiment, the lower member has a separated chamber. The at least one cord of the window covering includes two cords. A space between the upper member and the lower member is adapted to be passed through by one of the cords, and the separated chamber is adapted to be passed through by the other one of the cords.

In an embodiment, the toothed surface of the locking unit has a first end and a second end, and the toothed surface is provided in a tilted manner, so that the space between the first protrusion and the second protrusion has a larger room on a side near the reversion member than on another side near the pressing member. When the stopping member is located at the first position, the gear is near the first end of the toothed surface; when the stopping member is located at the second position, the gear is near the second end of the toothed surface.

In an embodiment, the base includes an upper member and a lower member engaging with each other. The locking unit includes a swing member pivotally provided between the upper member and the lower member. The toothed surface is provided on a side of the swing member.

In an embodiment, the pressing member includes an extended portion. A part of the extended portion extends into a space between the upper member and the lower member, and the extended portion has a protruded portion and a recessed portion provided on the part thereof extending into the space between the upper member and the lower member. Another part of the extended portion is located outside of the base. When the pressing member is not being operated, the swing member abuts against the protruded portion of the extended portion, so that the stopping member is located at the first position; when the pressing member is being operated and moved, the swing member is moved backward into the recessed portion of the extended portion, so that the stopping member is located at the second position, where the stopping member is adapted to allow the at least one cord to move relative to the base toward the second opening.

In an embodiment, the locking mechanism further includes a reversion member provided between the upper member and the lower member, wherein the reversion member exerts a pushing force onto the pressing member, which urges the pressing member to move toward an original position where the pressing member is when the pressing member is not operated.

In an embodiment, the lower member has a separated chamber. The at least one cord of the window covering includes two cords. A space between the upper member and the lower member is adapted to be passed through by one of the cords, and the separated chamber is adapted to be passed through by the other one of the cords.

In an embodiment, the locking unit includes a toothed surface. The stopping member includes a gear. A space between the toothed surface and the gear is adapted to be passed through by one of the at least one cord. When the stopping member is located at the first position, the gear meshes with the toothed surface, and abuts against the corresponding cord. The gear is adapted to be pushed to leave the first position by the corresponding cord which is moved relative to the base toward first opening when the movable rail is being moved.

In an embodiment, the base is provided with a first passage and a second passage. The first passage respectively forms the first opening and the second opening on side surfaces of the base. The first passage has the toothed surface provided on a bottom surface thereof. The second passage and the first passage intersect and communicate with each other. The locking unit includes a contact block, which is movably provided in the second passage, and abuts against the gear.

In an embodiment, the base is provided with a third passage. The third passage and the second passage intersect and communicate with each other. The pressing member includes an extended portion provided in the third passage. The extended portion has a protruded portion and a recessed portion. When the pressing member is not pressed, the protruded portion pushes and abuts against the contact block located below, which forces the gear to stay at the first position; when the pressing member is operated and moved, the recessed portion of the extended portion allows the contact block to move upward, which allows the gear to move to the second position, where the gear is adapted to allow the cord to move relative to the base toward the second opening.

In an embodiment, the locking mechanism further includes a reversion member. The third passage has an enclosed end. The reversion member is provided in the third passage, wherein an end of the reversion member abuts against the enclosed end, and another end thereof abuts against the pressing member, which urges the pressing member to move toward an original position where the pressing member is when the pressing member is not operated.

In an embodiment, the base includes a lower member, which has a recessed chamber. The toothed surface is provided on a side wall of the recessed chamber. The locking unit includes a sway member pivotally connected to the lower member, wherein the sway member sways in the recessed chamber. An end of the sway member is connected to the gear, and an opposite end thereof is connected to the pressing member. When the pressing member is not operated, the gear is located at the first position; when the pressing member is operated, the gear is movable to the second position.

In an embodiment, the locking mechanism further includes a reversion member provided in the recessed chamber, wherein the reversion member exerts a pushing force onto the sway member, which urges the pressing member to move toward an original position where the pressing member is when the pressing member is not operated.

In an embodiment, the window covering is installed in a window frame. An end of the at least one cord is fixedly connected to the fixed rail, while another end thereof is fixedly connected to the window frame after passing through the base.

In an embodiment, the window covering further includes a spring box provided in the movable rail. An end of the at least one cord is fixedly connected to the fixed rail, while another end thereof is connected to a reel of the spring box after passing through the base.

In an embodiment, an upper part and a lower part of the base each has a cord hole going through two side walls thereof. Each of the cord holes respectively forms the first opening and the second opening on the two side walls. Positions of the first openings on the upper part and the lower part of the base are staggered. The at least one cord includes two cords, each of which individually passes through one of the cord holes. The locking unit includes two non-slip structures, each of which is respectively formed on a wall of one of the cord holes. The at least one stopping member includes two stopping members, each of which respectively includes a roller provided in one of the cord holes. The pressing member includes two pushing rods, each of which goes into the base, with an end thereof pushing against the roller located in one of the cord holes. When the pressing member is not operated, the gear is located at the first position; when the pressing member is operated and moved, each of the pushing rods pushes the corresponding roller toward the second position, whereby each of the cords is movable relative to the base toward the second opening.

In an embodiment, the locking mechanism further includes a reversion member provided between the base and the pressing member, wherein the reversion member exerts a pushing force onto the pressing member, which urges the pressing member to move toward an original position where the pressing member is when the pressing member is not operated.

In an embodiment, the first opening and the second opening of the base are provided on different sides of the base.

In an embodiment, the first opening and the second opening of the base are provided on the same side of the base.

By providing the locking mechanism on the window covering, the movable rail could be precisely positioned after being moved, and the cord is not necessary to be very taut. Furthermore, the movable rail could be moved with less effort.

By controlling the location of the stopping member of the locking unit, the movable rail could precisely stay at the position where the user stops pushing it up, and would not sag. When the user presses the pressing member and pulls down the movable rail, the movable rail would immediately stay at its position, without sagging, once the user stops pressing the pressing member.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1:
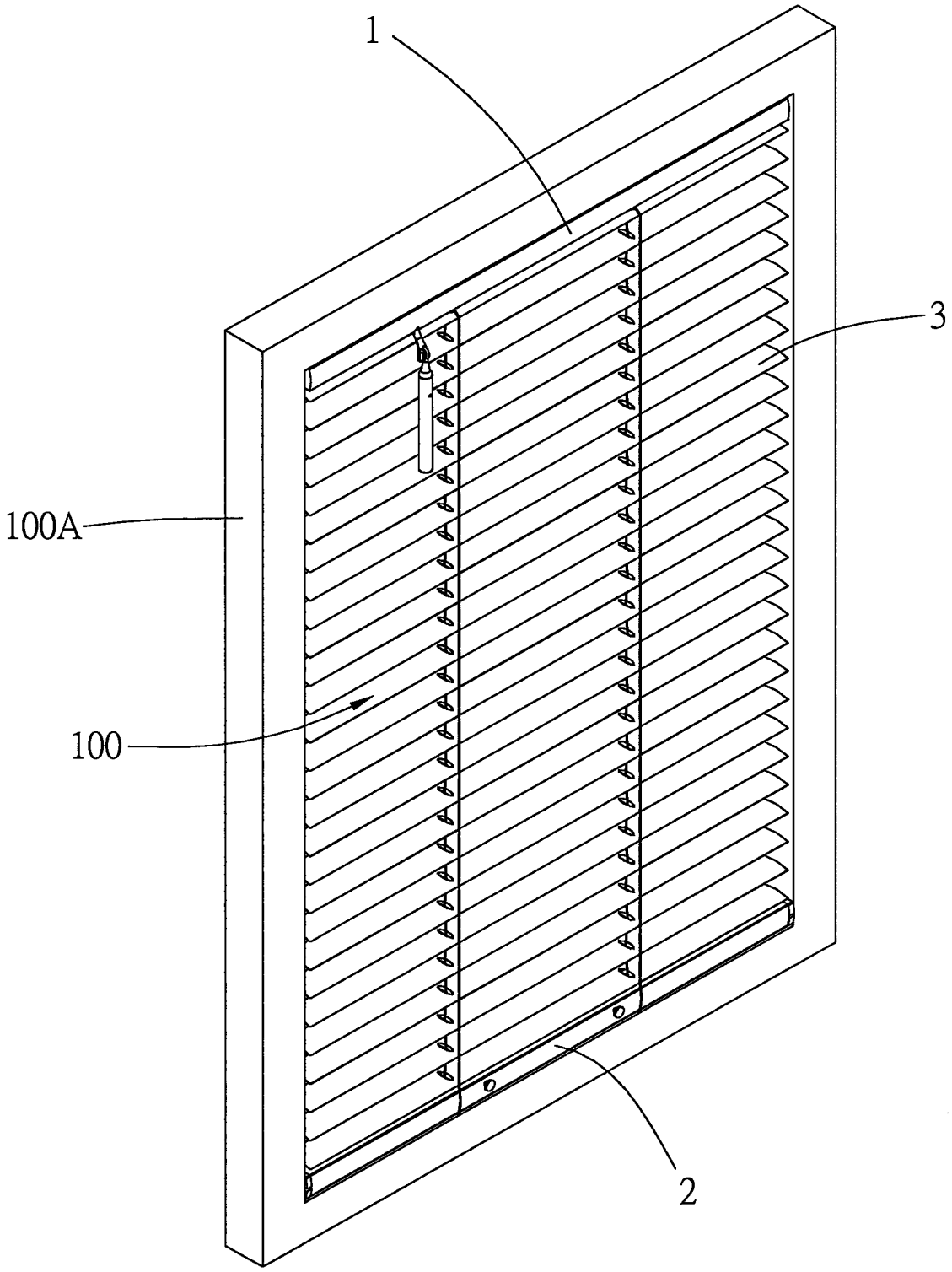
FIG. 1 is a perspective view of the window covering which includes two sets of locking mechanisms of a first embodiment of the present disclosure.
Figure 2:
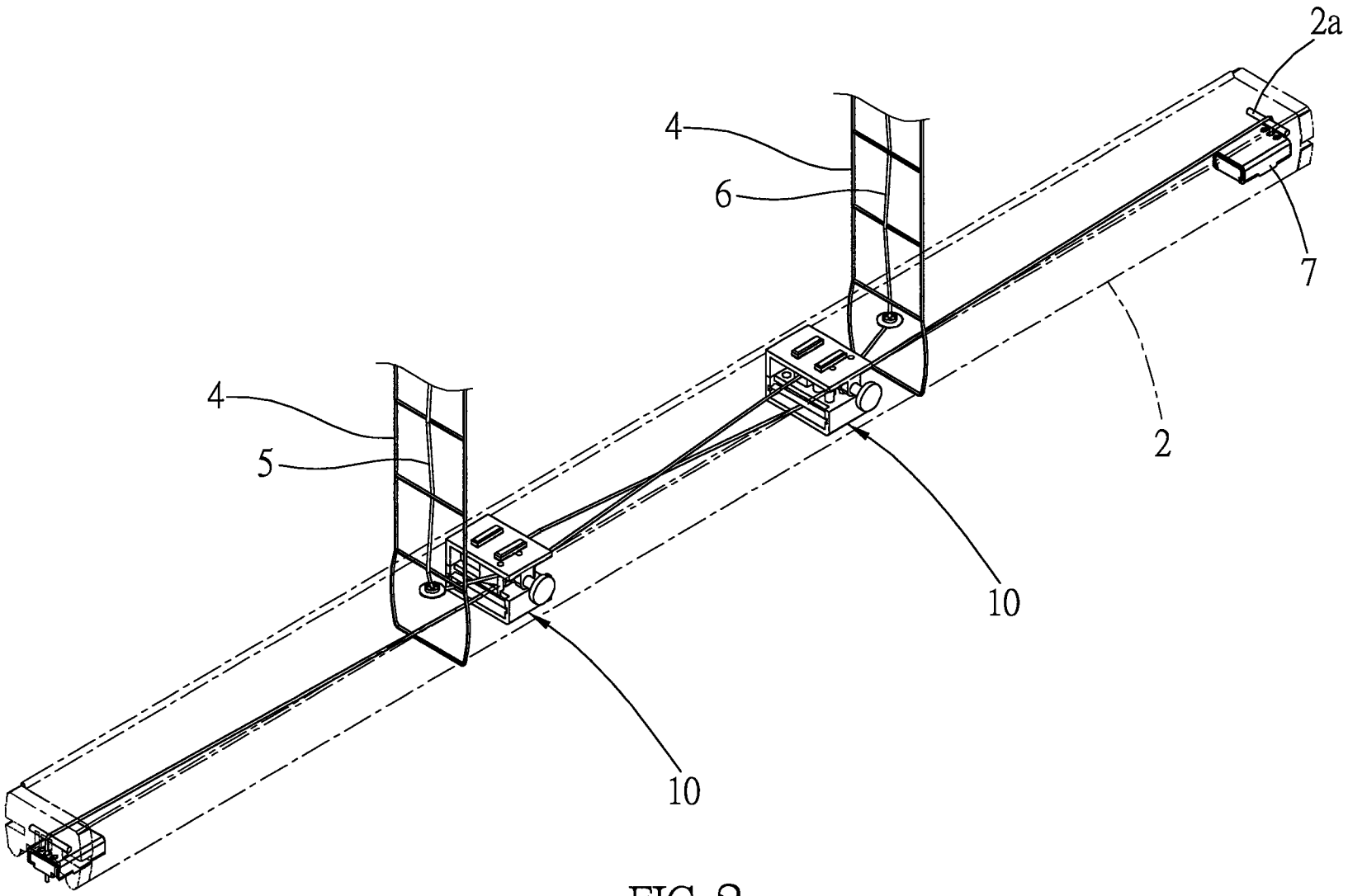
FIG. 2 is a perspective view, showing the relative positions of the bottom rail of the window covering illustrated in FIG. 1 and the locking mechanisms.
Figure 3:
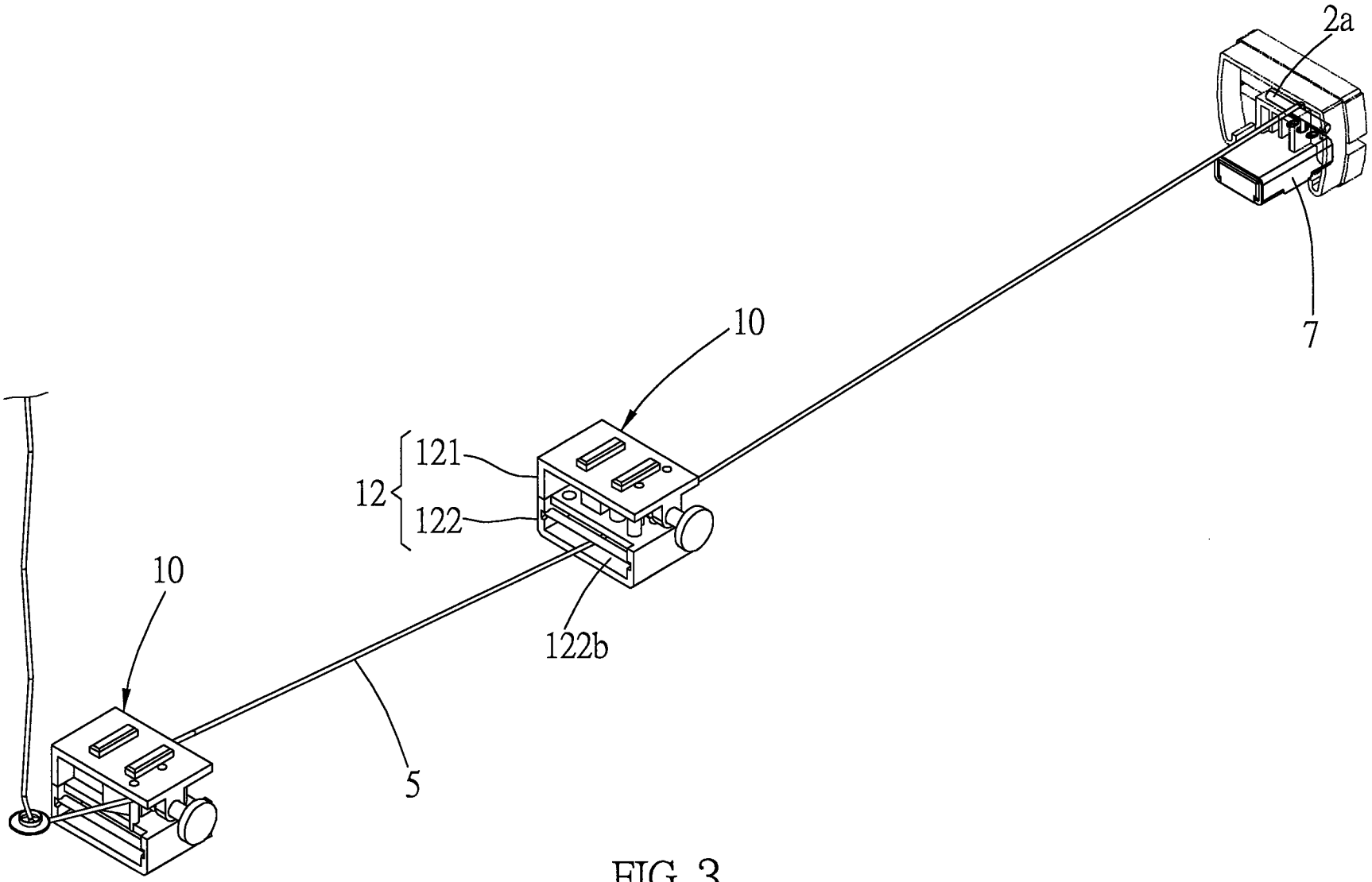
FIG. 3 is a perspective view, showing the relative positions of one of the cords and the locking mechanisms illustrated in FIG. 2.
Figure 4:
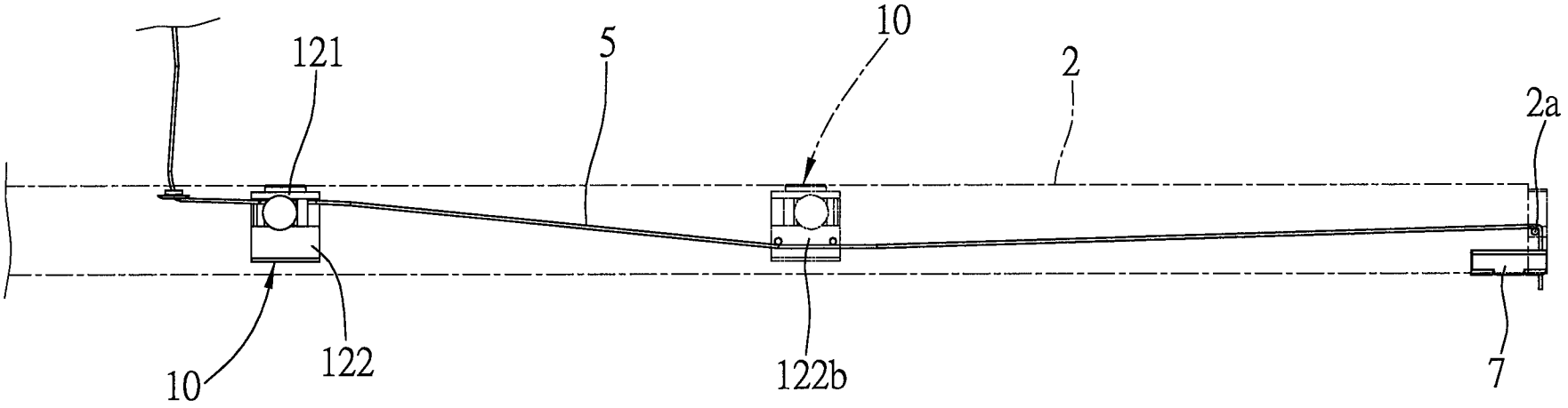
FIG. 4 is a front view of FIG. 3.

A window covering 100 including two sets of locking mechanisms 10 of a first embodiment of the present disclosure is illustrated in FIG. 1 to FIG. 4, wherein the window covering 100 is installed inside a window frame 100A. The window covering 100 includes a headrail 1, which is also called a fixed rail as defined in the present disclosure, a bottom rail 2, which is also called a movable rail as defined in the present disclosure, and a shielding structure, which includes, by way of example and not as a limitation, a plurality of slats 3. The slats 3 are suspended in parallel between the headrail 1 and the bottom rail 2 through two ladders 4. The bottom rail 2 is adapted to be moved relative to the headrail 1 by two cords 5, 6, whereby to expand or collect the window covering 100.

Figure 9:
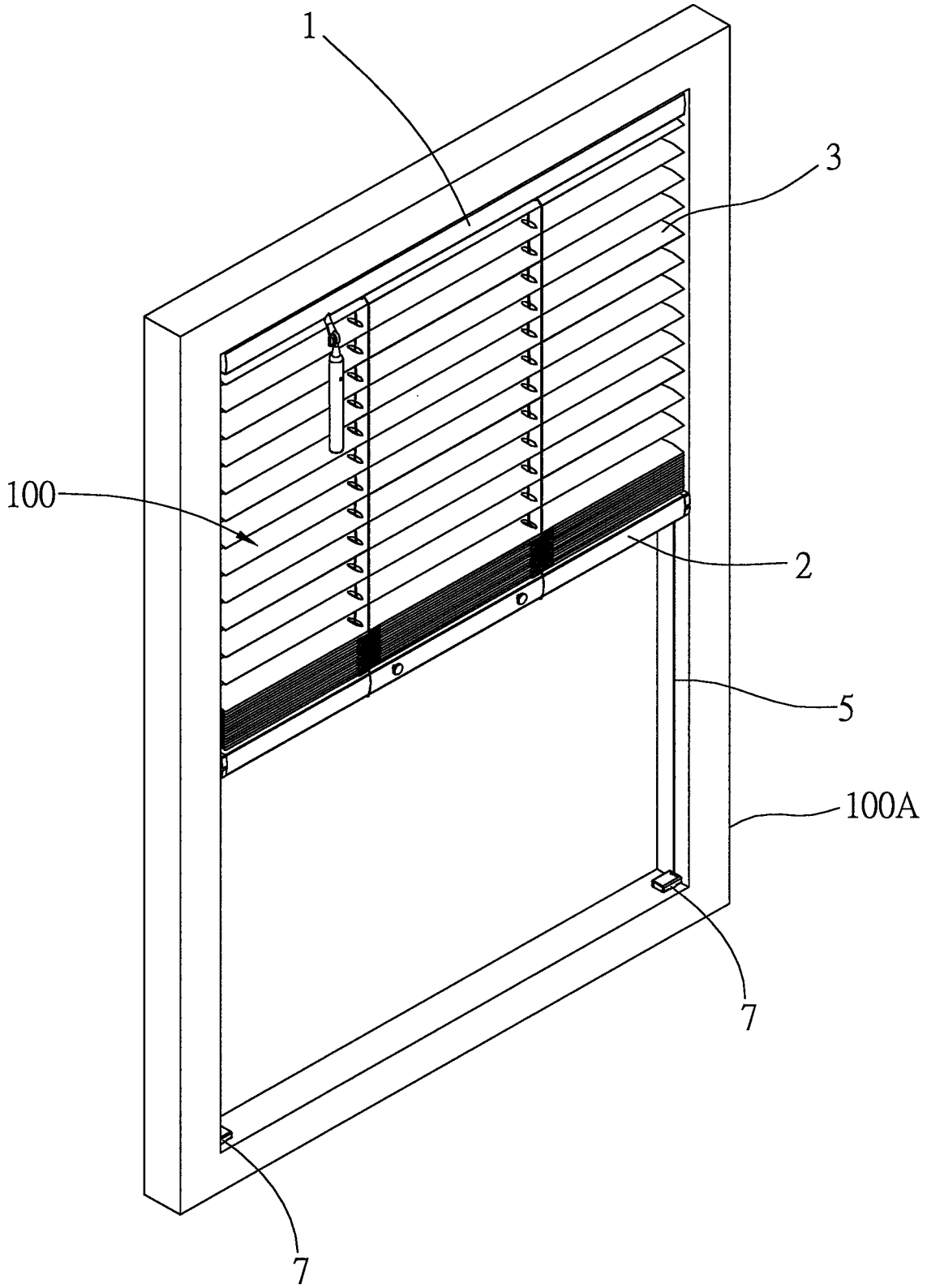
FIG. 9 is an exploded view, showing the condition when the window covering is partially collected.

Two sets of locking mechanisms 10 are included in the window covering 100, and are disposed in the bottom rail 2 separately. With an end fixed to the headrail 1, each of the cords 5, 6 sequentially passes through the slats 3, the bottom rail 2, and then the two sets of locking mechanisms 10. After passing through the locking mechanisms 10 and winding around a rod 2*a* of an end cover located on each side of the bottom rail 2, each of the cords 5, 6 passes through the bottom rail 2 again, with another end thereof fixedly connected to a fixed seat 7, respectively. Each of the fixed seats 7 is fixedly connected to the window frame 100A, as shown in FIG. 9. By fixing two ends, each of the cords 5, 6 would be taut, and have a fixed length. With such design, the bottom rail 2 could be moved vertically along the cords 5, 6. In other words, the window covering 100 described above is a tension window blind. It needs to be clarified that, though the aforementioned cords 5, 6 are fixedly connected to the window frame 100A through the fixed seats 7, in other environments having no window frames, the connected end of the cords 5, 6 could be directly fixedly connected to a wall of a building.

In the following paragraphs, we are going to explain how the bottom rail 2 can be stopped at any required position without being interfered by the locking mechanisms 10 of the first embodiment of the present disclosure. For ease of explanation, we will only use one out of the two sets of locking mechanisms 10 for discussion hereinafter.

Figure 5:
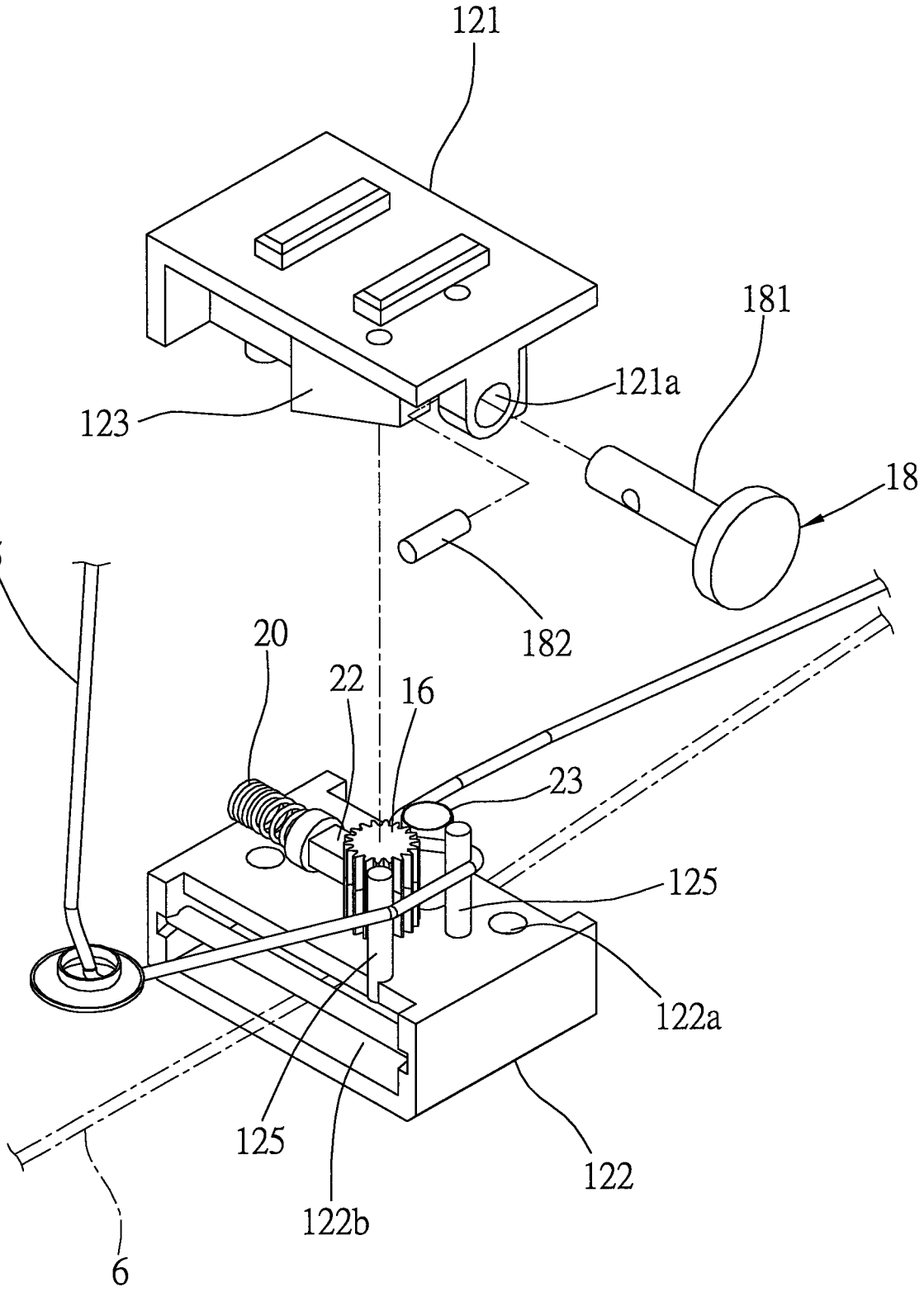
FIG. 5 is a perspective exploded view of the locking mechanism of the first embodiment of the present disclosure.
Figure 6:
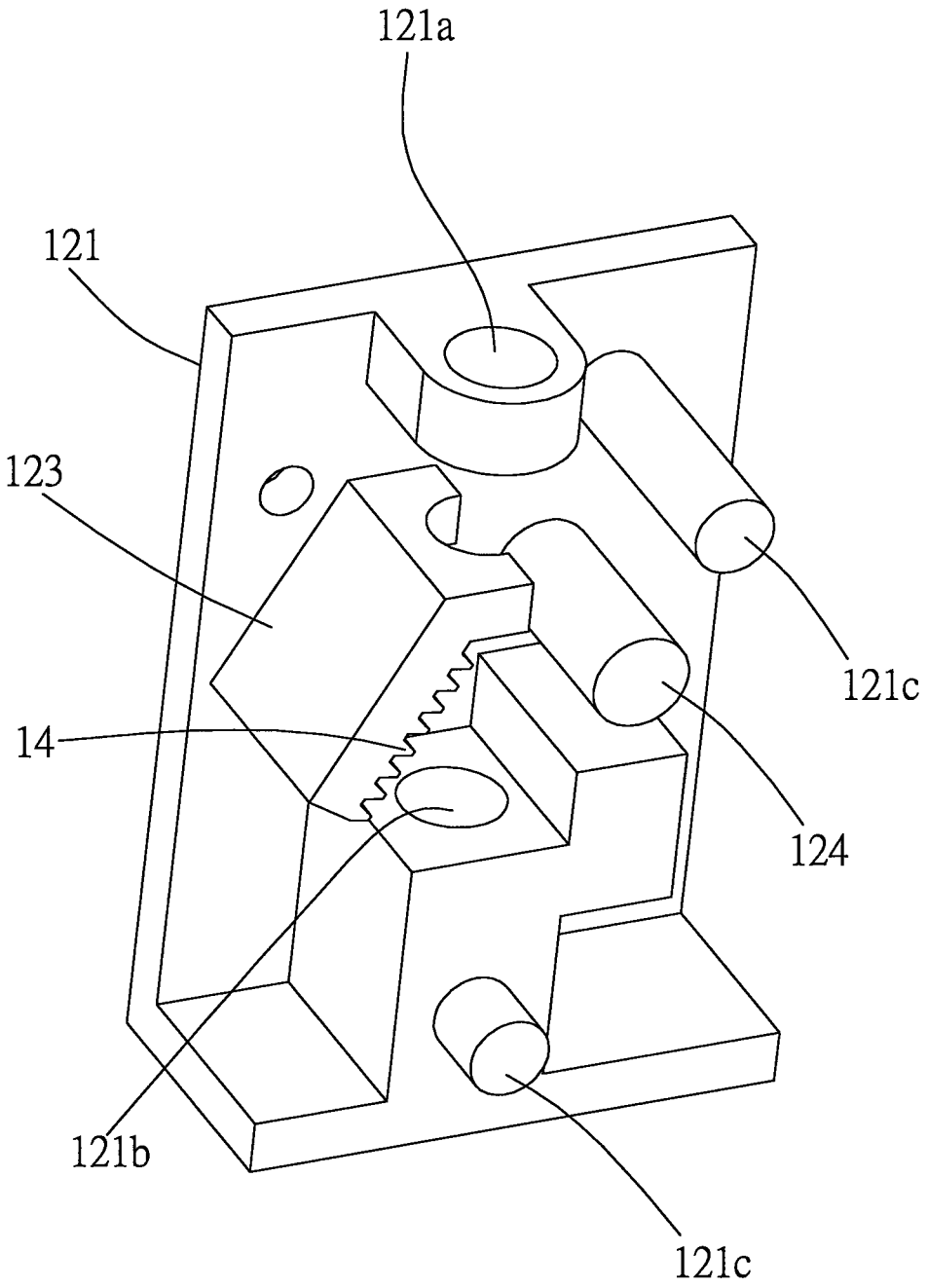
FIG. 6 is an exploded view of the upper member illustrated in FIG. 5.
Figure 7:
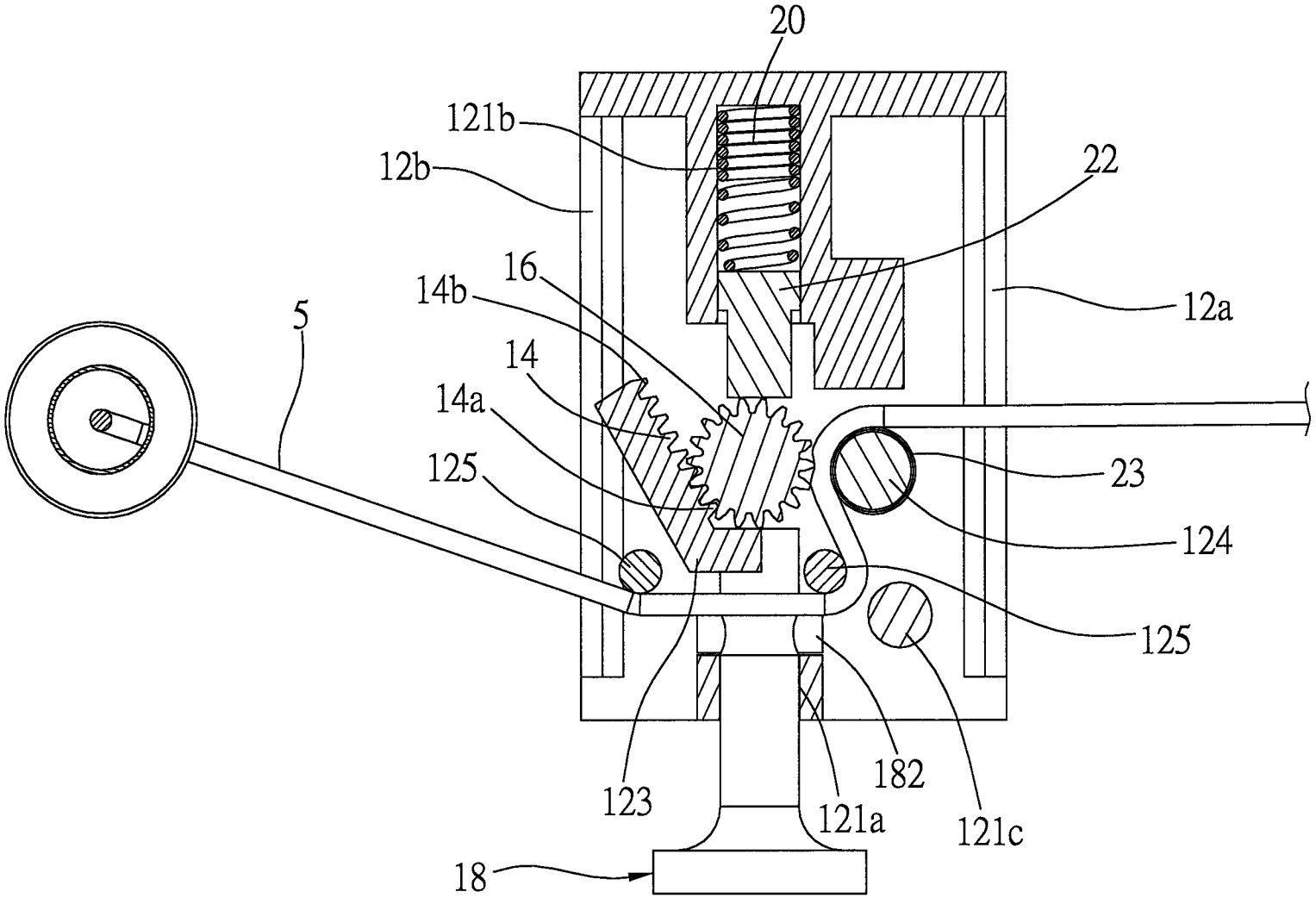
FIG. 7 is a top view omitting the upper member, showing the gear of the locking mechanism tightly abuts against the cord.

As shown in FIG. 5 to FIG. 7, the locking mechanism 10 includes a base 12, which is formed by engaging an upper member 121 with a lower member 122. The base 12 has a first opening 12*a* and a second opening 12*b* formed on two sides thereof, wherein the first opening 12*a* and the second opening 12*b* communicate with each other. In addition, the base 12 includes a first protrusion 123 and a second protrusion 124 provided between the upper member 121 and the lower member 122. In the current embodiment, the first protrusion 123 and the second protrusion 124 are integrally connected to a bottom surface of the upper member 121. One of the cords (i.e., the cord 5) passes through the base 12 via the second opening 12*b* and the first opening 12*a*, and winds around (i.e., changes its direction) through a plurality of guiding posts 125 and the second protrusion 124. In addition, the upper member 121 further has a protrusion provided on a front side thereof, and has another protrusion provided on a rear side thereof opposite to the front side. A through hole 121*a* is provided on the protrusion on one side, while a blind hole 121*b* is provided on the another protrusion on the other side.

The lower member 122 of the base 12 has a plurality of positioning holes 122*a* on a surface thereof, wherein the positioning holes 122*a* are adapted to be aligned with and inserted by a plurality of positioning posts 121*c* of the upper member 121, whereby to engage the upper member 121 with the lower member 122. The lower member 122 has a separated chamber 122*b*, which is adapted to be passed through by the other one of the cords (i.e., the cord 6). In other words, the cord 5 passes through the space between the upper member 121 and the lower member 122, and the cord 6 passes through the separated chamber 122*b*. In this way, the cords 5, 6 would not interfere with each other.

The locking mechanism 10 further includes a locking unit, which includes a toothed surface 14 formed on a side of the first protrusion 123. The toothed surface 14 has a first end 14*a* and a second end 14*b*, and is provided in an inclined manner, so that the space between the first protrusion 123 and the second protrusion 124 gradually increases from the front side toward the rear side. The locking unit further includes a stopping member, which is a gear 16 as an example. The gear 16 is located between the upper member 121 and the lower member 122, and is confined between the first protrusion 123 and the second protrusion 124. A part of the gear 16 meshes with the toothed surface 14, and another part thereof contacts the cord 5.

The locking mechanism 10 further includes a pressing member 18 and a reversion member. The pressing member 18 has an extended portion 181 passing through the through hole 121*a* of the upper member 121, wherein an end of the extended portion 181 abuts against the gear 16, while another end thereof extends out of the base 12 to be manually pressed by a user. However, pressing the pressing member 18 by hand is merely an exemplified operational method provided in the present disclosure. In practice, the pressing member could also be operated by being rotated, flicked, or through other equivalent methods. A plug 182 passes through the extended portion 181 of the pressing member 18, so that the extended portion 181 would appropriately abut against the protrusion with the through hole 121*a*, and therefore would not disengage from the upper member 121. The reversion member includes a spring 20 and a pushing member 22 provided in the blind hole 121*b*, wherein the spring 20 pushes the pushing member 22 to move outward, so that a part of the pushing member 22 abuts against the gear 16. In the current embodiment, the pushing force provided by the spring 20 is exerted to the gear 16 through the pushing member 22, and then to the pressing member 18. In this way, the pressing member 18 would tend to return to the original position when it is not pressed by the user.

The components and the structural relations between the components of the locking mechanism 10 of the first embodiment of the present disclosure have been illustrated above, and now we are going to discuss the function of the locking mechanism 10.

The bottom rail 2 illustrated in FIG. 7 is in a stationary state. At this time, the gear 16 of the locking mechanism 10 would be pushed by the spring 20, and therefore would stay at a first position near the first end 14*a* of the toothed surface 14. Since the length of the cord 5 is fixed, and the cord 5 is taut as two ends thereof are fixed, with the help of the weight of the bottom rail 2 and the slats 3 carried thereon, part of the teeth of the gear 16 would tightly abut against the cord 5 at where it winds around (i.e., changes its direction) by passing the second protrusion 124. It is also worth mentioning that, in the current embodiment, a metal ring 23 is further provided to fit around the second protrusion 124, whereby to reduce the friction of the cord 5.

Figure 8:
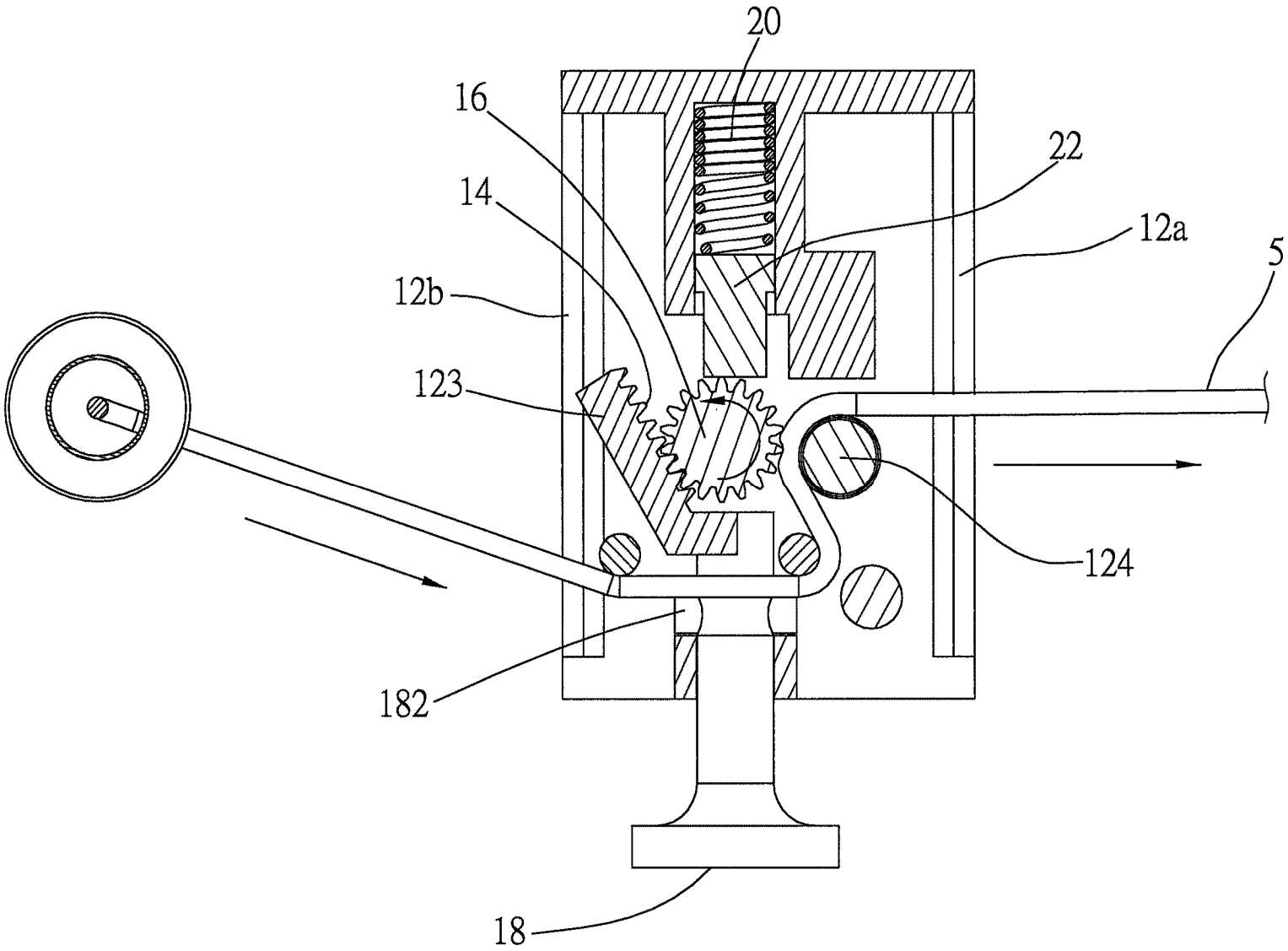
FIG. 8 is similar to FIG. 7, showing the cord is pulled in a direction toward the first opening of the base, and the gear shifts.

As shown in FIG. 8, while the bottom rail 2 is being pushed upward toward the headrail 1 along the cord 5, the cord segment exposed between the fixed seat 7 and the locking mechanism 10 in the bottom rail 2 would become longer, and the cord segment between the headrail 1 and the locking mechanism 10 in the bottom rail 2 would become shorter, or the bottom rail 2 would not be moved gradually upward. At this time, the cord 5 would be moved toward the first opening 12*a* of the base 12 relative to the locking mechanism 10, which would rotate the gear 16 counterclockwise, for the gear 16 tightly abuts against the cord 5. Since a part of the gear 16 is pushed against by the pushing member 22, and another part of the gear meshes with the toothed surface 14 of the first protrusion 123, the gear 16 would move toward the second end 14*b* from the first end 14*a* along the toothed surface 14 of the first protrusion 123 along with the rotation. Whereby, the gear would slightly shift away from the first position, and would compress the spring 20. Since the space between the first protrusion 123 and the second protrusion 124 gradually increases from the front side toward the rear side, the gear 16 would no longer tightly abut against the cord after shifting away from the first position due to the change in space. In this way, the cord 5 could be freely moved toward the first opening 12*a*. Therefore, the bottom rail 2 could be smoothly pushed up without being interfered, changing the lengths of cord segments of the cord 5 on two sides of the locking mechanism 10.

As shown in FIG. 9, when the user stops pushing up the bottom rail 2, the cord 5 would also stop moving immediately. The slightly-shifted gear 16 would then return to the first position illustrated in FIG. 7 through the reversion force provided by the spring 20. Once the gear 16 returns to the first position, part of the teeth thereof would, again, tightly abut against the cord 5 at where the cord 5 winds around at the second protrusion 124. At the same time, the weight of the bottom rail 2 and the slats 3 carried thereon would urge the cord 5 to move toward the second opening 12*b* of the base 12 relative to the locking mechanism 10, which would slightly rotate the gear 16 clockwise to mesh with and move along the toothed surface 14 of the first protrusion 123 toward the first opening 12*a*. Due to the change in space between the first protrusion 123 and the second protrusion 124, the gear 16 would abut against the cord 5 more tightly, preventing the cord 5 from moving relative to the base 12. In other words, the bottom rail 2 would be positioned precisely and immediately, and the movement would not be even noticeable. Therefore, no matter where the bottom rail 2 is moved to, it would precisely stay at where it is once the user stops pushing it up. Furthermore, the bottom rail 2 would not sag for even a little bit.

Figure 10:
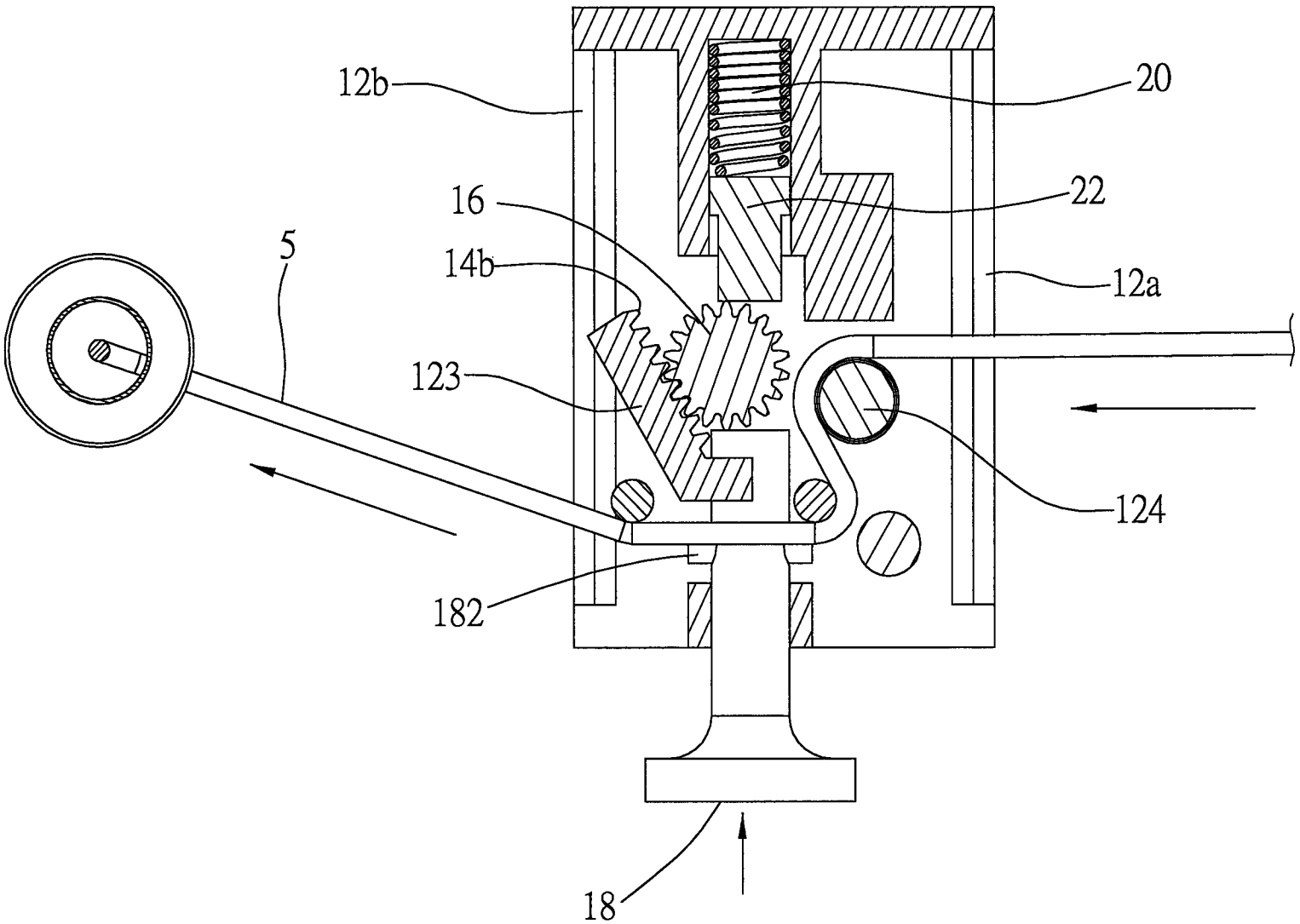
FIG. 10 is similar to FIG. 7, showing the cord is pulled in a direction toward the second opening of the base.

The condition when the bottom rail 2 is pulled down to expand the window covering 100 and change the shielded area is shown in FIG. 10. The gear 16 is confined by the pressing member 18, the pushing member 22, and the cord 5 passing by the second protrusion 124 in a normal state illustrated in FIG. 7. By pressing the pressing member 18 inward by hand, the gear 16 could be rotated along toothed surface 14, and shift away from the second protrusion 124. Herein we define that the gear 16 is located at a second position when the gear 16 is moved to a position near the second end 14*b* of the toothed surface 14. At the same time, the gear 16 would compress and deform the spring 20 through the pushing member 22. After that, the bottom rail 2 could be continuously pulled down, for the teeth of the gear 16 would no longer tightly abut against the cord 5, and two ends of the cord 5 are fixed. Therefore, while the locking mechanism 10 is being moved downward along with the bottom rail 2, the cord 5 would move toward the second opening 12*b* relative to the base 12, so that the bottom rail 2 could be smoothly moved downward.

Once when the pressing member 18 is not pressed, the pressing member 18 would automatically return to its original position due to the pushing of the spring 20. On the other hand, the gear 16 would be also pushed back to the first position, and the cord 5 would be unmovably confined between the gear 16 and the second protrusion 124 again. In this way, during the operation of pulling down the bottom rail 2, it would precisely stay at the position it is at the moment when the user stops pressing the pressing member 18. Furthermore, the bottom rail 2 would not sag at the same time.

As it can be seen in the above descriptions, no matter the bottom rail 2 is moved toward or away from the headrail 1, the locking mechanism 10 would not interfere with the operation of the bottom rail 2. Furthermore, once when the upward pushing force exerted to the bottom rail 2 is dismissed, or when the user stops pressing the pressing member 18 as pulling down the bottom rail 2, the locking mechanism 10 could immediately provide a locking effect to the cord 5, whereby to precisely stop the bottom rail 2, and to prevent the problem of sagging of the bottom rail 2.

Figure 11:
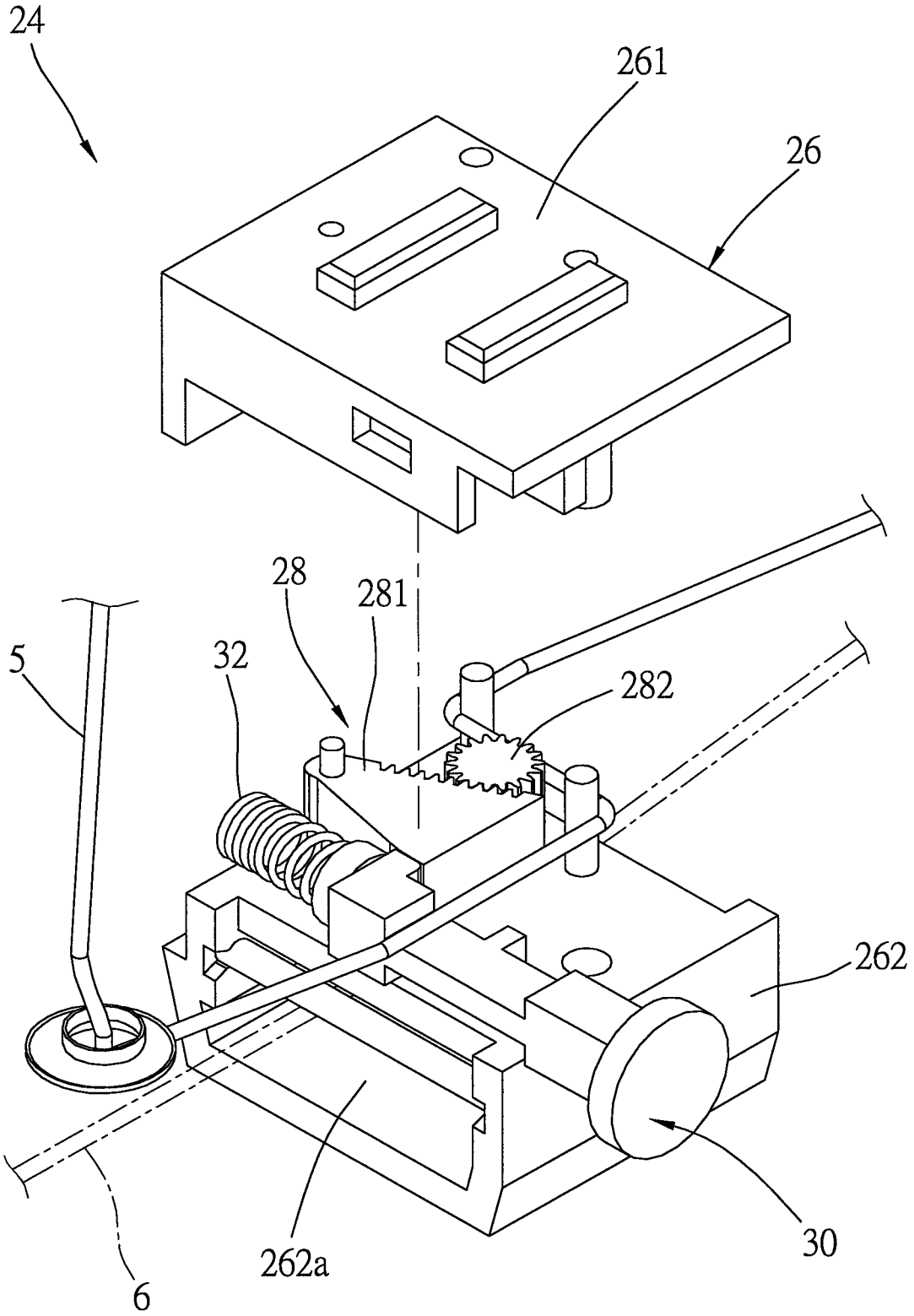
FIG. 11 is a perspective exploded view of the locking mechanism of a second embodiment of the present disclosure.
Figure 12:
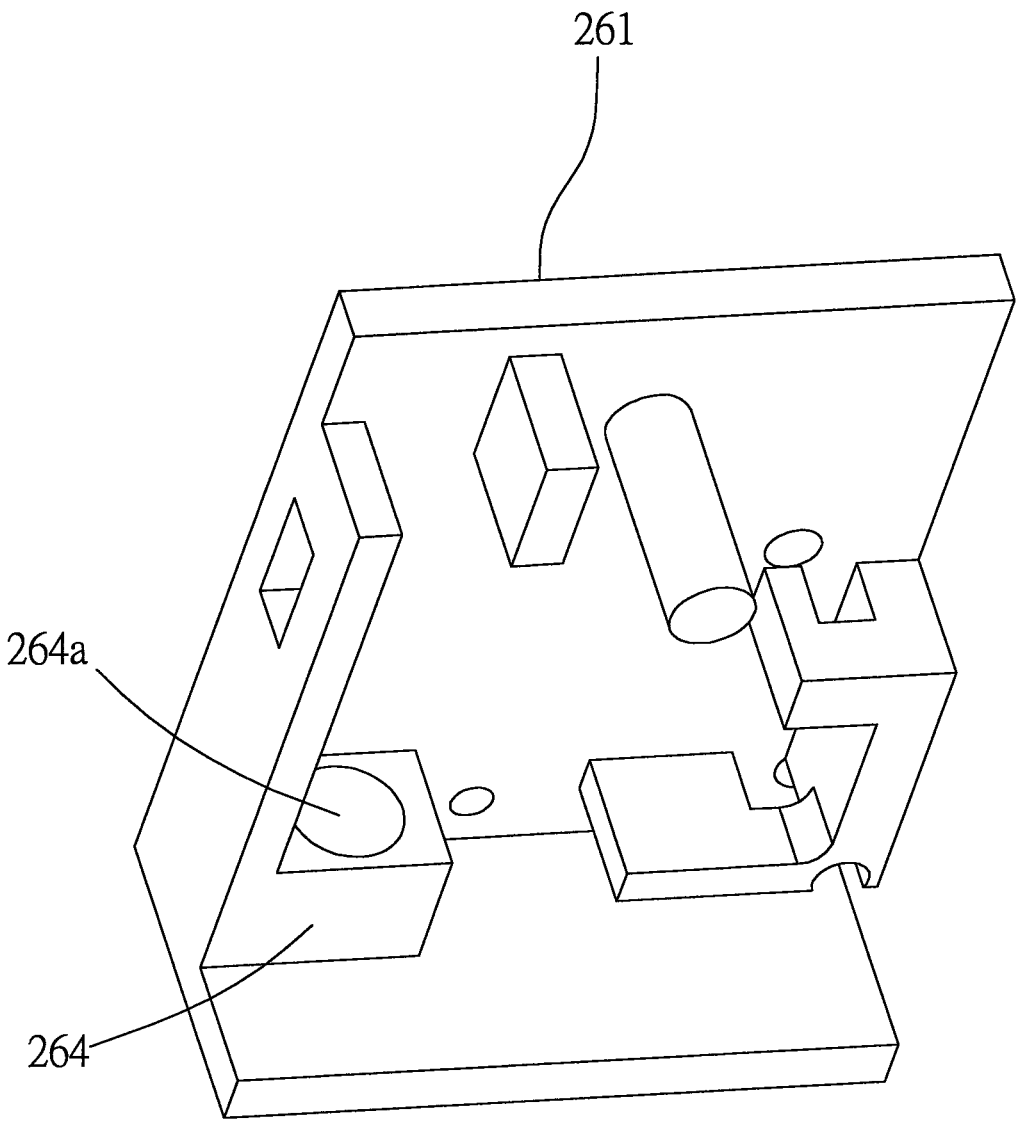
FIG. 12 is an exploded view of the upper member illustrated in FIG. 11.
Figure 13:
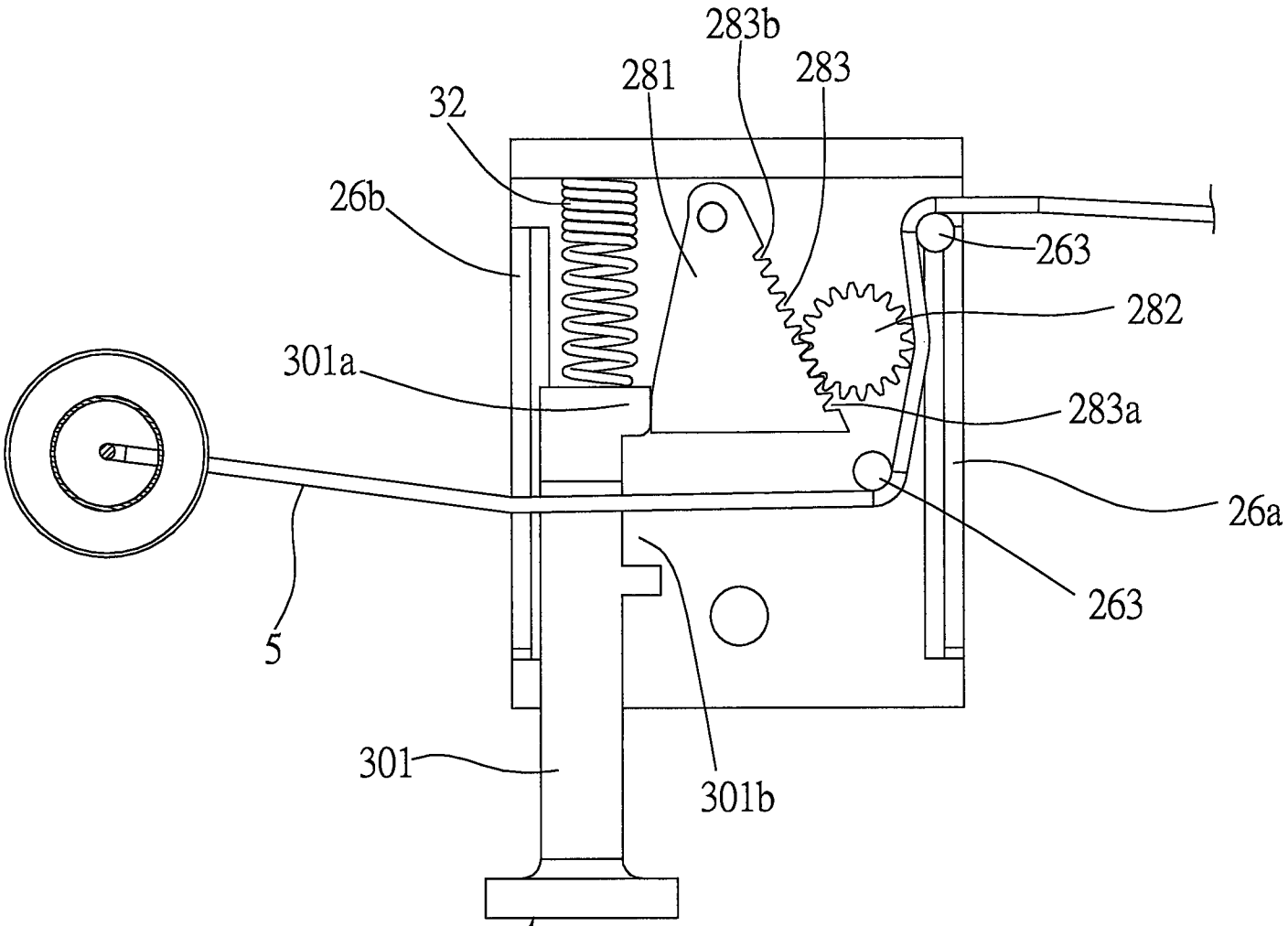
FIG. 13 is a top view omitting the upper member, showing the gear of the locking mechanism tightly abuts against the cord.

We are going to illustrate other kinds of locking mechanisms which could also achieve the aforementioned objective in the following paragraphs. A locking mechanism 24 of a second embodiment of the present disclosure is illustrated in FIG. 11 to FIG. 13, which is also applied in the window covering 100 mentioned in the first embodiment. The number of sets of the locking mechanisms 24 included in the window covering 100 corresponds to the number of the cords, and therefore there are multiple sets applied therein. Again, we only take one set of the locking mechanisms 24 as an example for discussion herein, which includes a base 26, a locking unit 28, a pressing member 30, and a reversion member 32.

The base 26 is formed by engaging an upper member 261 with a lower member 262, forming a first opening 26*a* and a second opening 26*b* on two sides, which communicate with each other. The cord 5 passes through the first opening 26*a* and the second opening 26*b*, wherein the cord segment between the upper member 261 and the lower member 262 winds around (i.e., changes its direction) through a plurality of guiding posts 263. The upper member 261 has a block 264 provided on a rear side thereof, wherein the block 264 has a blind hole 264*a*. The lower member 262 has a separated chamber 262*a*, which is adapted to be passed through by the other cord 6. With such design, the cord 5 passes through the space between the upper member 261 and the lower member 262, while the cord 6 passes through the separated chamber 262*a*. Therefore, the cords 5, 6 would not interfere with each other.

The locking unit 28 includes a swing member 281 and a stopping member which is a gear 282 as an example. The swing member 281 is substantially a triangle block pivotally provided between the upper member 261 and the lower member 262. The swing member 281 has a toothed surface 283 provided on a side thereof, wherein the toothed surface 283 has a first end 283*a* and a second end 283*b*. The space in the lower member 262 left between the toothed surface 283 and the corresponding guiding post 263 gradually increases from the first end 283*a* toward the second end 283*b*. A part of the gear 282 meshes with the toothed surface 283, while another part thereof contacts the cord 5.

The pressing member 30 includes an extended portion 301, of which a part extends into the space between the upper member 261 and the lower member 262, wherein said part has a protruded portion 301*a* and a recessed portion 301*b*. Another part of the extended portion 301 is outside of the base 26 to be pressed. The reversion member 32 is a spring, and is received in the blind hole 264*a*, wherein the pushing force provided by said spring is directly exerted onto the pressing member 30, whereby the pressing member 30 would be urged to move toward the original position, i.e., where the pressing member 30 is when it is not pressed.

The components and the relative positions of the locking mechanism 24 of the second embodiment of the present disclosure have been explained in the above paragraphs. Similar to the first embodiment, the length of the cord 5 is fixed, and the cord 5 is taut as two ends thereof are fixed. As shown in FIG. 13, when the bottom rail 2 is in a stationary state, the protruded portion 301*a* of the pressing member 30, located at the original position where the pressing member 30 is when the pressing member 30 is not being pressed, would abut against a side of the swing member 281, preventing the swing member 281 from pivoting clockwise. At this time, the gear 282 stays at the first position near the first end 283*a* of the toothed surface 283, with part of teeth thereof tightly abutting against the cord 5.

Figure 14:
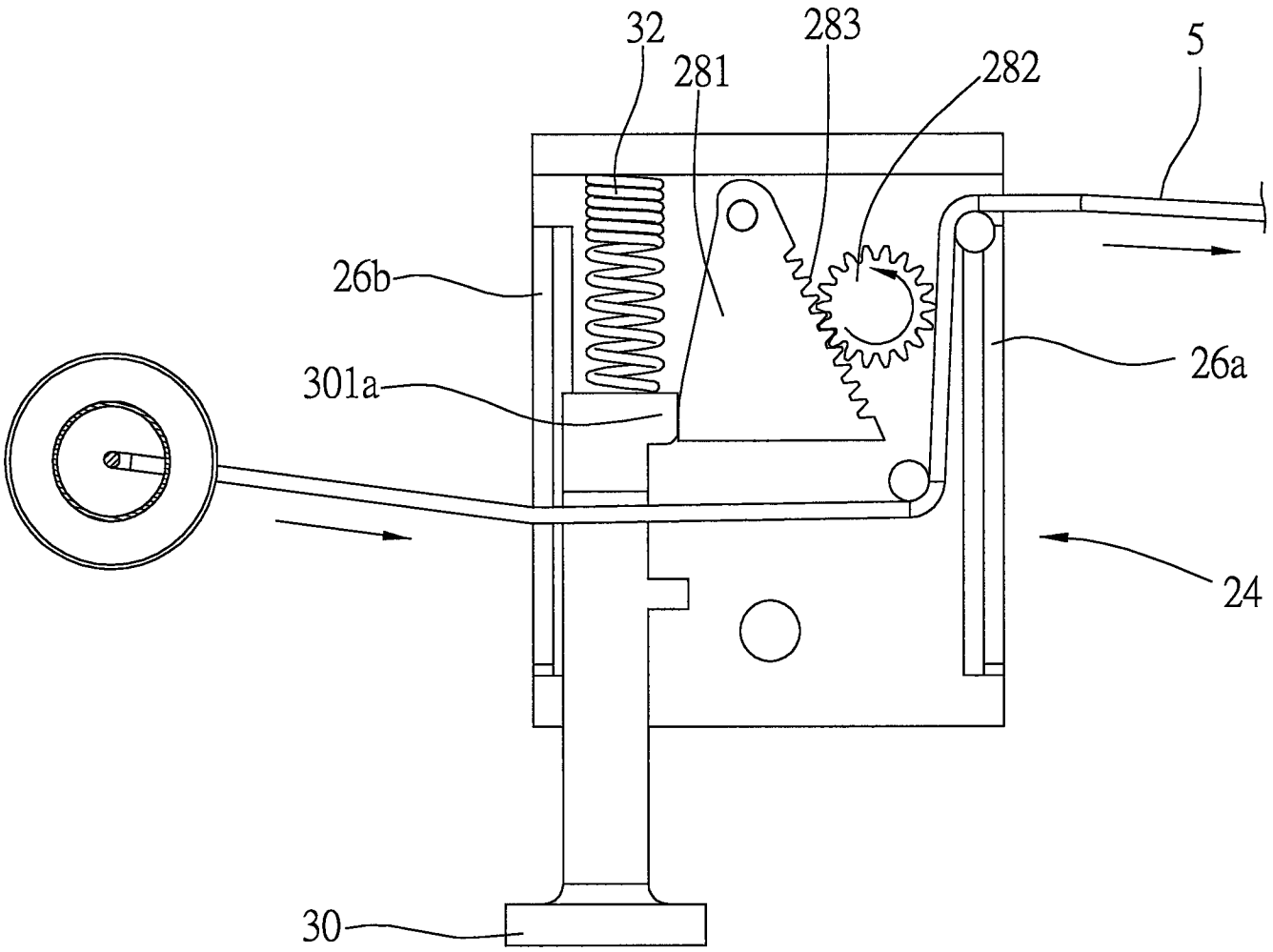
FIG. 14 is similar to FIG. 13, showing the cord is pulled in a direction toward the first opening of the base, and the gear shifts.

The condition when the bottom rail 2 is pushed upward is illustrated in FIG. 14. When the bottom rail 2 is moved toward the headrail 1 along the cord 5, the cord 5 would move relative to the locking mechanism 24 toward the first opening 26*a* of the base 26, for the position of the locking mechanism 24 would remain unchanged. While the cord 5 is moving relative to the locking mechanism 24, the gear 282 would be therefore rotated counterclockwise along the toothed surface 283 toward the region with larger space. As long as the gear 282 slightly shifts away from the first position, the cord 5 would not be tightly fixed, whereby the bottom rail 2 could be smoothly moved upward without being interfered.

Similarly, once when the bottom rail 2 is no longer being pushed upward, the cord 5 would be immediately moved relative to the locking mechanism 24 toward the second opening 26*b* due to the weight of the bottom rail 2 and the slat 3 stacked thereon, which would rotate the gear 282 clockwise to pull the gear 282 back to the narrower first position in no time. In other words, the gear 282 would return to the state shown in FIG. 13. At this time, the gear 282 would tightly abut against the cord 5 again, so that the bottom rail 2 could be precisely stopped at where it is when the pushing force is dismissed. Furthermore, the user would not even notice the change in the position of the bottom rail 2.

Figure 15:
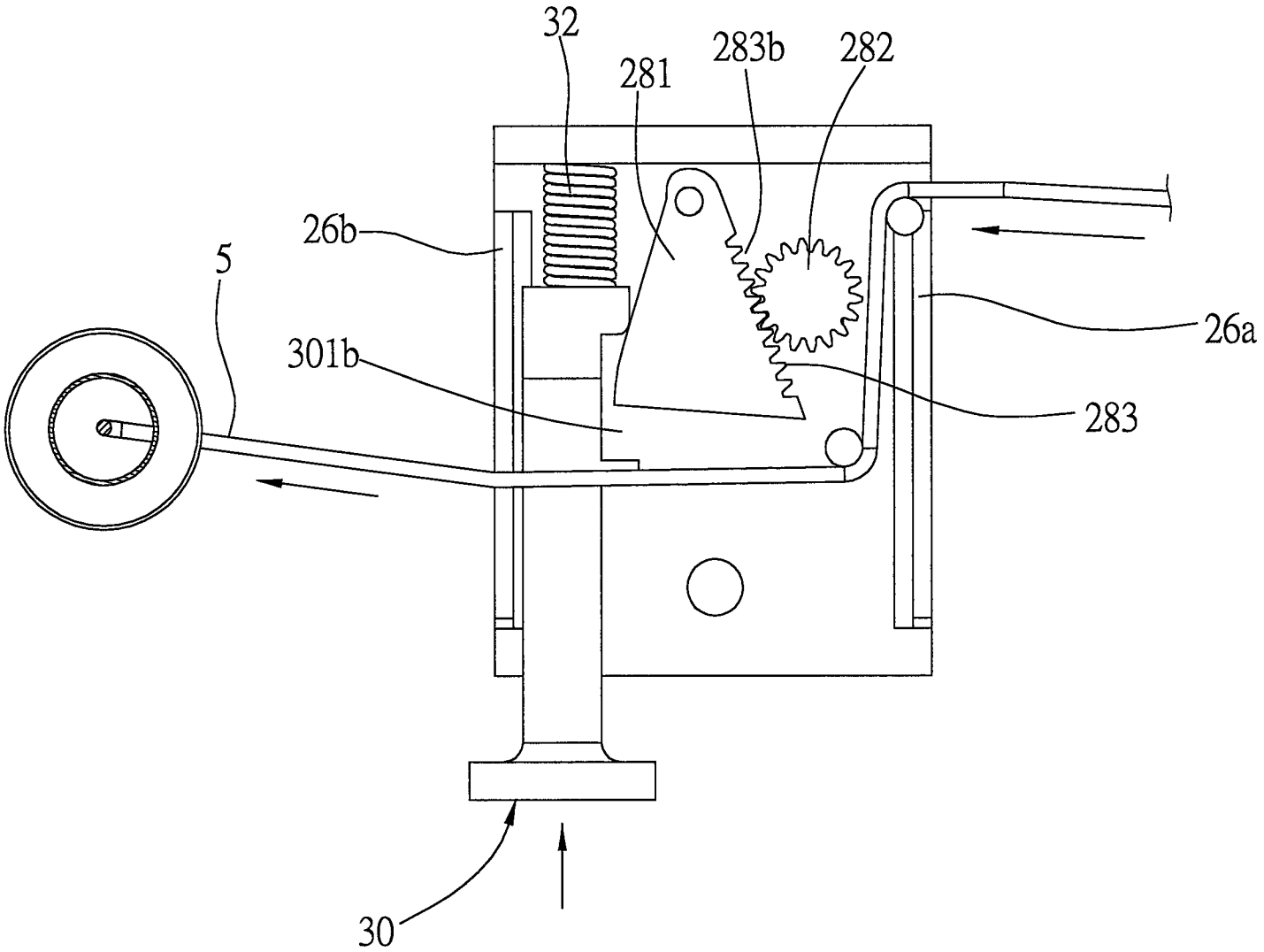
FIG. 15 is similar to FIG. 13, showing the cord is pulled in a direction toward the second opening of the base.

As shown in FIG. 15, while the pressing member 30 is being pressed and while the bottom rail 2 is being pulled downward, the recessed portion 301*b* would correspond to an end corner of the swing member 281 as the result of the change in the position of the pressing member 30, whereby the swing member 281 would have a space for pivoting. Therefore, when the cord 5 is moved relative to the base 26 toward the second opening 26*b*, the swing member 281 would be pivoted to retreat a part thereof opposite to the toothed surface 283 into the recessed portion 301*b*, which would make sufficient room for the gear 282 to move freely to the second position at the second end 283*b* of the toothed surface 283. In this way, if the bottom rail 2 is continuously pulled downward, the cord 5 would be gradually moved relative to the base 26 toward the second opening 26*b* while the locking mechanism 24 is being moved downward along with the bottom rail 2, for the teeth of the gear 282 no longer tightly abuts against the cord 5, and two ends of the cord 5 are fixed. As a result, the bottom rail 2 could be smoothly moved downward.

Similarly, once when the pressing member 30 is no longer pressed, the pressing member 30 would return to its original position where the pressing member 30 is when the pressing member 30 is not being pressed as being pushed by the reversion member 32, and the protruded portion 301*a* thereof would push the swing member 281 to swing counterclockwise. Then, the gear 282 would contact the cord 5 as being pushed by the swing member 281. With the effect of the weight of the bottom rail 2 and the slats 3 stacked thereon, the gear 282 would, again, rotate clockwise along the toothed surface 283 to get back to the first position, whereby the gear 282 would tightly abut against the cord 5 again, preventing the cord 5 from moving. Therefore, as being moved downward, the bottom rail 2 could stay at the position where it is at the time point when the pressing member 30 is not pressed anymore. Furthermore, the bottom rail 2 would not sag.

Figure 16:
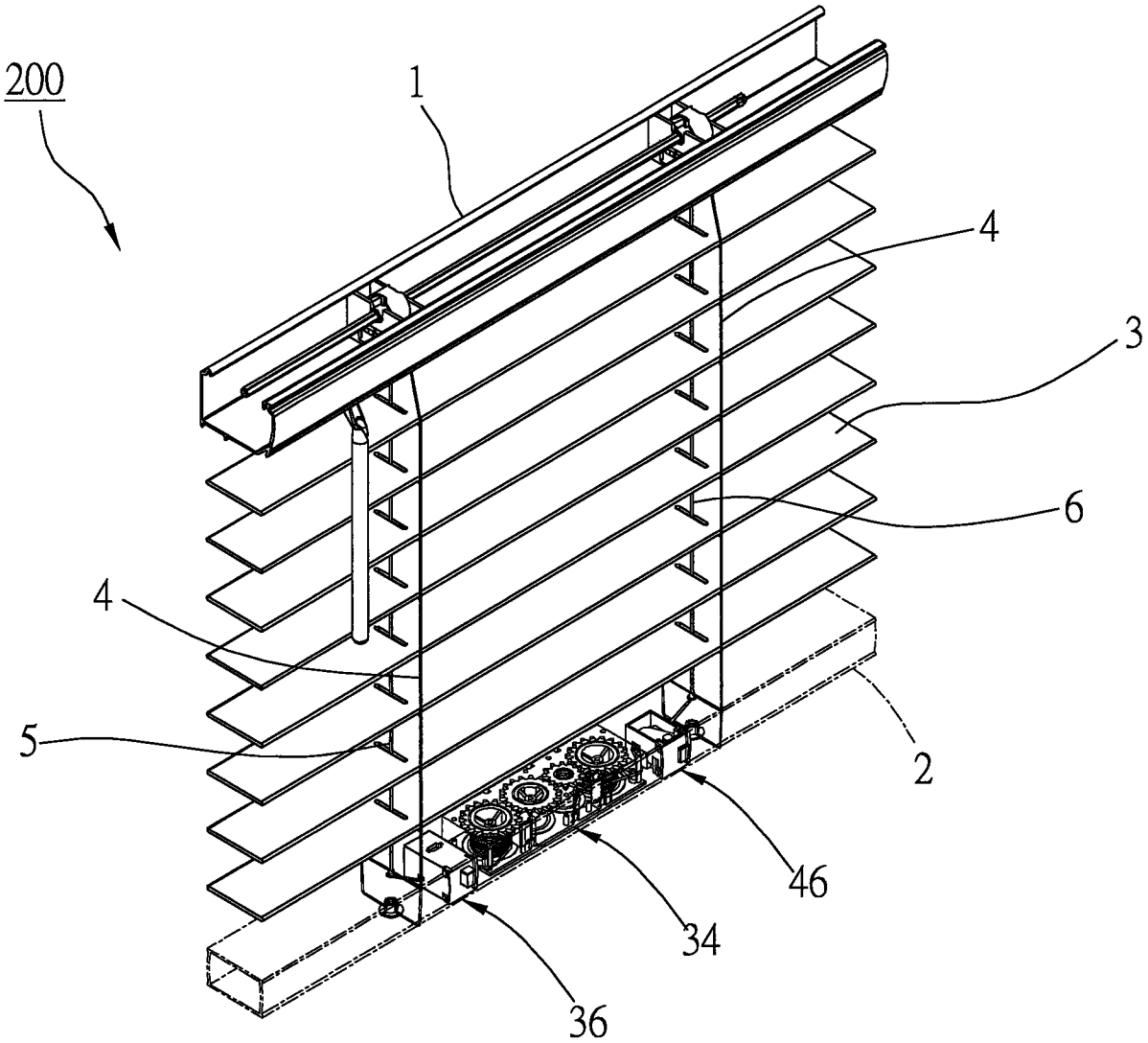
FIG. 16 is an exploded view of a window covering including locking mechanisms of third and fourth embodiments of the present disclosure.
Figure 17:
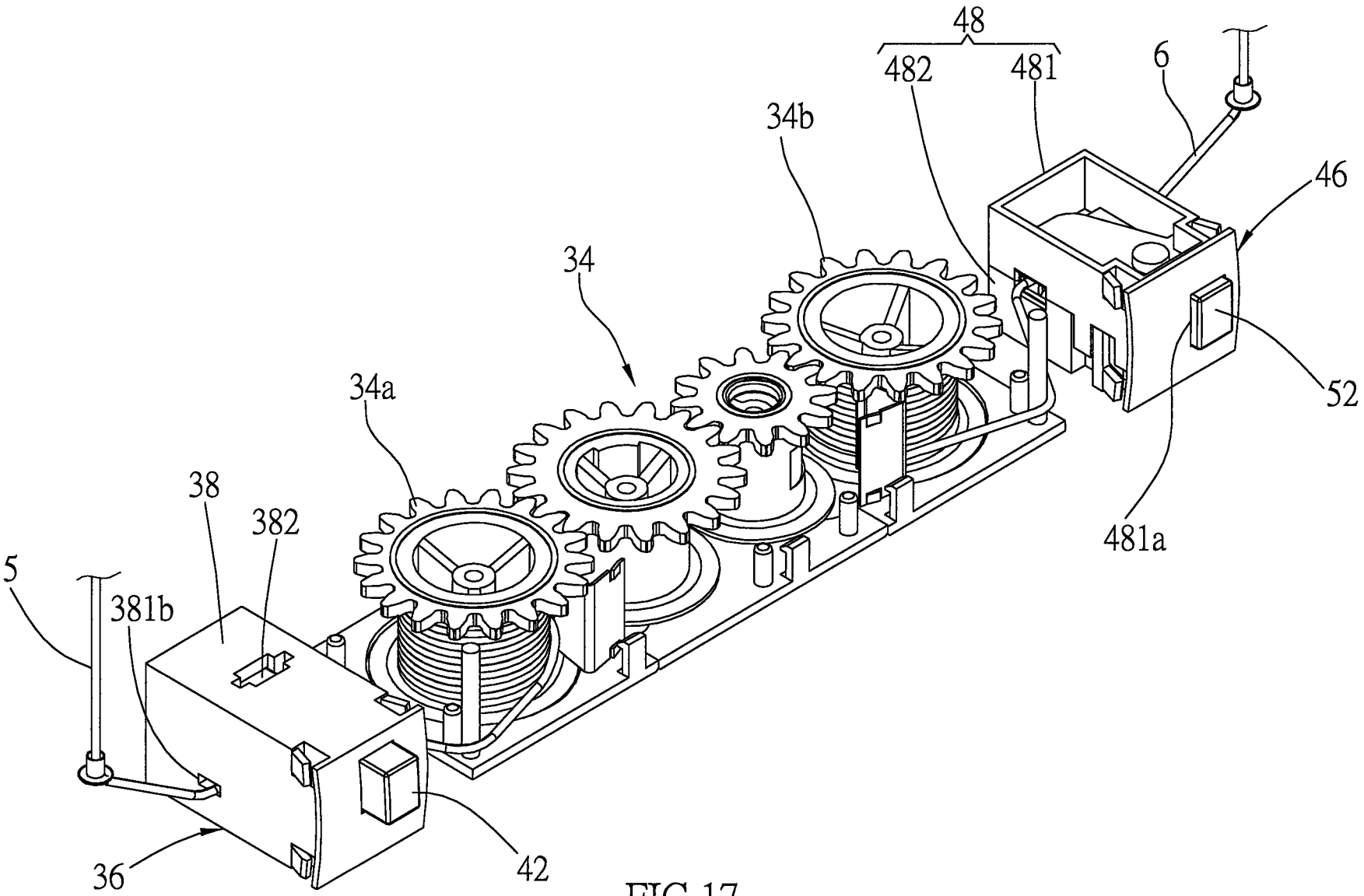
FIG. 17 is an exploded view, showing the positions of a spring box and the locking mechanisms illustrated in FIG. 16.

The same as the window covering 100 disclosed with the first embodiment, the window covering 200 illustrated in FIG. 16 and FIG. 17 also include the headrail 1, the bottom rail 2, the slats 3, the ladders 4, and the cords 5, 6. However, instead of the fixed seats 7, the window covering 200 includes a spring box 34 installed in the bottom rail 2. Therefore, this kind of window covering is usually called a cordless window blind. As shown in FIG. 16, a locking mechanism 36 of a third embodiment of the present disclosure is provided on a left side of the spring box 34, and a locking mechanism 46 of a fourth embodiment of the present disclosure is provided on a right side of the spring box 34, wherein the details of the locking mechanism 46 of the fourth embodiment of the present disclosure are further shown in FIG. 25. It has to be clarified that, though the spring box 34 illustrated in FIG. 16 has two sets of locking mechanisms of different embodiments provided on two sides thereof, one of which is the locking mechanism 36 of the third embodiment, and the other one is the locking mechanism 46 of the fourth embodiment. In practice, two sets of locking mechanisms of the same embodiment could be also provided on two sides of the spring box. For example, there could be two sets of locking mechanisms 36 of the third embodiment, or two sets of locking mechanisms 46 of the fourth embodiment provided at the same time. No matter what combination it is, the effect and the objective of the current disclosure would not be affected.

Figure 18:
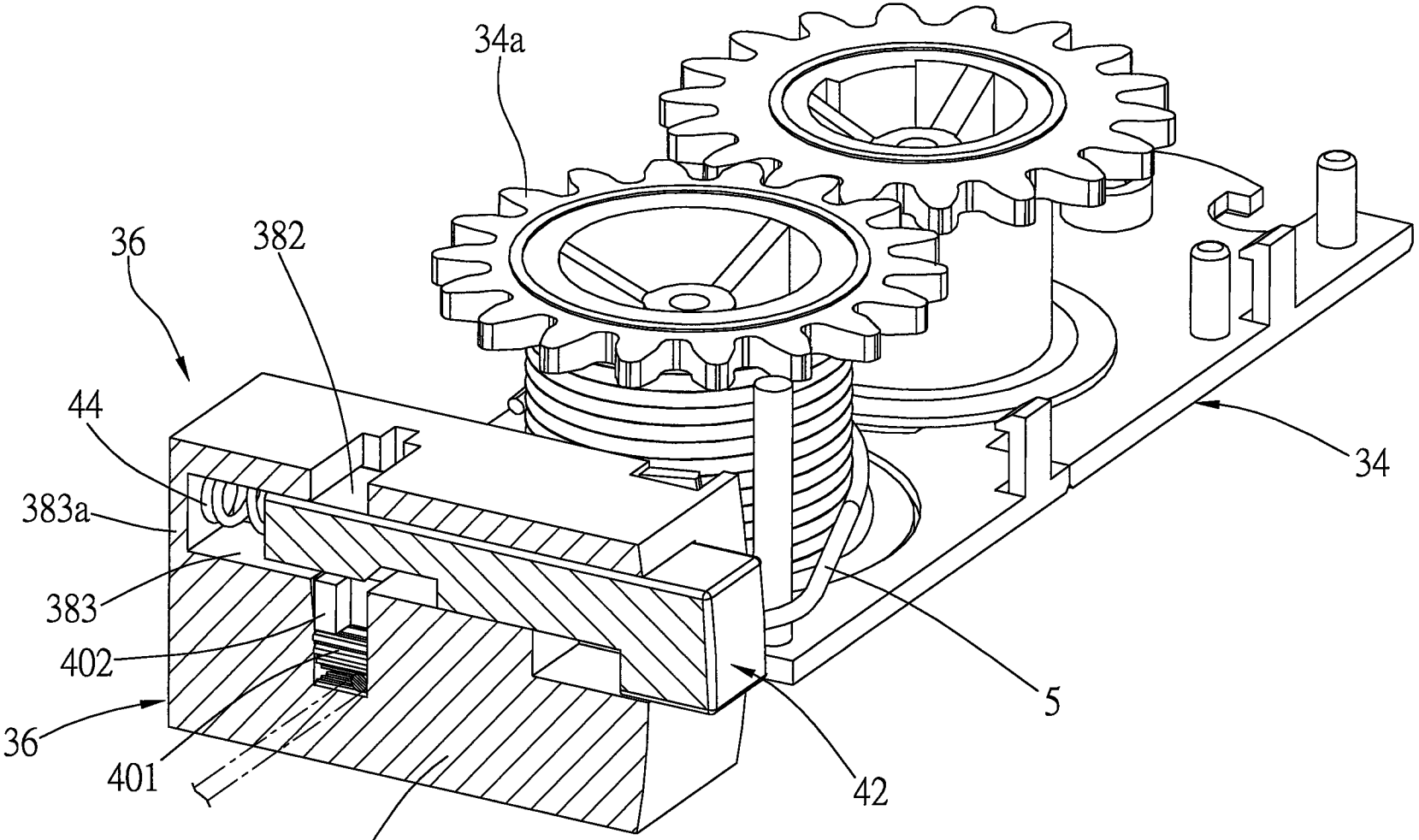
FIG. 18 is a perspective and partial sectional view of the locking mechanism of the third embodiment of the present disclosure.

The locking mechanism 36 of the third embodiment of the present disclosure is provided on the left side of the spring box 34, and the details thereof are shown in FIG. 18. In the current embodiment, the cord 5 passed through the locking mechanism 36, with one end thereof fixedly connected to the headrail 1, and another end thereof connected to a reel 34*a* of the spring box 34. The bottom rail 2 could be moved toward or away from the headrail 1 as the cord 5 is wound up or leased by the reel 34*a*. Since the spring box 34 in the current embodiment is a conventional device, we are not going to describe its details herein.

Figure 19:
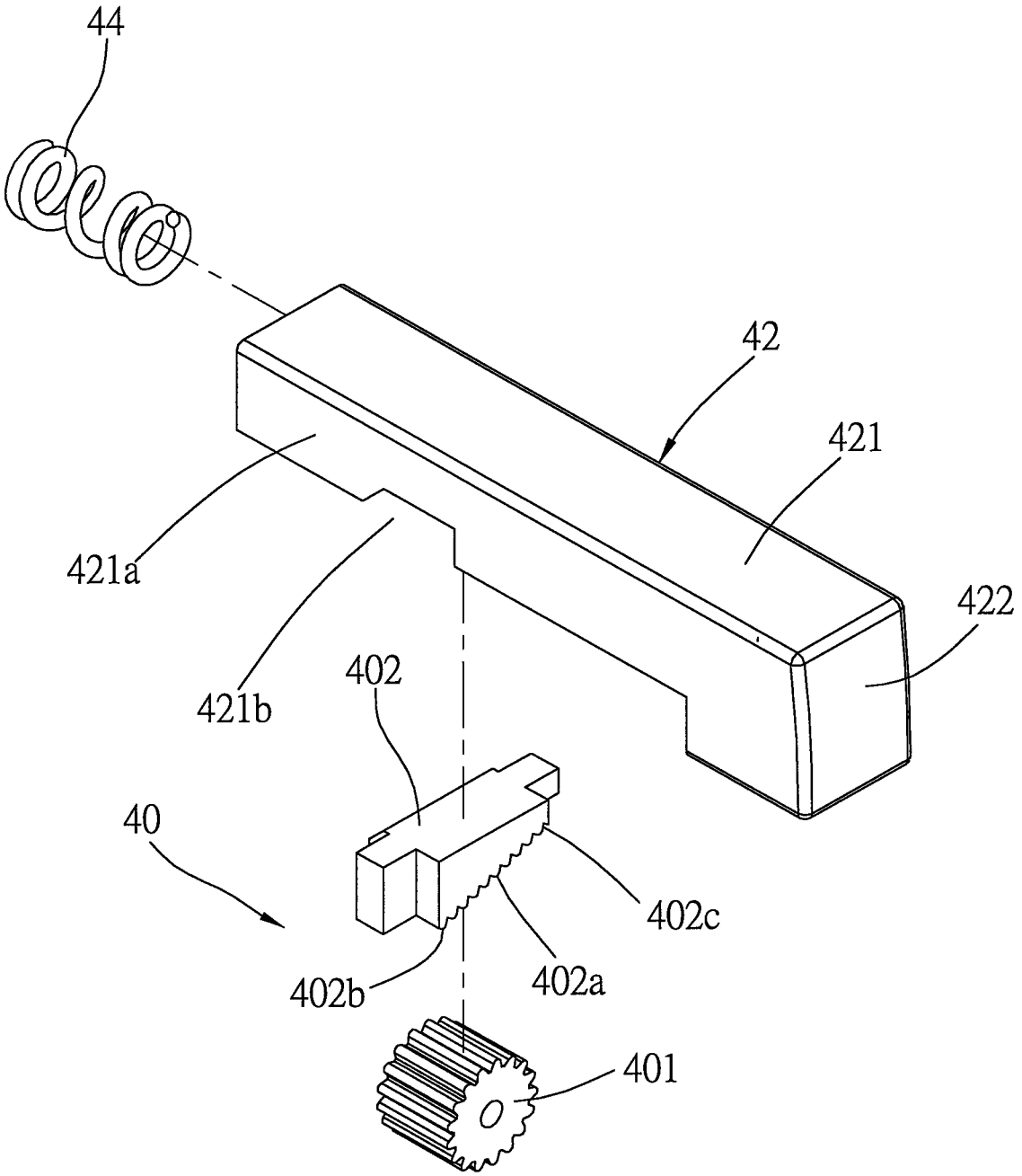
FIG. 19 is an exploded view, showing the components of the locking mechanism of the third embodiment of the present disclosure.
Figure 20:
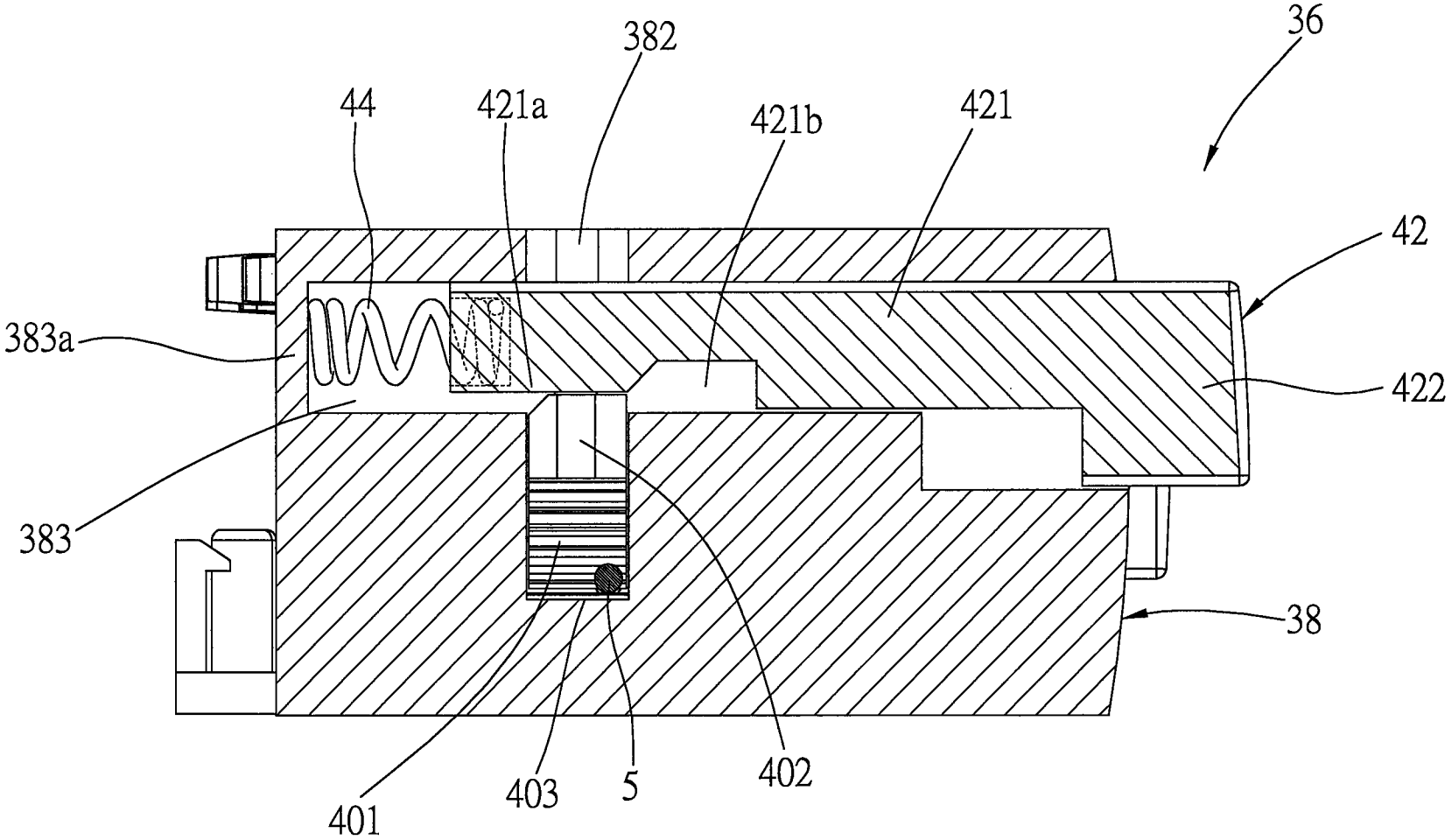
FIG. 20 is a left side view of FIG. 18.
Figure 21:
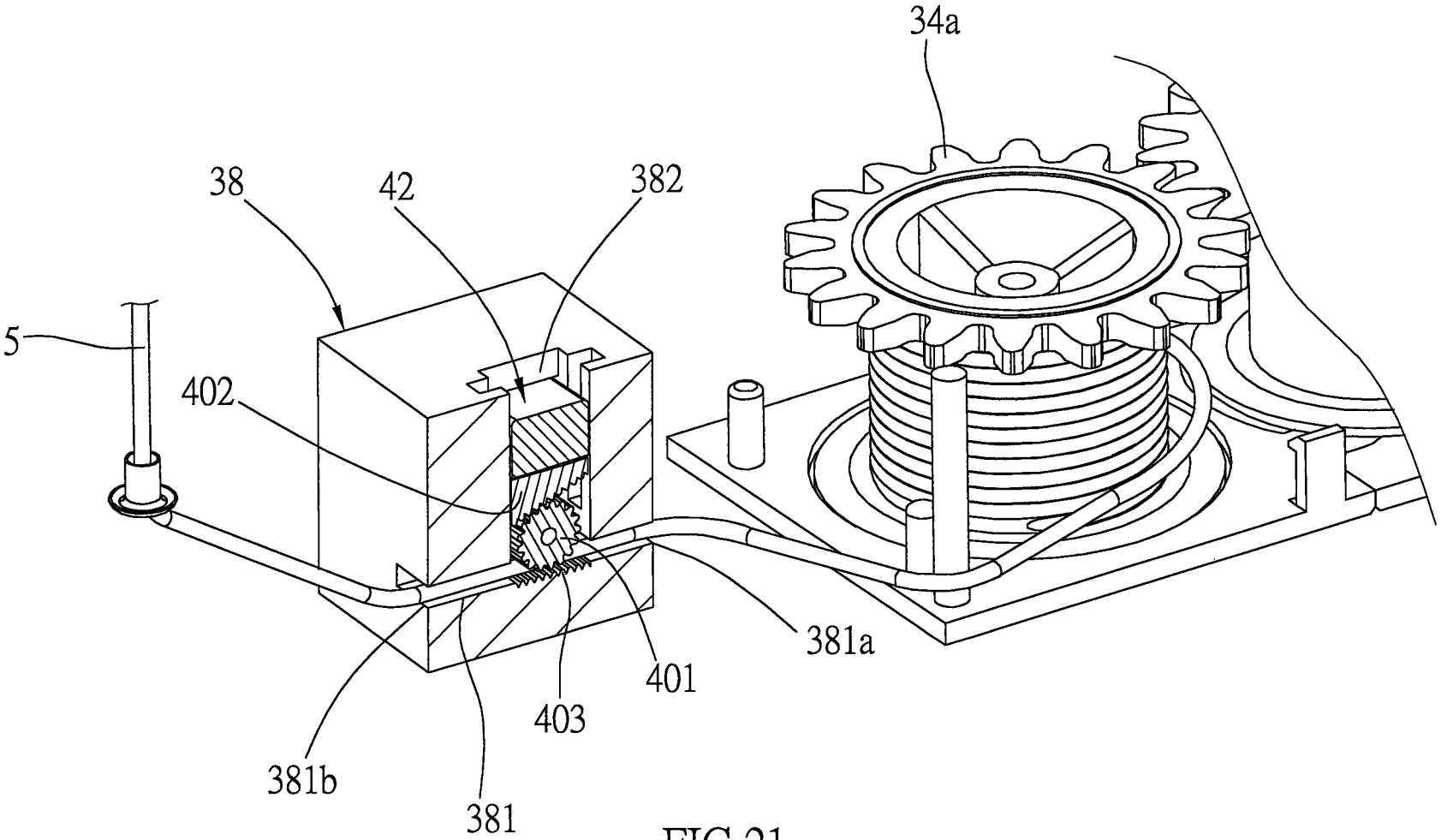
FIG. 21 is a perspective and partial sectional view of the locking mechanism of the third embodiment of the present disclosure.

As shown in FIG. 19 to FIG. 21, the locking mechanism 36 of the third embodiment includes a base 38, a locking unit 40, a pressing member 42, and a reversion member 44. The base 38 is provided with a first passage 381, a second passage 382, and a third passage 383. The first passage 381 horizontally go through the base 38 to form a first opening 381*a* and a second opening 381*b* individually on two sides of the base 38, wherein the cord 5 passes through the first opening 381*a* and the second opening 381*b*. The second passage 382 is vertically provided, and communicates with the first passage 381. The third passage 383 is horizontally provided, and communicates with the second passage 382. Furthermore, the third passage 383 and the first passage 381 are orthogonally provided.

The locking unit 40 includes a stopping member which is a gear 401 as an example, a contact block 402, and a toothed surface 403 provided on a bottom surface of the first passage 381. A lower part of the gear 401 meshes with the toothed surface 403, and the cord 5 passes through the space between the gear 401 and the toothed surface 403. The contact block 402 is provided in the second passage 382, and is movable in a vertical direction. Furthermore, the contact block 402 has an inclined toothed surface 402*a* provided on a bottom surface thereof, wherein the inclined toothed surface 402*a* meshes with an upper part of the gear 401. The inclined toothed surface 402*a* has a start end 402*b* and a finish end 402*c*. A distance between the inclined toothed surface 402*a* and the toothed surface 403 gradually increases from the start end 402*b* toward the finish end 402*c*.

The pressing member 42 further includes an extended portion 421 provided in the third passage 383, and a head 422 connected to a head end of the extended portion 421, wherein the head 422 is located outside of the base 38. The extended portion 421 has a protruded portion 421*a* and a recessed portion 421*b*. The reversion member 44 is a spring, wherein an end of the spring abuts against an enclosed end 383*a* of the third passage 383, while another end thereof abuts against a tail end of the extended portion 421. The reversion member 44 exerts a pushing force onto the pressing member 42, which urges the pressing member 42 to move toward its original position where the pressing member 42 is not pressed. As shown in FIG. 20 and FIG. 21, when the pressing member 42 is not pressed, the protruded portion 421*a* of the extended portion 421 would press and abut against the contact block 402 below, so that the gear 401 would force the cord 5 to tightly abut against the toothed surface 403. Whereby, the cord 5 would not be movable relative to the base 38. Therefore, the position of the bottom rail 2 would remain stationary. Herein we define the gear 401 is located at a first position near the start end 402*b*.

Figure 22:
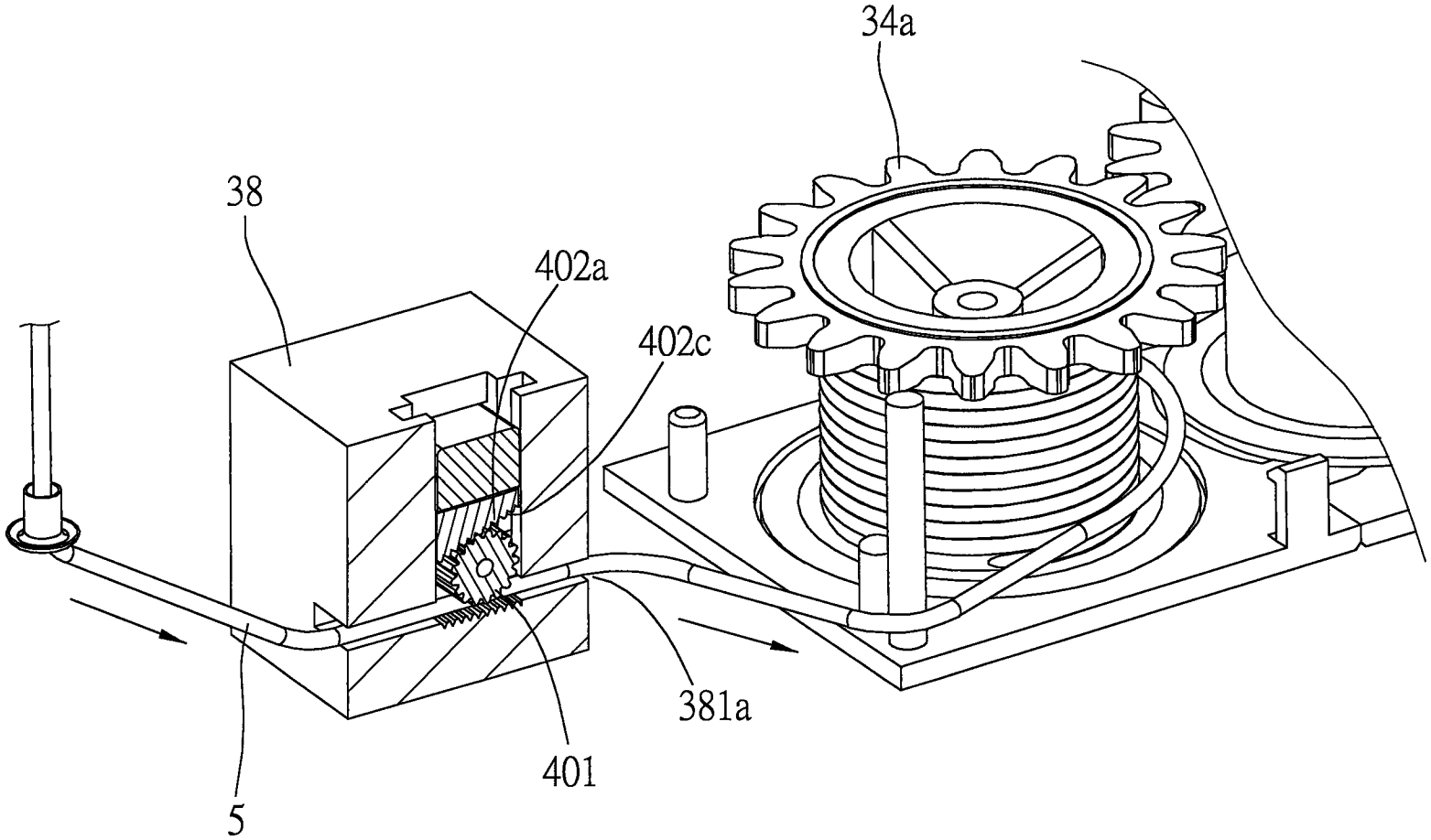
FIG. 22 is similar to FIG. 21, showing the cord is pulled in a direction toward the first opening of the base, and the gear shifts.

As shown in FIG. 22, when the bottom rail 2 is being pushed up to move toward the headrail 1 along the cord 5, the cord 5 would be moved relative to the base 38 toward the first opening 381*a*, and would be wound up by the reel 34*a*, for the position of the locking mechanism 36 in the bottom rail 2 is fixed. During the process of winding the cord 5 around the reel 34*a*, the cord 5 would pull the gear 401 to rotate toward the finish end 402*c* along the inclined toothed surface 402*a*. In other words, the gear 401 would be moved toward the region with larger space, where the gear 401 could be free, and therefore the cord 5 could be pulled freely as well. It has to be clarified that, as long as the gear 401 slightly shifts away from the first position, the cord 5 would not be tightly fixed, and therefore the bottom rail 2 could be smoothly moved upward without being interfered. Once when the bottom rail 2 is not pushed up, the gear 401 would be pulled by the cord 5 again, and would immediately return to the first position, i.e., the condition shown in FIG. 21. As a result, the cord 5 would not be able to continuously move relative to the base 38. The effect of the current embodiment is the same as that of the aforementioned embodiments, which means, no matter where the bottom rail 2 is located, the bottom rail 2 would not sag once it is not pushed anymore.

Figure 23:
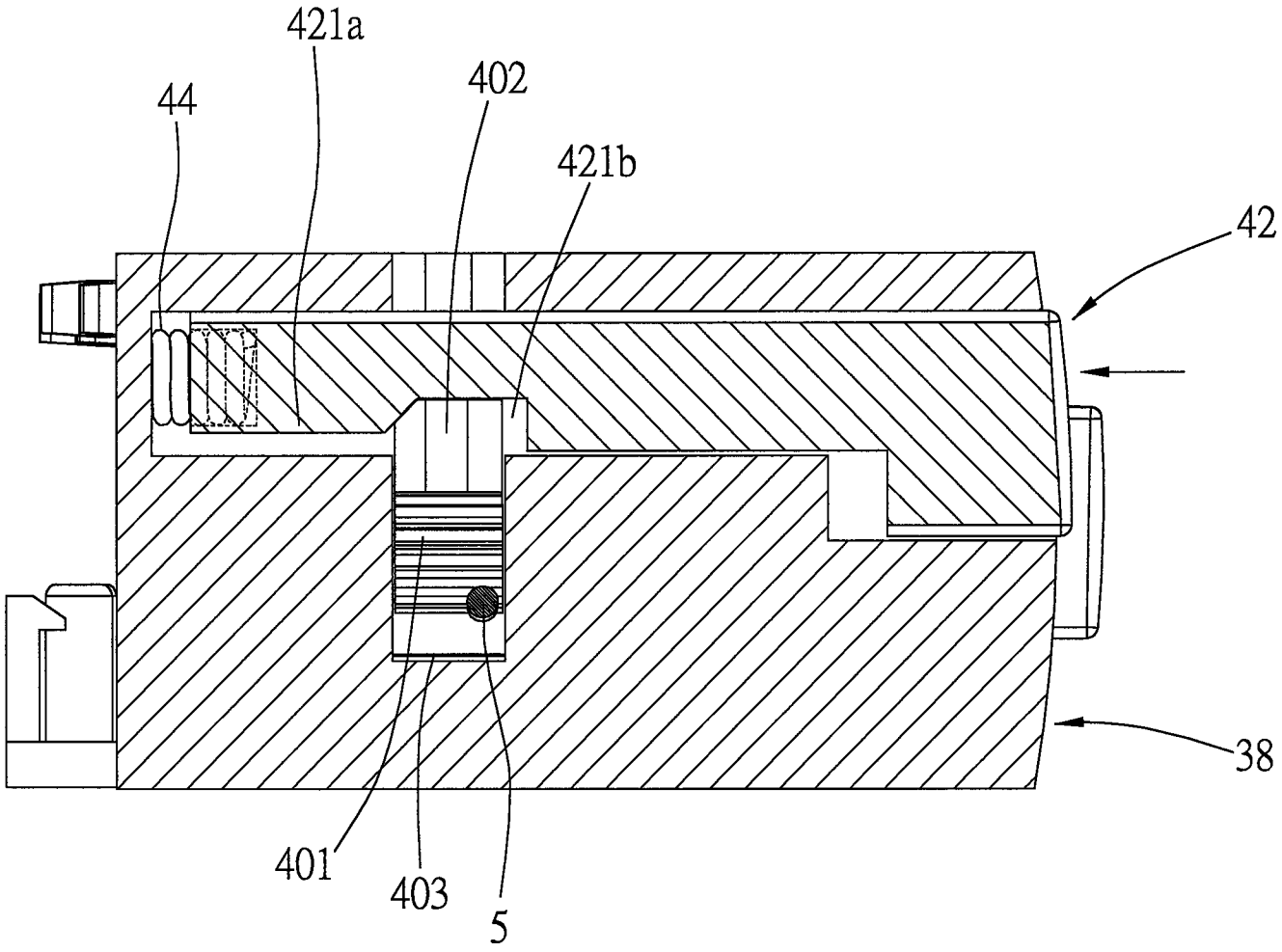
FIG. 23 is similar to FIG. 20, showing the gear is moved upward by pressing down the pressing member.
Figure 24:
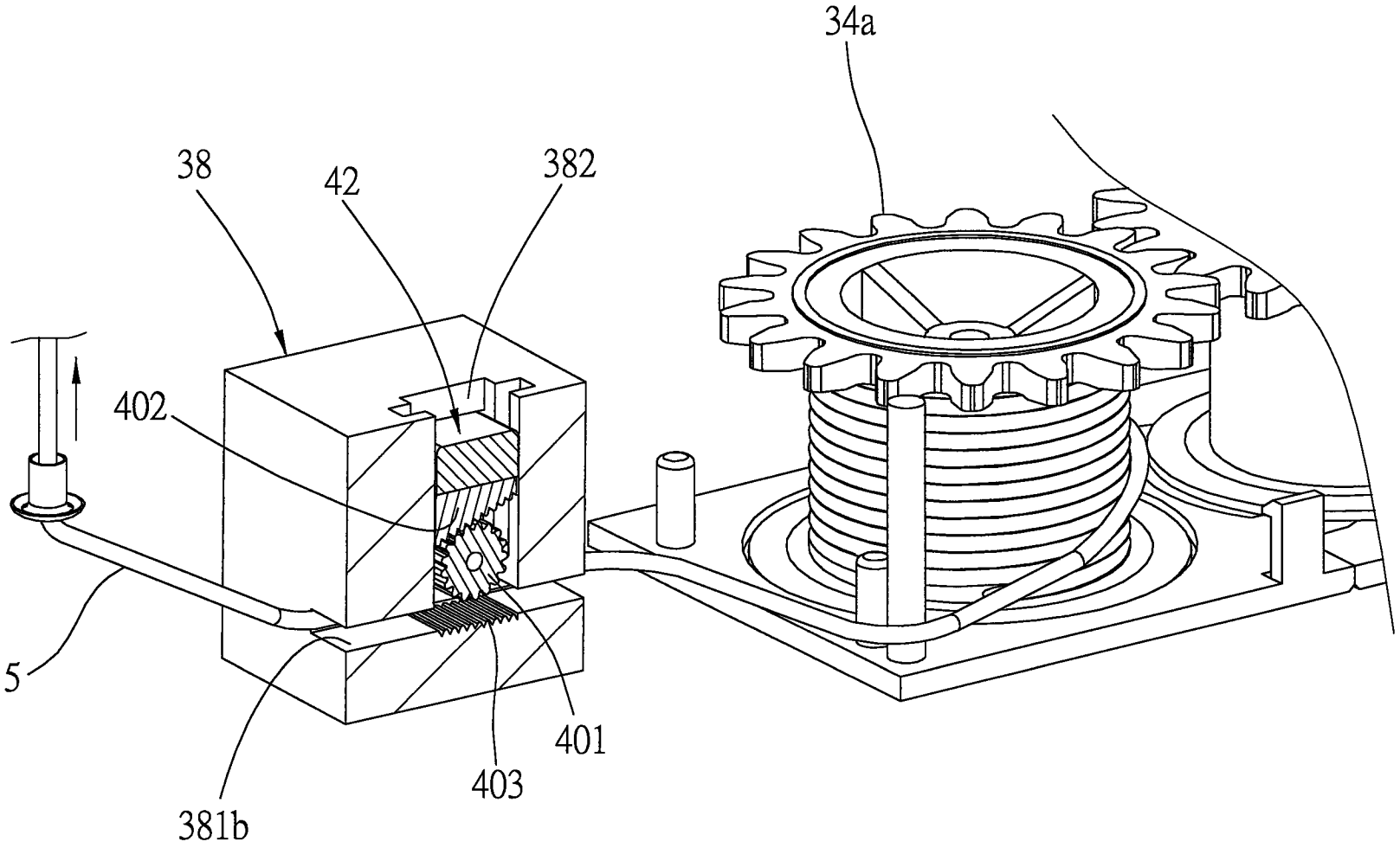
FIG. 24 is similar to FIG. 20, showing the cord is pulled in a direction toward the second opening of the base.

As shown in FIG. 23 and FIG. 24, when the pressing member 42 is pressed inward, the recessed portion 421*b* of the pressing member 42 would correspond to the contact block 402. In this way, the cord 5 could be moved relative to the base 38 toward the second opening 381*b* while the bottom rail 2 is being pulled down. At this time, the cord 5 would push up the contact block 402 through the gear 401, so that a part of the contact block 402 would enter the recessed portion 421*b*. Therefore, if the bottom rail 2 is continuously being pulled down, the cord 5 released from the reel 34*a* could be moved toward the second opening 381*b* along with the downward movement of the bottom rail 2, for the gear 401 is in a free state with the teeth thereof no longer tightly abutting against the cord 5, and two ends of the cord 5 are fixed. In this way, the bottom rail 2 could be smoothly moved downward. Herein we define the gear 401 is located at a second position.

When the pressing member 42 is no longer pressed, the reversion member 44 would push the pressing member 42 to return to the original position where the pressing member 42 is when the pressing member 42 is not pressed, whereby to restore the pressing member 42 back to the previous state shown in FIG. 21 that the protruded portion 421*a* thereof pushes and abuts against the contact block 402 located below. At this time, the contact block 402 would push the gear 401 back to the first position to tightly abut against the cord 5 again, whereby to ensure that, while being moved downward, the bottom rail 2 could precisely stay at where it is when the pressing member 42 is no longer pressed. Furthermore, the bottom rail 2 would not sag.

Figure 25:
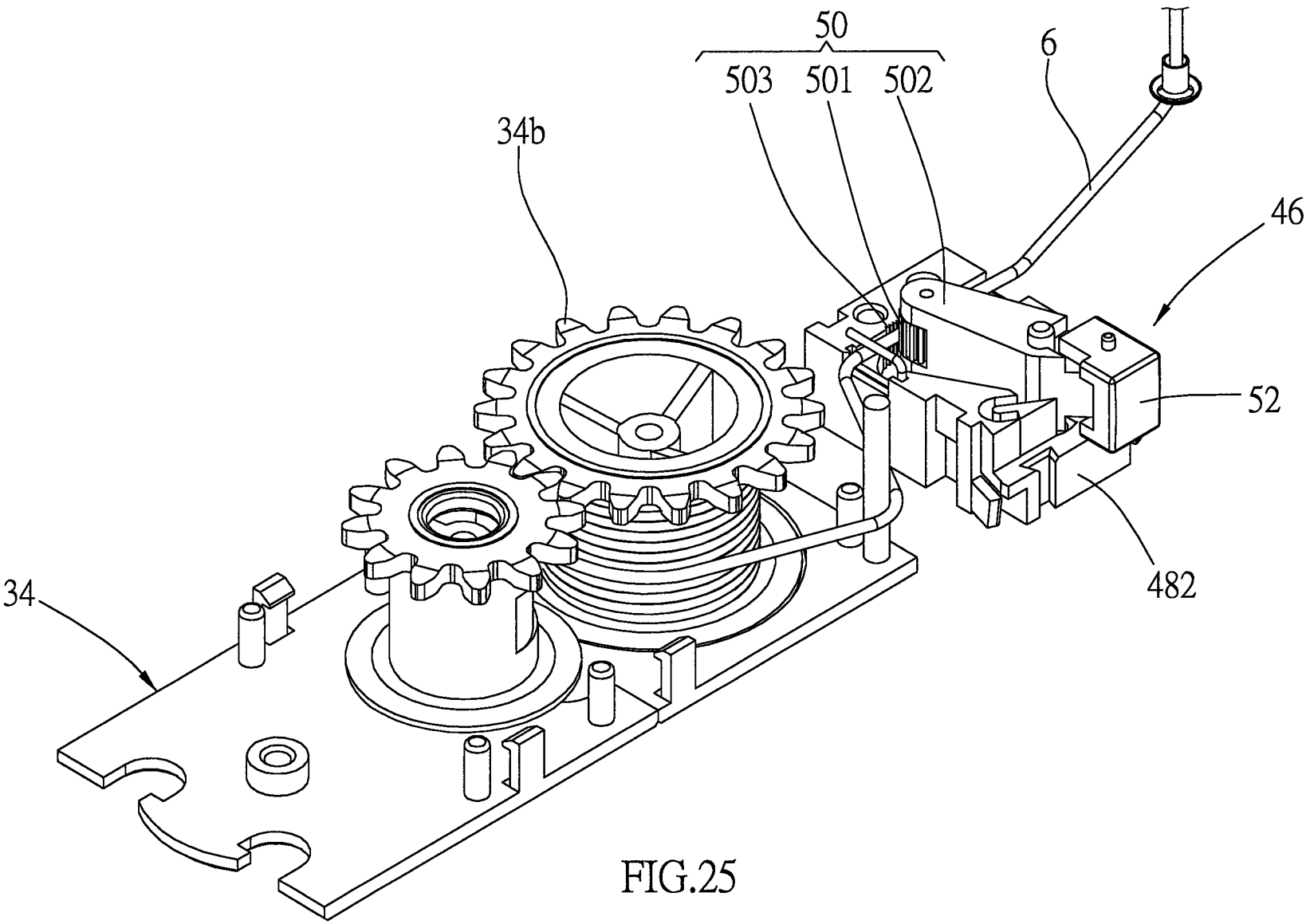
FIG. 25 is an exploded view of the locking mechanism of the fourth embodiment of the present disclosure.

The details of the locking mechanism 46 of the fourth embodiment of the present disclosure are illustrated in FIG. 25. As shown in FIG. 16, the locking mechanism 46 is installed on the right side of the spring box 34, and is passed through by the cord 6, of which an end is connected to another reel 34*b* of the spring box 34. The cord 5 and the cord 6 could work together to steadily move the bottom rail 2 toward or away from the headrail 1 as being wound around or released from the reels 34*b*.

Figure 26:
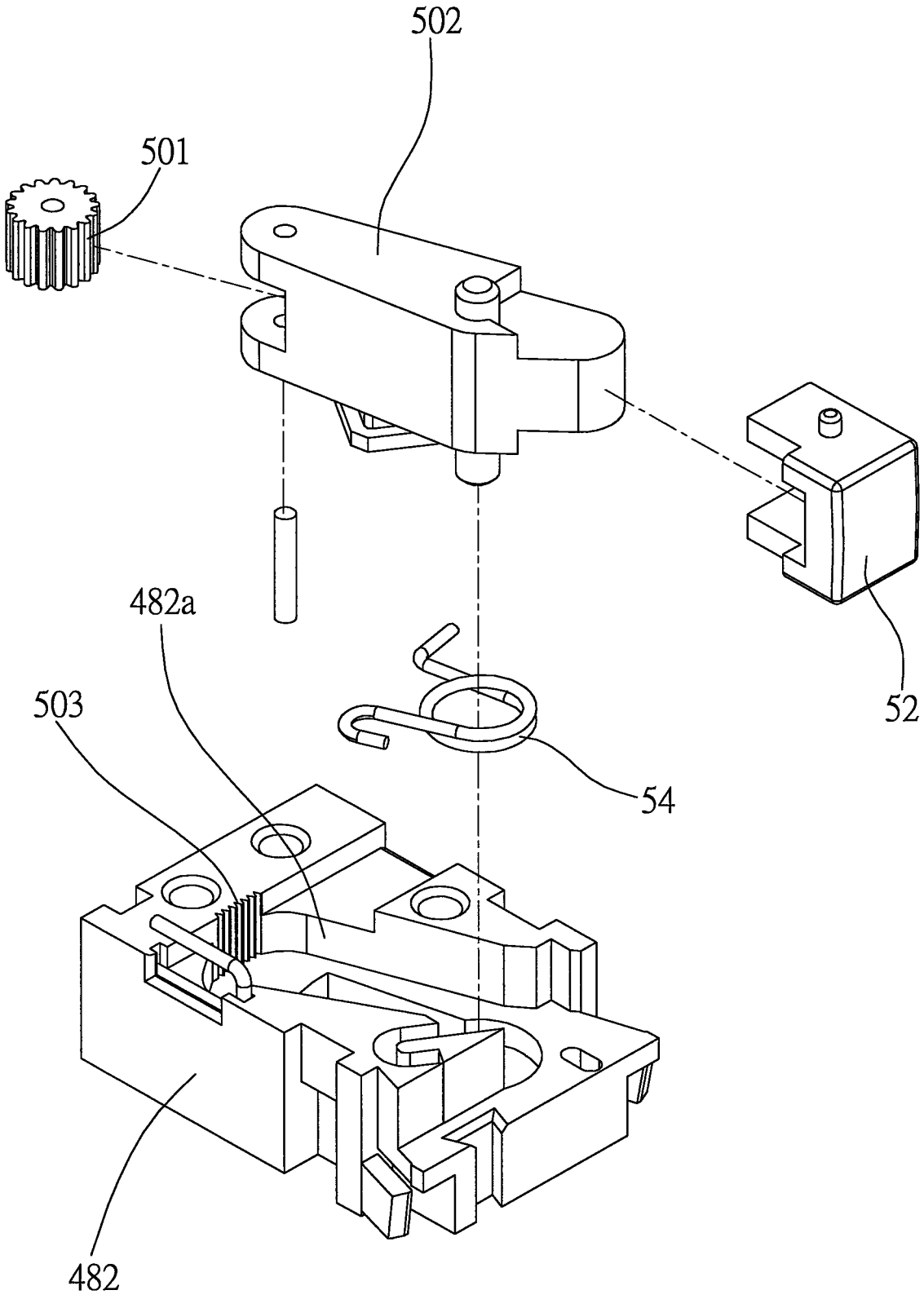
FIG. 26 is an exploded view, showing the components of the locking mechanism of the fourth embodiment of the present disclosure.
Figure 27:
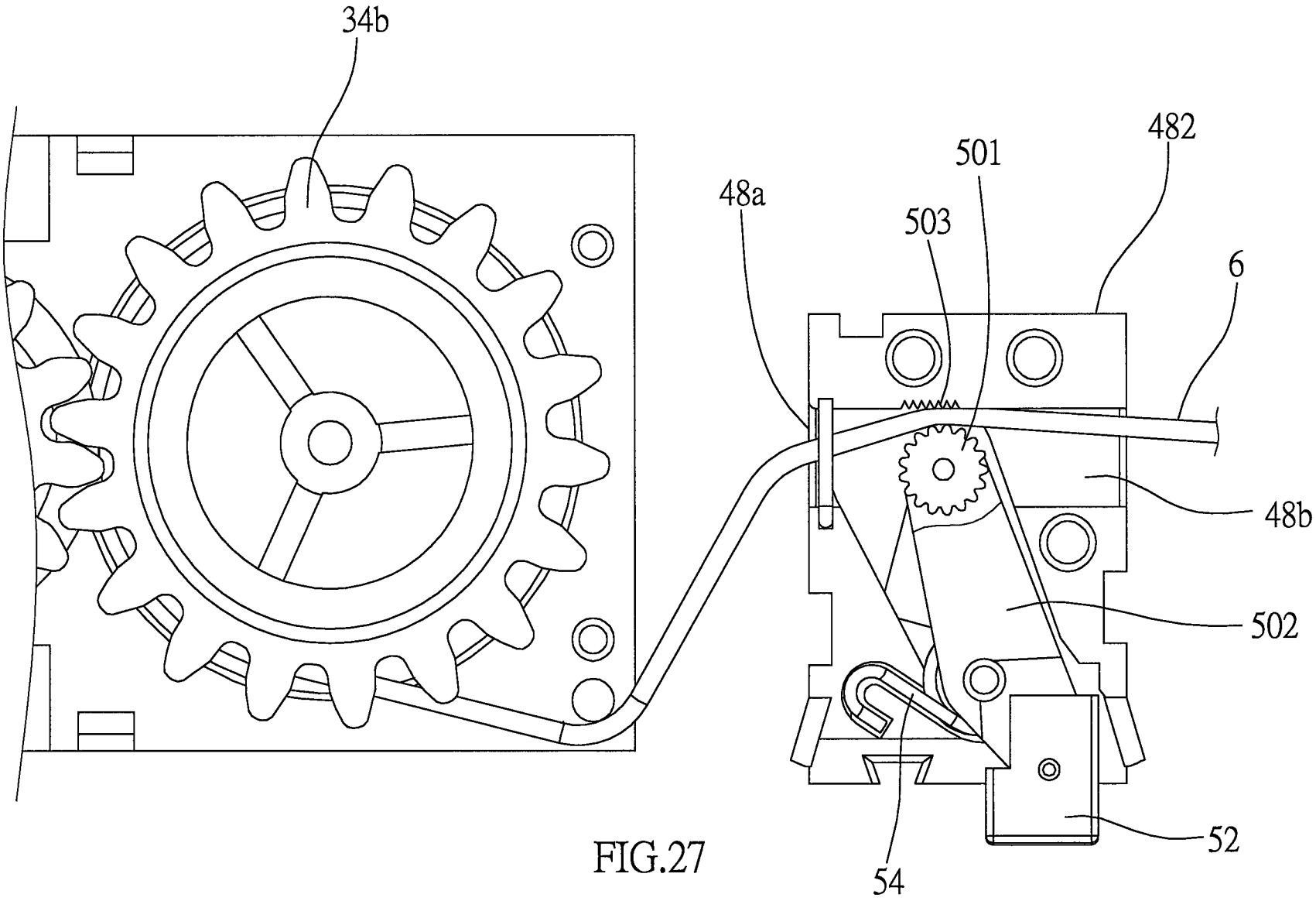
FIG. 27 is a top view, showing the gear of the locking mechanism tightly abuts against the cord.

As shown in FIG. 26 and FIG. 27, the locking mechanism 46 of the fourth embodiment includes a base 48, a locking unit 50, a pressing member 52, and a reversion member 54. The base 48 is formed by engaging a cover 481, which is illustrated in FIG. 17, with a lower member 482, forming a first opening 48*a* and a second opening 48*b* on two sides thereof, wherein the first opening 48*a* and the second opening 48*b* communicate with each other. The cover 481 has an opening 481*a* provided on a side thereof, which can be seen in FIG. 17. The lower member 482 has a recessed chamber 482*a* which is recessed from a top surface thereof.

The locking unit 50 includes a stopping member which is a gear 501 as an example, a sway member 502, and a toothed surface 503 formed on a side wall of the recessed chamber 482*a*. The sway member 502 is pivotally connected to the lower member 482, and sways in the recessed chamber 482*a*. An end of the sway member 502 is also connected to the gear 501, so that the gear 501 and the toothed surface 503 are provided correspondingly. Another end of the sway member 502 is connected to the pressing member 52, wherein the pressing member 52 passes through the opening 481*a* of the cover 481, as shown in FIG. 17. The pressing member 52 has a pivoting relation with the sway member 502, and is located on a side away from the pivot between the sway member 502 and the lower member 482.

As for the reversion member 54, it is a torsion spring in the current embodiment, which is provided in the recessed chamber 482*a*, and is below the sway member 502. The reversion member 54 exerts a pushing force onto the sway member 502, which urges the sway member 502 to move in a certain direction, whereby the pressing member 52 is indirectly urged to stay at a predetermined position. More specifically, when the pressing member 52 is not pressed, the reversion member 54 would push against the sway member 502 to keep the sway member 502 staying in the condition shown in FIG. 27, i.e., when the gear 501 forces the cord 6 to tightly abut against the toothed surface 503, so that the cord 6 could not be pulled out. Herein we define the gear 501 is located at a first position.

Figure 28:
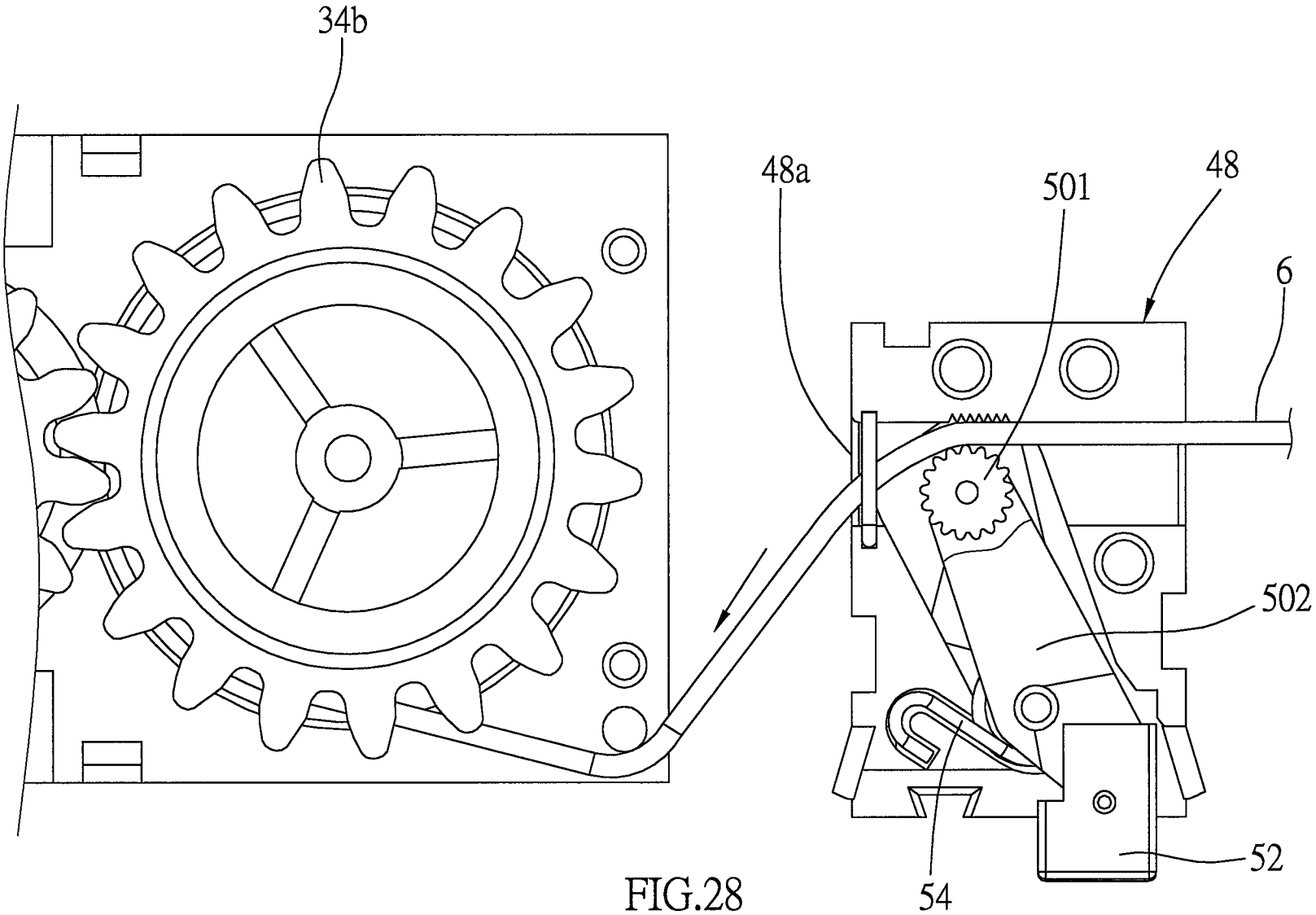
FIG. 28 is similar to FIG. 27, showing the cord is pulled in a direction toward the first opening of the base, and the gear shifts.

FIG. 28 shows the condition when the bottom rail 2 is being pushed up to move toward the headrail 1 along the cord 6. Similarly, since the position of the locking mechanism 46 is fixed, the cord 6 would be moved relative to the base 48 toward the first opening 48*a* of the base 48, and would be wound up by the corresponding reel 34*b*. During the process of moving the cord 6, the movement of the cord 6 would also guide and push the gear 501 to rotate, forcing the sway member 502 to swing toward the left side, which would compress the reversion member 54. At this time, the bottom rail 2 could be smoothly pushed up without being interfered. When the upward pushing force is dismissed, the reversion member 54 would release its compressed energy to push the sway member 502 back to its original position, where the gear 501 would, again, force the cord 6 to tightly about against the toothed surface 503. In this way, the bottom rail 2 could precisely stop at where it is when the external force is dismissed, and the bottom rail 2 would not sag.

Figure 29:
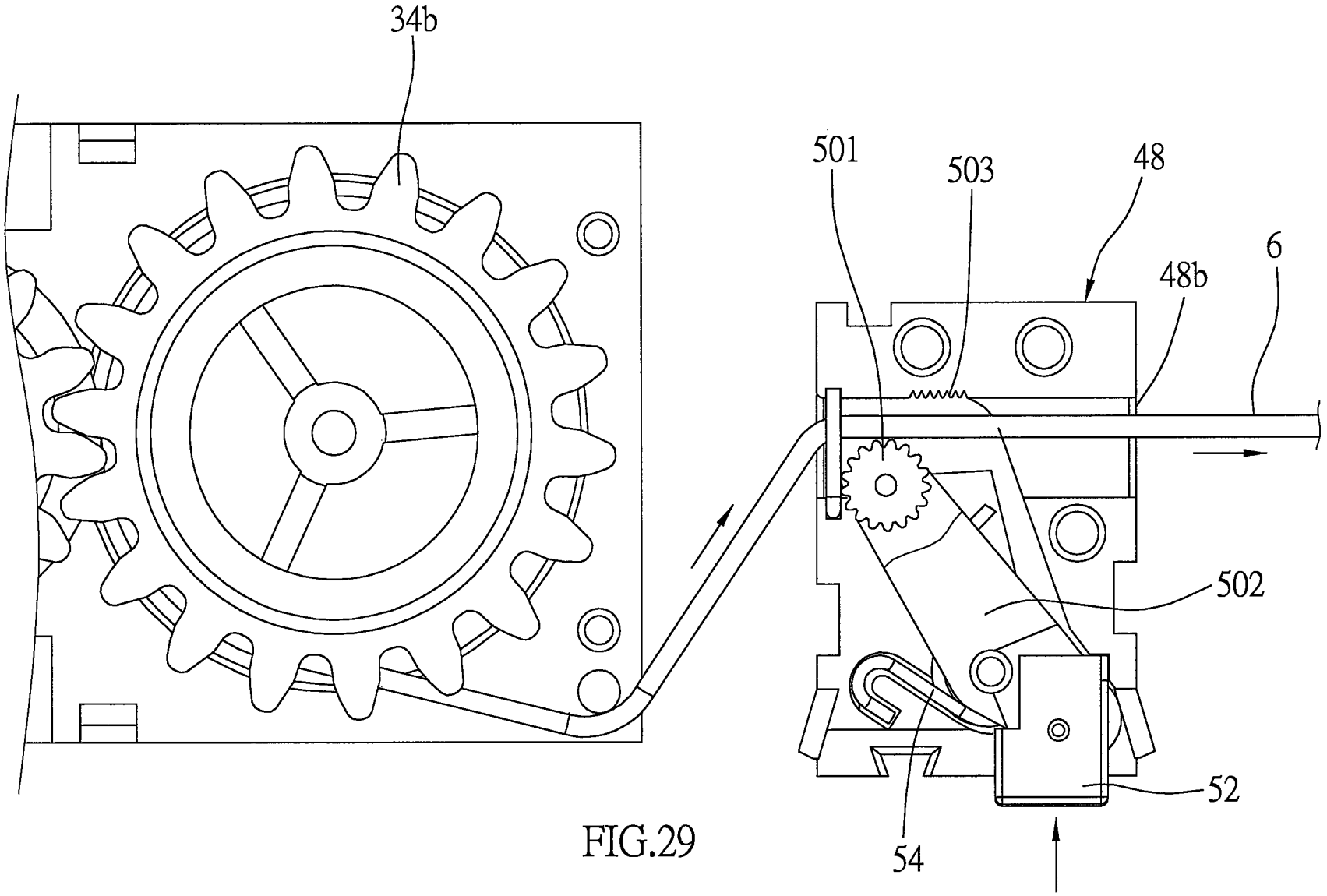
FIG. 29 is similar to FIG. 27, showing the cord is pulled in a direction toward the second opening of the base.

FIG. 29 further shows that, when the pressing member 52 is pressed inward, the sway member 502 would significantly swing toward the left side, and the gear 501 would shift to a second position away from the toothed surface 503. Therefore, when the bottom rail 2 is being pulled down, the cord 6 released from the corresponding reel 34*b* would move relative to the base 48 toward the second opening 48*b*, for the teeth of the gear 501 would no longer tightly abut against the cord 6, and two ends of the cord 6 are fixed. As a result, the bottom rail 2 could be smoothly moved downward. Once when the pressing member 52 is not pressed, the compressed reversion member 54 would return to its original state in no time, which would make the sway member 502 go back to the state shown in FIG. 27 along with the gear 501, and the cord 6 would be tightly abutted against again. Therefore, the bottom rail 2 would precisely stay at where it is when the pressing member 5 is not pressed anymore, and the bottom rail 2 would not sag.

Each of the aforementioned embodiments could achieve the objective to precisely stop the bottom rail 2 at any required positions. However, it has to be clarified that, the locking mechanism 10 of the first embodiment of the present disclosure and the locking mechanism 24 of the second embodiment of the present disclosure not only could be applied in a tension window blind, but also could be used in a cordless window blind which has a spring box. In such a case, the end of each of the cords 5, 6 which is originally fixed on the window frame 100A should be respectively connected to the reel of the spring box instead. Similarly, the locking mechanism 36 of the third embodiment of the present disclosure and the locking mechanism 46 of the fourth embodiment of the present disclosure not only could be applied in a cordless window blind, but also could be used, of course, in a tension window blind. In such a case, the end of each of the cords 5, 6 which is originally connected to the reel of the spring box should be directly fixed on the window frame 100A after passing through the bottom rail 2 instead.

Figure 30:
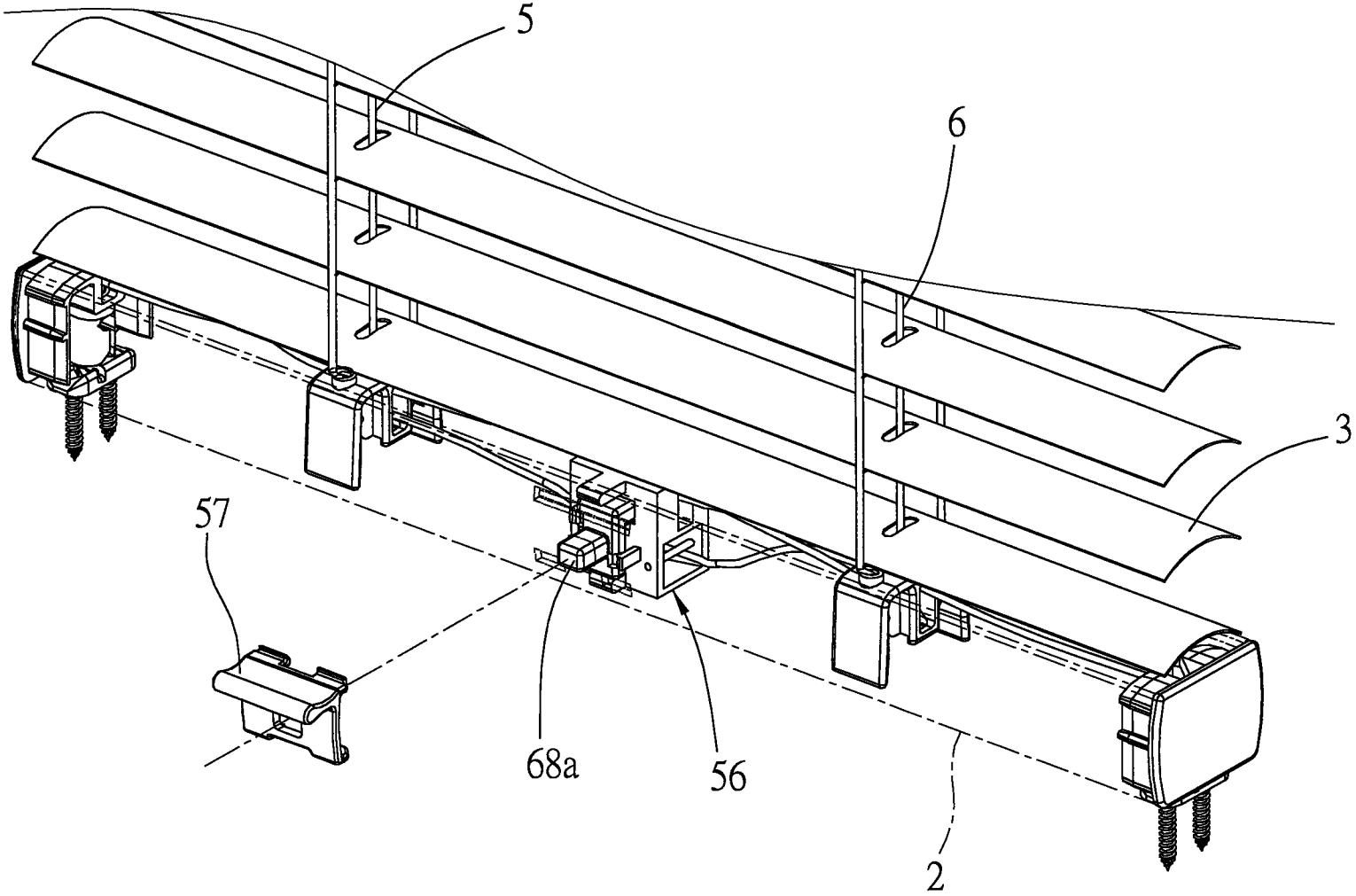
FIG. 30 is an exploded view, showing the window covering including the locking mechanism of a fifth embodiment of the present disclosure.
Figure 31:
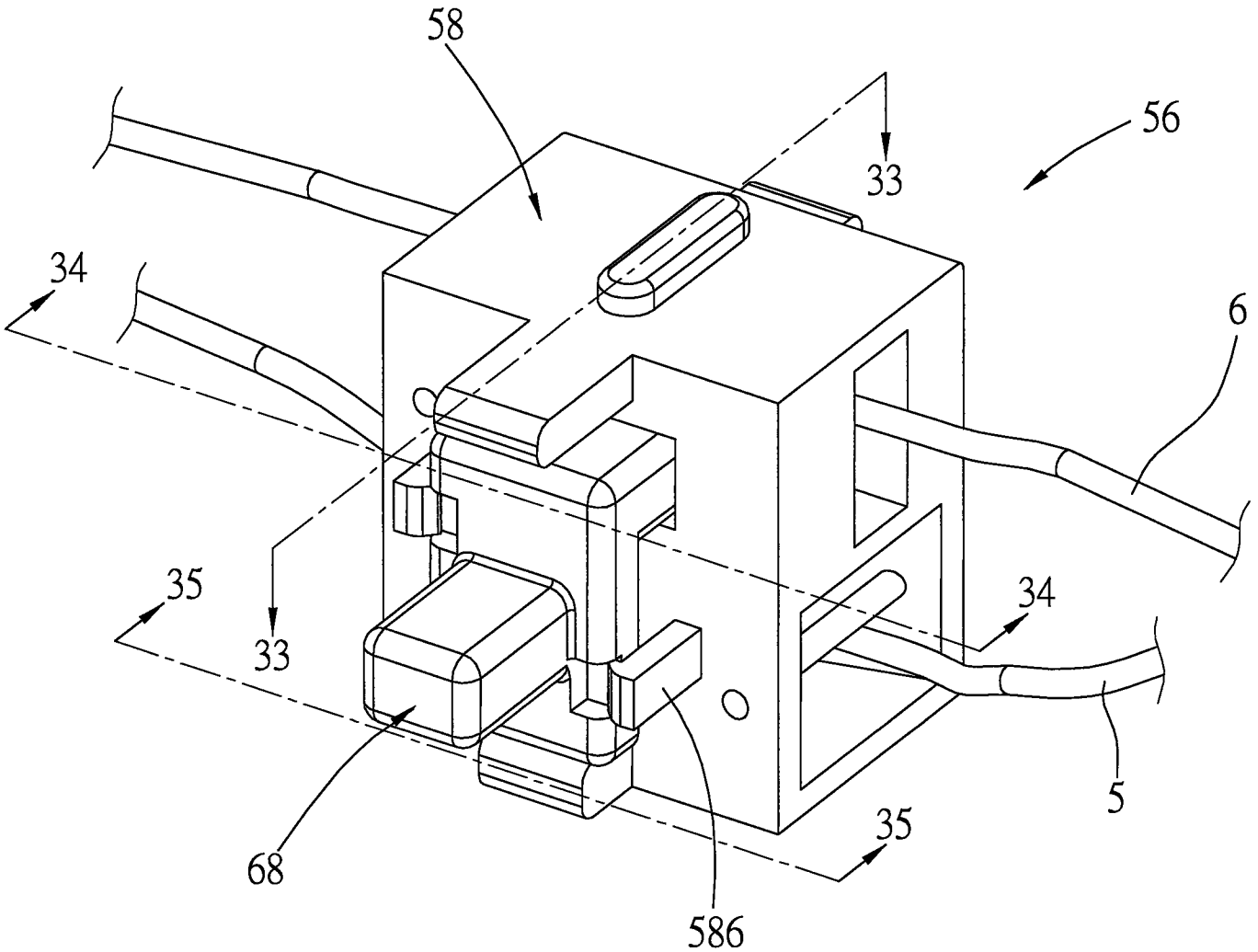
FIG. 31 is an exploded view of the locking mechanism of the fifth embodiment of the present disclosure.
Figure 32:
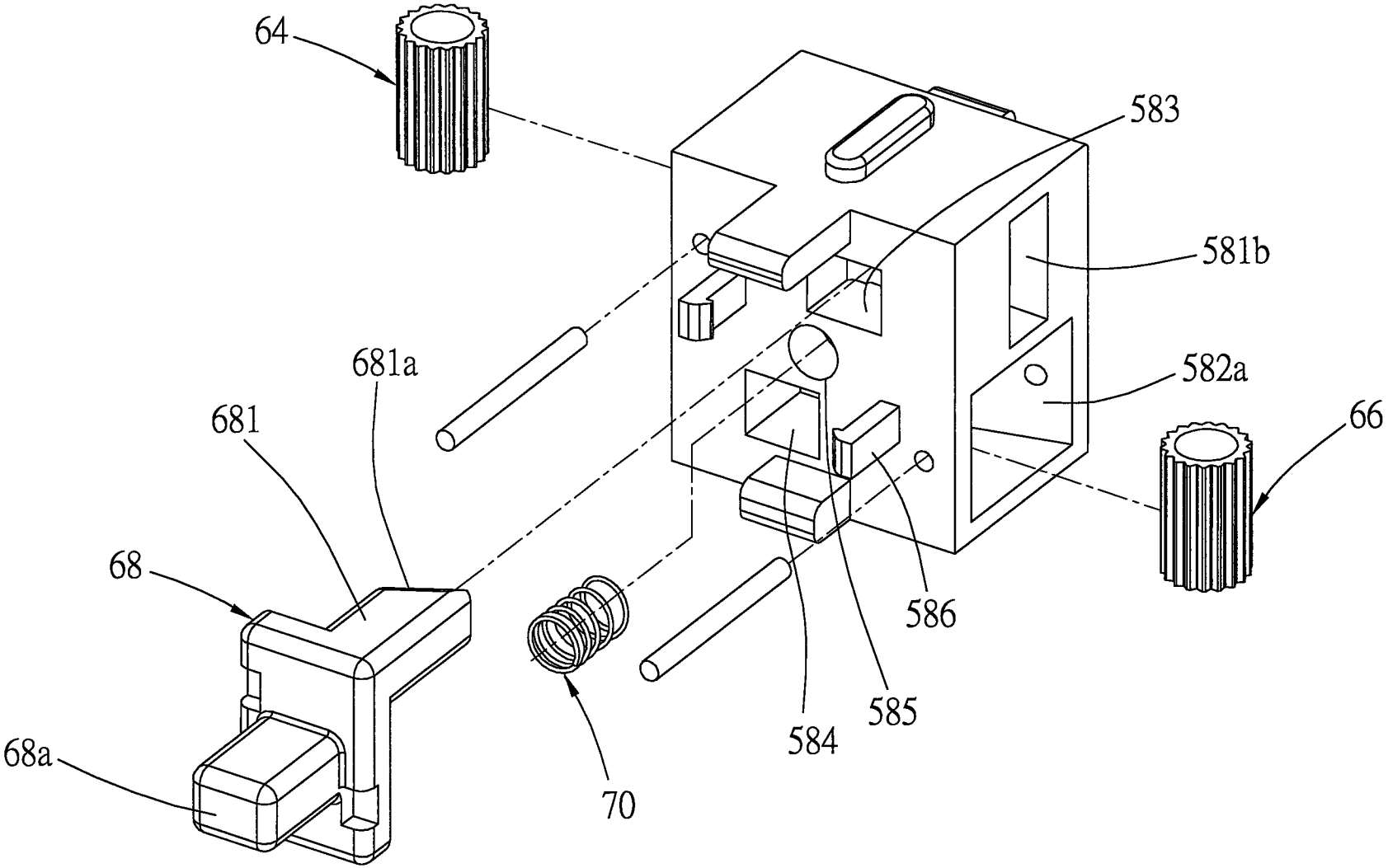
FIG. 32 is an exploded view of the locking mechanism shown in FIG. 31.
Figure 33:
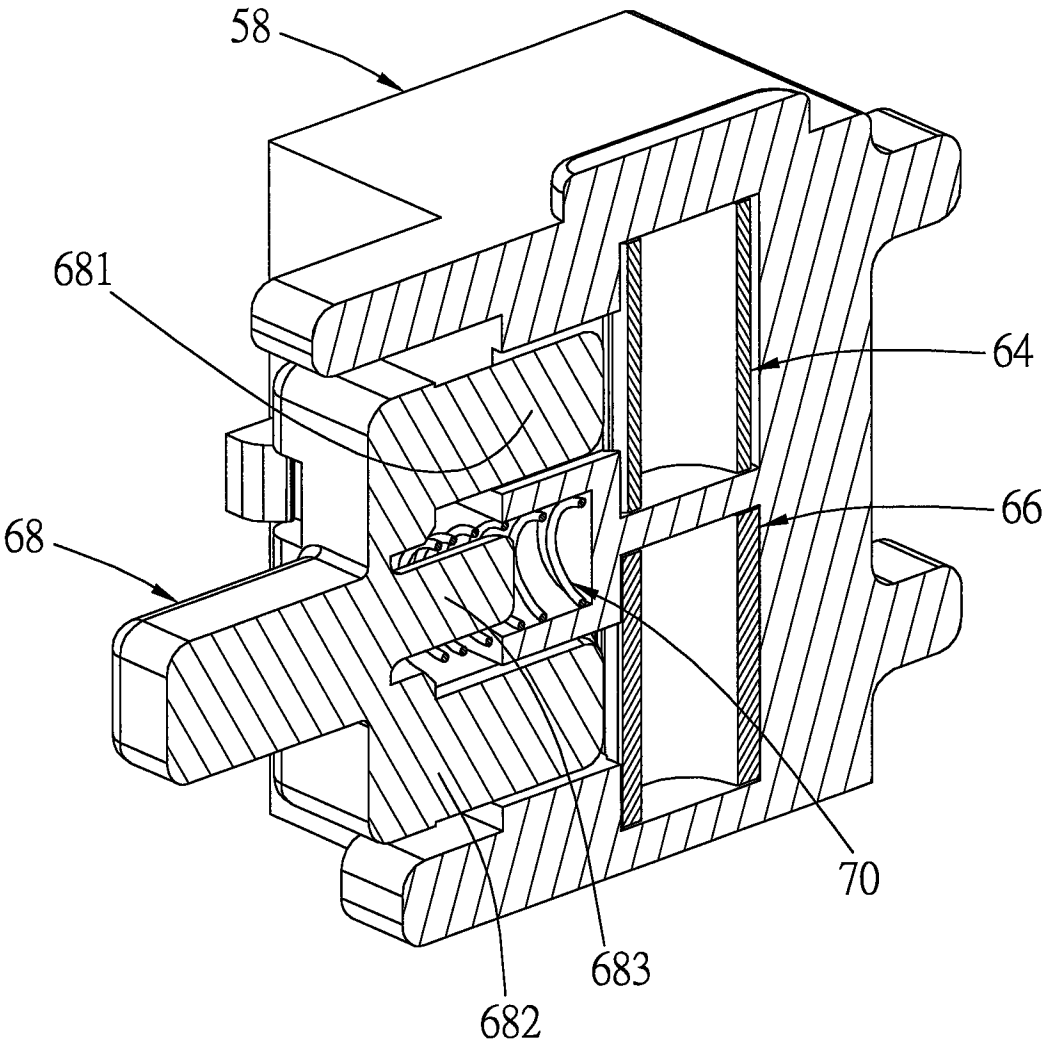
FIG. 33 is a sectional view along the 33-33 line in FIG. 31.
Figure 34:
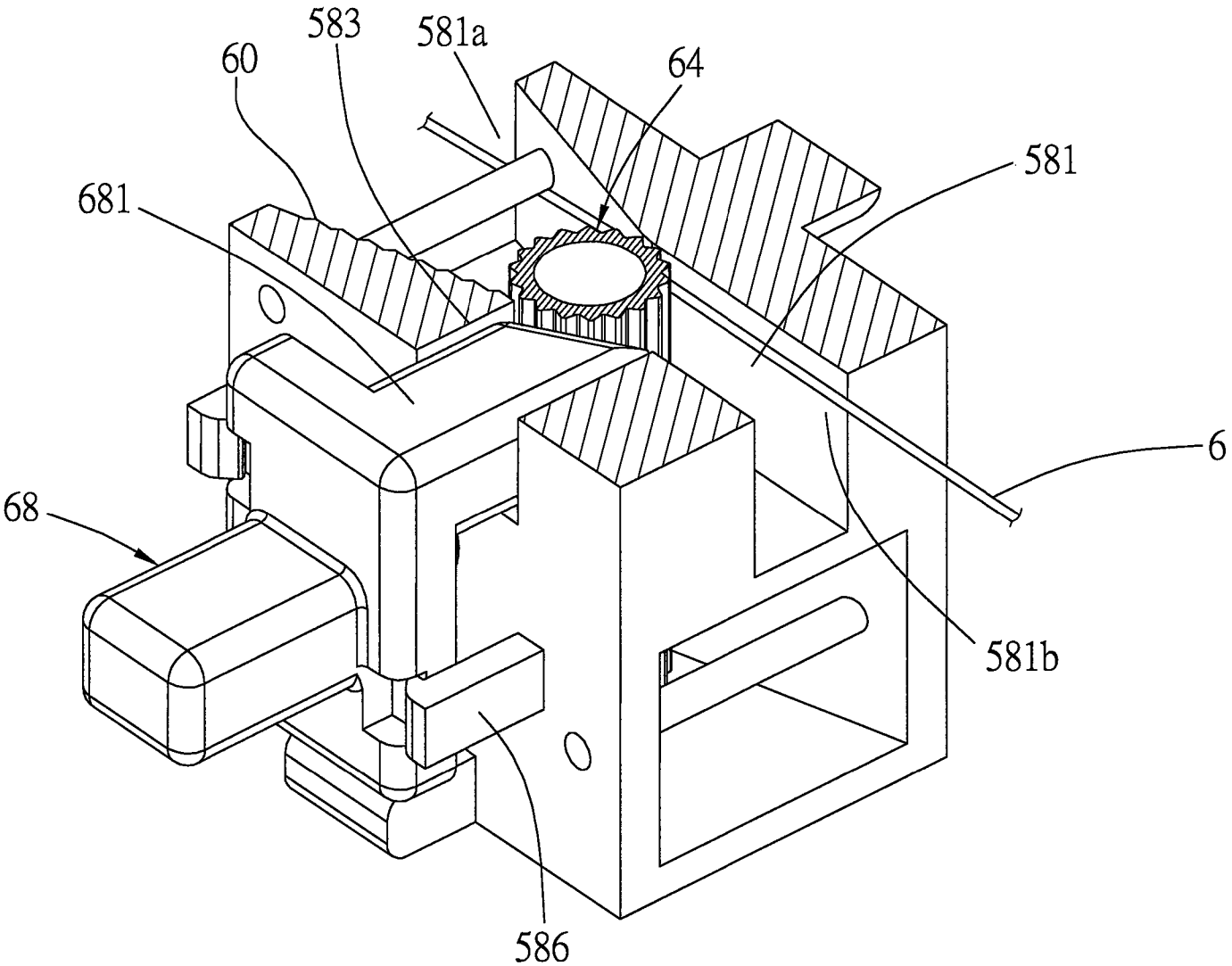
FIG. 34 is a sectional view along the 34-34 line in FIG. 31.
Figure 35:
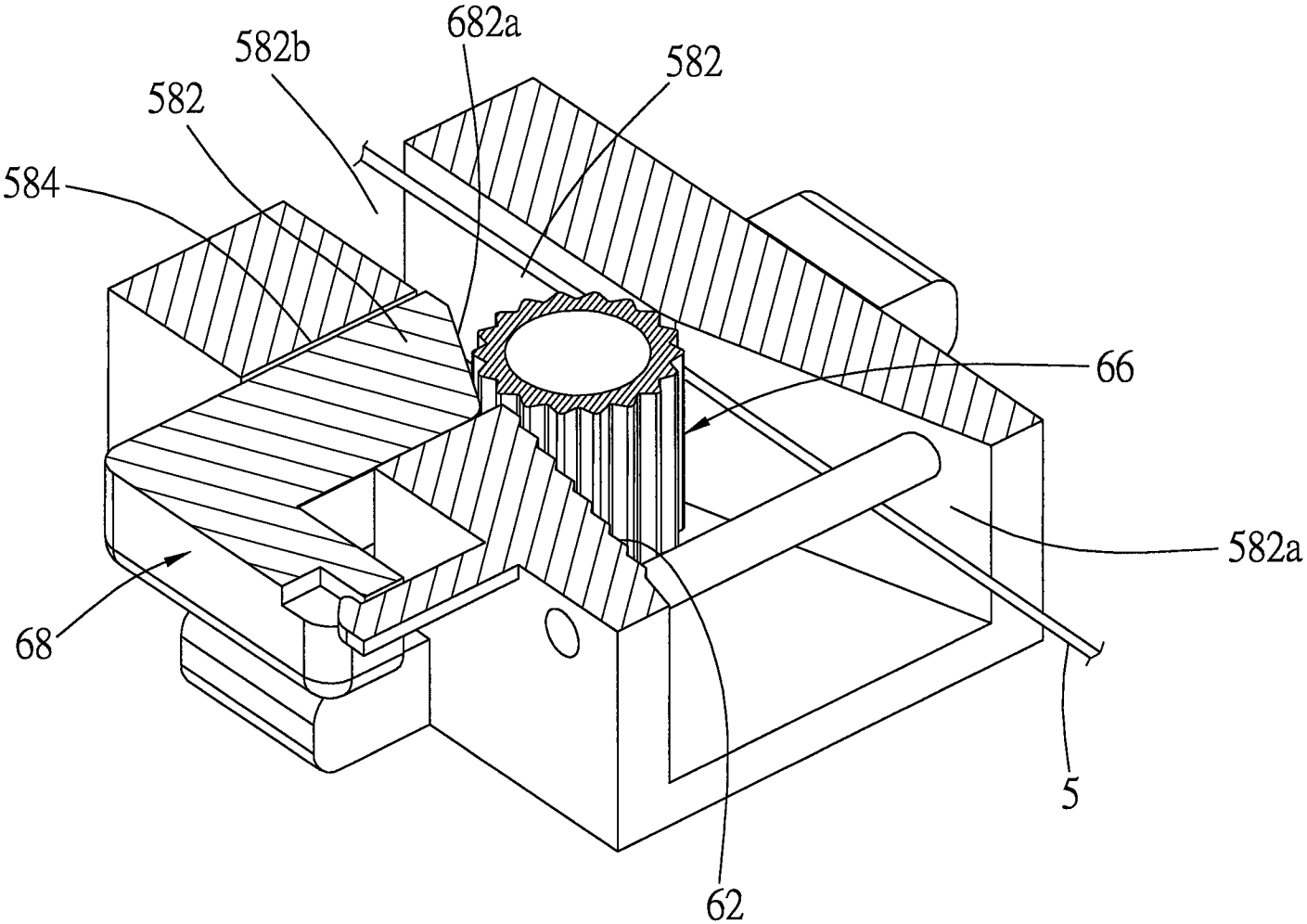
FIG. 35 is a sectional view along the 35-35 line in FIG. 31.

Two sets of locking mechanisms are respectively used with two cords in the aforementioned each embodiment from the first to the fourth embodiments. However, in practice, there could be only one single set of locking mechanism to control two cords. A tension window blind having substantially the same structure with the tension window blind of the first embodiment is illustrated in FIG. 30, wherein a locking mechanism 56 of a fifth embodiment of the present disclosure is provided at a middle portion of the bottom rail 2 of the window covering. The two cords 5, 6 respectively pass through the locking mechanism 56 from two sides, and each is fixedly connected to a fixed seat.

As shown in FIG. 30 to FIG. 35, the locking mechanism 56 of the fifth embodiment of the present disclosure includes a grip 57, a base 58, a locking unit, a pressing member 68, and a reversion member. The grip 57 passes through the bottom rail 2, and is engaged with base 58. An upper part and a lower part of the base 58 each has a cord hole going through two side walls on two sides. Each of the cord holes is composed of a straight segment, which has an equal diameter through the whole segment, and an expanding segment, of which a diameter gradually increases toward the outside. For ease of explanation, herein we call the cord hole of the upper part of the base 58 "the upper cord hole 581", and the cord hole of the lower part of the base 58 "the lower cord hole 582". The expanding segment of the upper cord hole staggers the expanding segment of the lower cord hole. A left side of the upper cord hole 581 is a first opening 581*a*, and a right side thereof is a second opening 581*b*. The cord 6 passes through the cord hole 581. A right side of the lower cord hole 582 is a first opening 582*a*, and a left side thereof is a second opening 582*b*. The cord 5 passes through the cord hole 582. An area of each of the aforementioned first openings is greater than an area of each of the second openings. The base 58 further has an upper through hole 583 communicating the upper cord hole 581 with the outside, a lower through hole 584 communicating the lower cord hole 582 with the outside, and a blind hole 585 recessed from a front surface thereof.

The locking unit includes two non-slip structures, each of which is respectively formed at a wall of one of the cord holes, and two stopping members which are rollers as an example. Each of the rollers can be moved along one of the non-slip structures until reaching an end of one of the non-slip structures. In the current embodiment, the non-slip structures include an upper inclined toothed surface 60 and a lower inclined toothed surface 62, and each of the rollers has teeth on a surface thereof. The upper inclined toothed surface 60 is formed on a side wall of the upper cord hole 581. An end of the upper inclined toothed surface near the interior is defined as a first end, and another end thereof near the outside is defined as a second end. Similarly, the lower inclined toothed surface 62 is formed on a side wall of the lower cord hole 582. An end of the lower inclined toothed surface near the interior is defined as a first end, and another end thereof near the outside is defined as a second end. One of the rollers (i.e., the roller 64) is provided in the upper cord hole 581, and the other one of the rollers (i.e., the roller 66) is provided in the lower cord hole 582. It has to be clarified that, though the aforementioned non-slip structures use toothed surfaces as an example, this is not a limitation of the present disclosure. In other words, as long as they could provide a non-slip effect, the non-slip structures are not limited to be toothed surfaces. For example, each of the non-slip structures could respectively be a segment with bumps provided on the side wall of one of the cord holes. Similarly, the surface of each of the rollers is not limited to have teeth. Bumps provided on the surface would also do.

An end 68*a* of the pressing member 68 of the locking mechanism 56 is located outside of the base 58. After assembling, said end 68*a* is exposed out of the bottom rail 2 and the grip 57 to be pressed by the user, as shown in FIG. 30. Another end of the pressing member 68 includes two pushing rod, which extend in parallel, and include an upper pushing rod 681 and a lower pushing rod 682. In addition, a guide rod 683 is provided between the upper pushing rod 681 and the lower pushing rod 682. It is worth mentioning that, the upper pushing rod 681 has an inclined pushing surface 681*a* facing the first opening 581*a* of the upper cord hole 581, and the lower pushing rod 682 also has an inclined pushing surface 682*a* facing the first opening 582*a* of the lower cord hole 582. The upper pushing rod 681 goes into the upper through hole 583 of the base 58, with the inclined pushing surface 681*a* thereof abutting against the roller 64; the lower pushing rod 682 goes into the lower through hole 584 of the base 58, with the inclined pushing surface 682*a* thereof abutting against the roller 66. The reversion member is a spring 70 fitting around the guide rod 683. An end of the spring 70 abuts against a bottom of the blind hole 585, and another end thereof abuts against the pressing member 68. The pushing force of the spring 70 would urge the pressing member 68 to move outward. In addition, the pressing member 68 is hooked by two hooks 586 of the base 58, and therefore would not disengage from the base 58.

Figure 36:
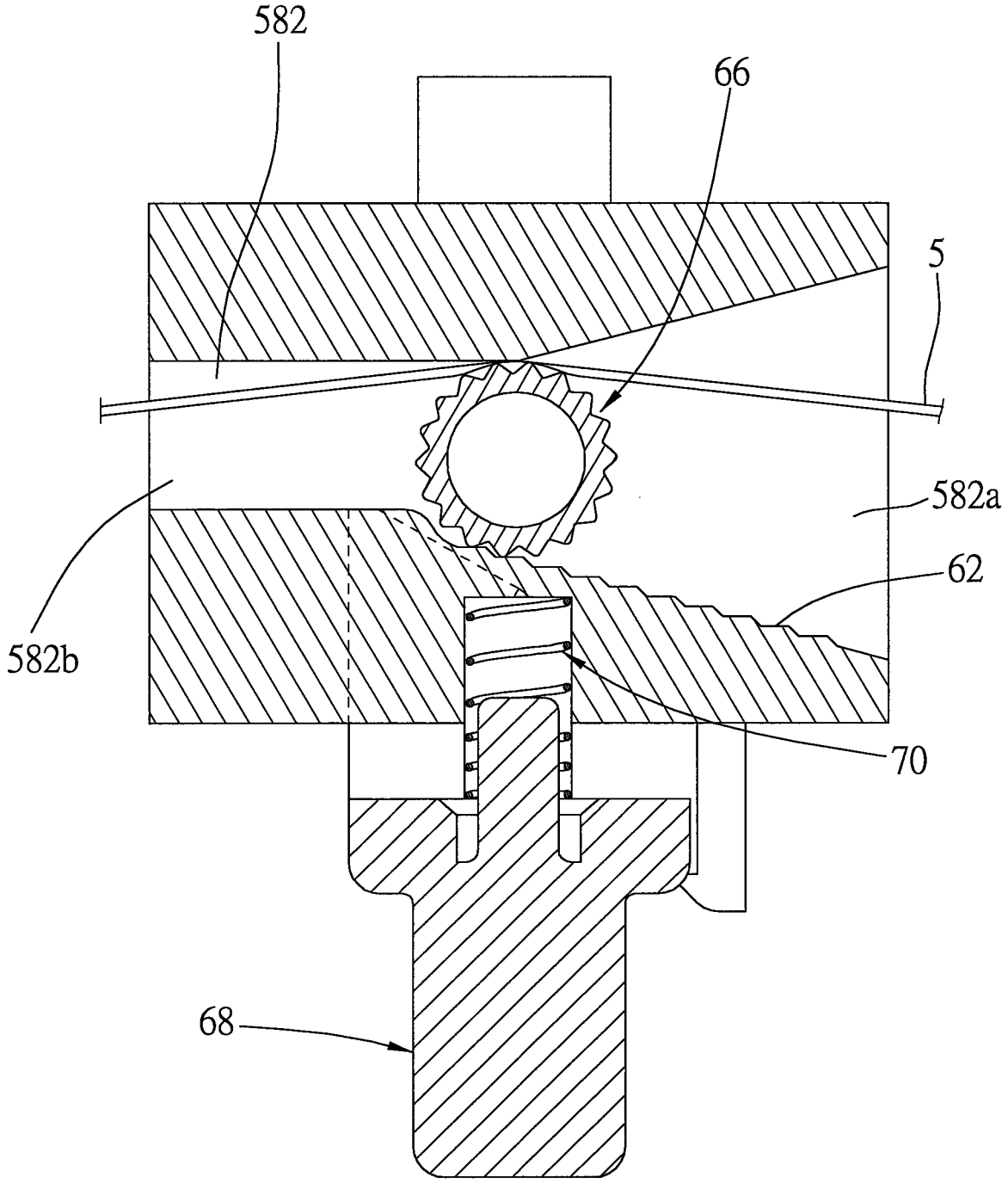
FIG. 36 is a sectional view, showing the gear of the locking mechanism tightly abuts against the cord.

Since the cords 5, 6 are controlled in the same way, herein we simply discuss how the locking mechanism 56 controls the cord 5 for ease of explanation. FIG. 36 shows the condition when the bottom rail 2 is in a stationary state. At this time, the roller 66 stays at a first position near the first end of the lower inclined toothed surface 62, i.e., the junction of the straight segment and the expanding segment thereof, and the cord 5 is tightly clamped between the roller 66 and an opposite wall of the corresponding cord hole which does not have the lower inclined toothed surface 62 provided thereon.

Figure 37:
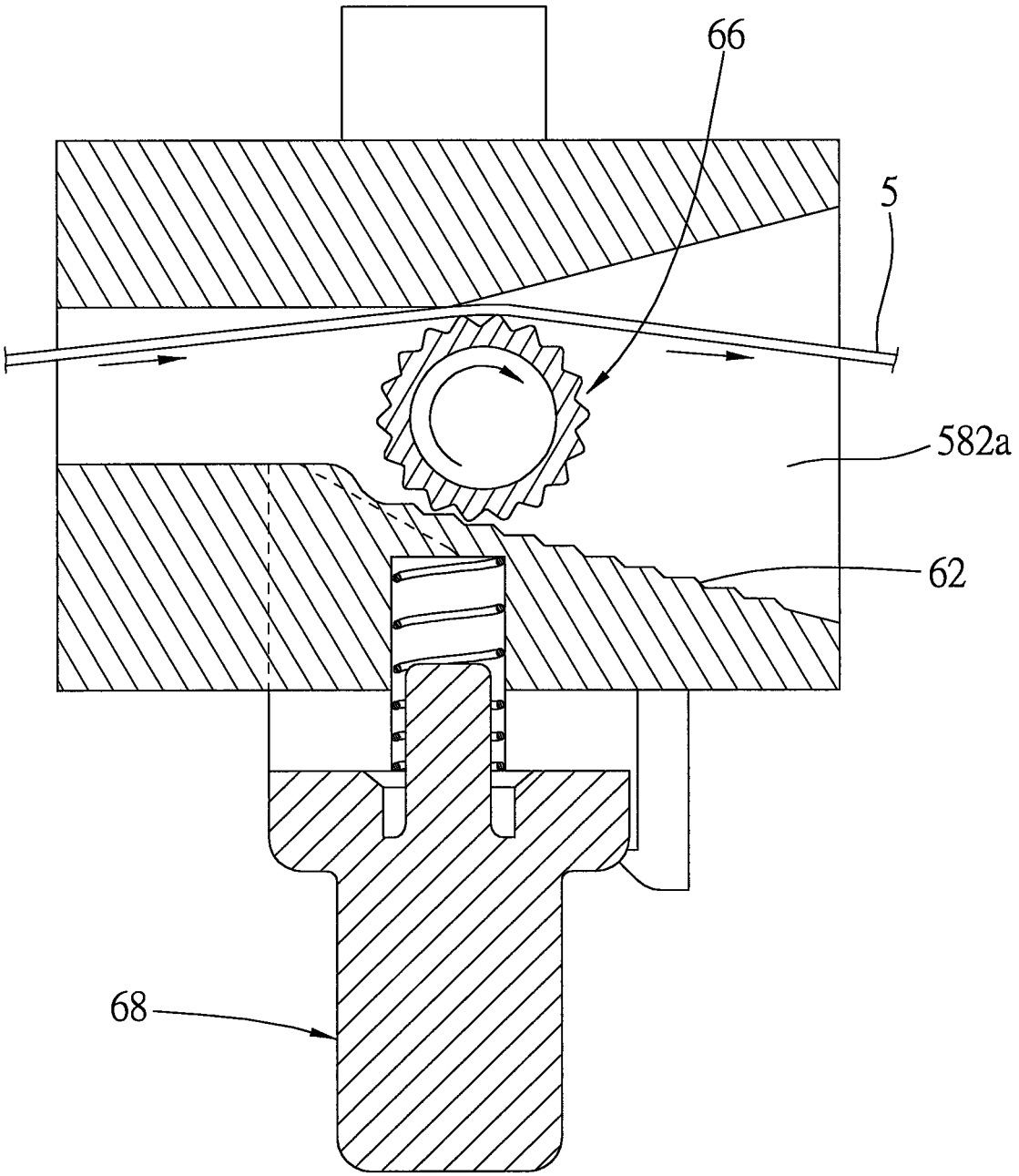
FIG. 37 is similar to FIG. 36, showing the cord is pulled in a direction toward the first opening of the base, and the gear shifts.

FIG. 37 shows the condition when the bottom rail 2 is pushed up to move toward the headrail 1 along the cord. Since the position of the locking mechanism 56 is fixed, the cord 5 would move relative to the base 58 toward the first opening 582*a* of the lower cord hole 582. During the process of moving the cord 5, the roller 66 would be pushed by the cord 5 to rotate toward the region with larger space along the lower inclined toothed surface 62. Once the roller 66 shifts away from the first position, even slightly, the cord 5 would not be fixed. Whereby, the bottom rail 2 could be smoothly pushed up without being interfered.

Once when the upward pushing force is dismissed, the cord 5 would be immediately moved toward the second opening 582*b* due to the weight of the bottom rail 2 and the slats 3, which would rotate the roller 66 and pull the roller 66 back to the first position, as the condition shown in FIG. 36. Since the first position has less space, the roller 66 would tightly abut against the cord 5 again, whereby to stop the bottom rail 2 at its current position when the upward pushing force is dismissed.

Figure 38:
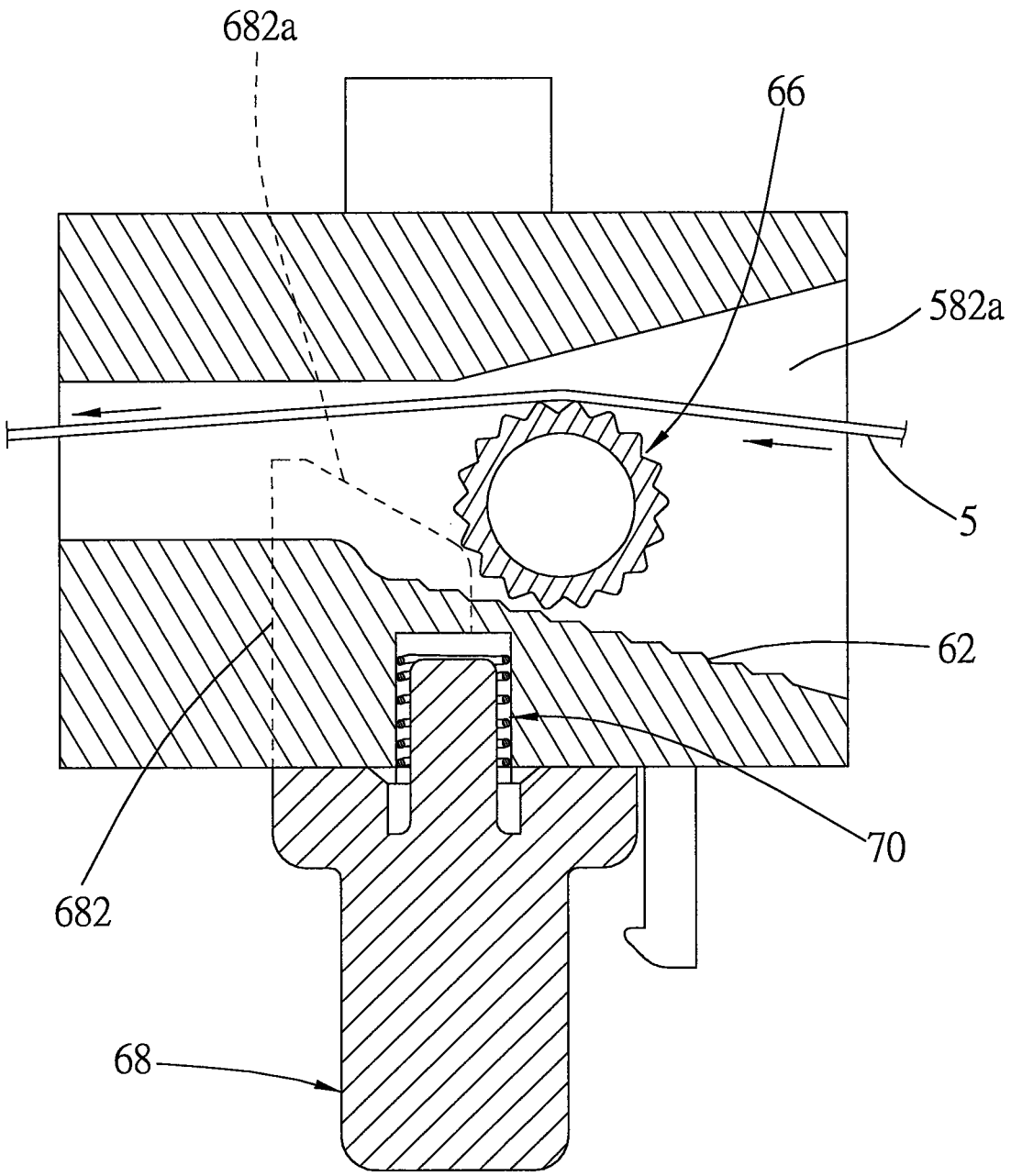
FIG. 38 is similar to FIG. 27, showing the cord is pulled in a direction toward the second opening of the base.

As shown in FIG. 38, when the user presses the pressing member 68 inward, holds the grip 57, and pulls down the bottom rail 2, the inclined pushing surface 682*a* at a front end of the lower pushing rod 682 of the pressing member 68 would guide and push the roller 66 to move toward the first opening 582*a* of the lower cord hole 582. Whereby, the roller 66 could be moved to a second position. Before the force pushing the pressing member 68 inward is dismissed, the roller 66 would keep moving freely at the second position in the expanding segment, and the cord 5 would no longer be tightly clamped. In this way, when the bottom rail 2 is being pulled down, the cord segment between the fixed seat and the locking mechanism 56 in the bottom rail 2 would become shorter, while the cord segment between the headrail 1 and the locking mechanism 56 in the bottom rail 2 would become longer, so that the bottom rail 2 could be gradually moved downward. Similarly, once when the pressing member 68 is not pressed, the pressing member 68 would return to its original position through the pushing of the spring 70. The cord 5 would be affected by the weight of the bottom rail 2 and the slats 3 to move relatively, pulling and rotating the roller 66 to return to the first position, where the roller 66 would tightly abut against the cord 5 again, which would prevent the cord 5 from being pulled out, and the bottom rail 2 would not sag.

Figure 39:
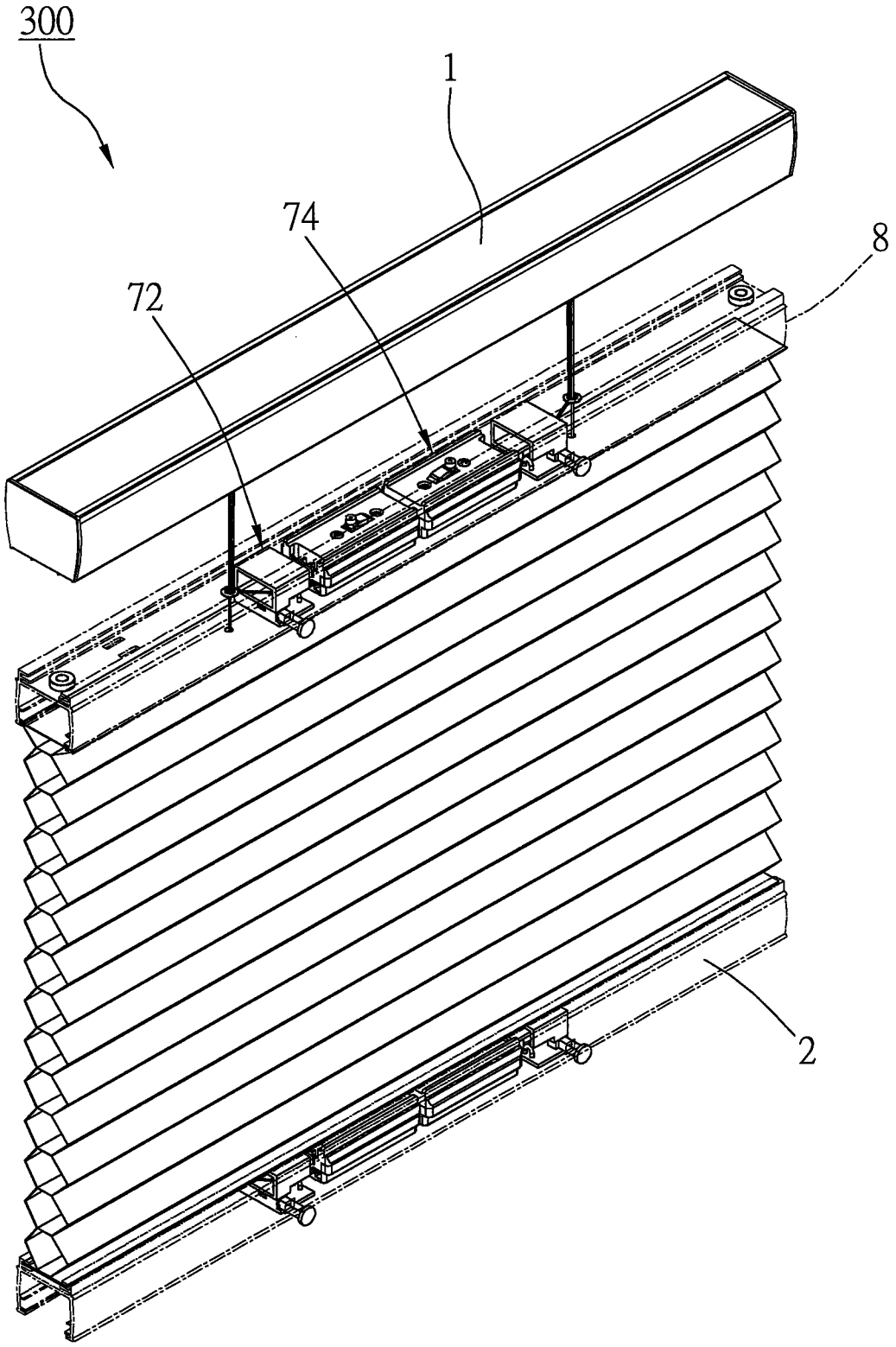
FIG. 39 is an exploded view, showing a top down-bottom up (TDBU) window covering including the locking mechanism of a sixth embodiment of the present disclosure.
Figure 40:
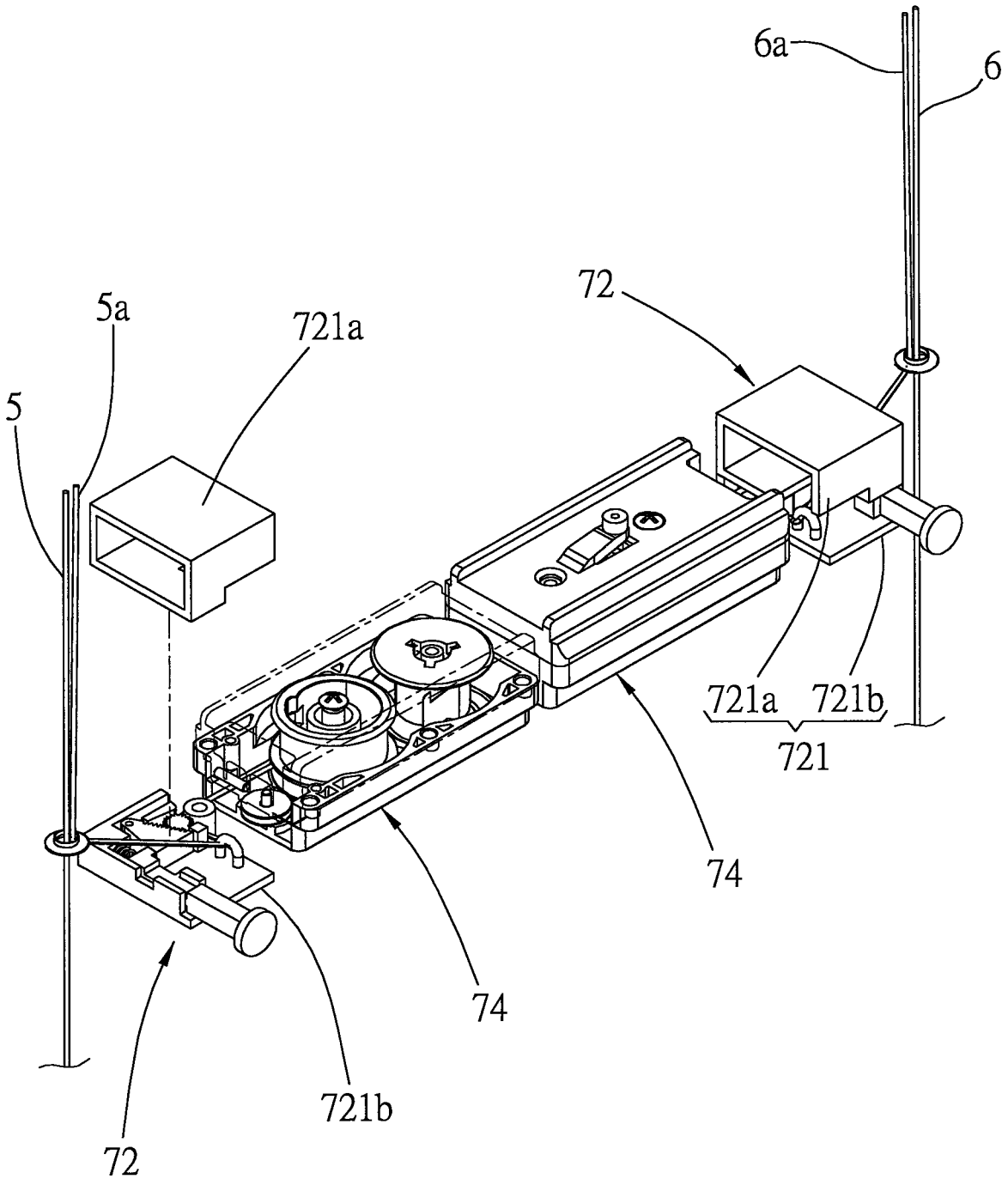
FIG. 40 is an exploded view, showing two sets of the locking mechanisms of the sixth embodiment of the present disclosure and the spring boxes installed in the middle rail of the TDBU window covering.

In each of the aforementioned embodiments, the locking mechanism is installed in the bottom rail 2 of the window covering. However, in practice, the locking mechanism disclosed in the present disclosure could be also applied in a TDBU (top down, bottom up) window covering. A sixth embodiment of the present disclosure is illustrated in FIG. 39 and FIG. 40. A window covering 300 disclosed therein not only includes the headrail 1 and the bottom rail 2, but also has a middle rail 8 provided between the headrail 1 and the bottom rail 2. By changing the position of the middle rail 8, the shielded portion of the TDBU window covering 300 can be changed as required. For example, A TDBU window covering could allow light to pass through an upper portion thereof, with the lower portion thereof still blocking light out. In such a design, the bottom rail 2 can be moved up and down along the cords 5, 6 as mentioned above, and the middle rail 8 can be moved up and down along another set of cords 5*a*, 6*a*.

It can be seen from the above descriptions of the embodiments, by providing the locking mechanism of the present disclosure at the bottom rail 2, the bottom rail 2 could be precisely stopped at any required position. Similarly, the locking mechanism of the present disclosure could provide the same effect on the middle rail 8. By providing the locking mechanism of the present disclosure in the middle rail 8, the middle rail 8 could be also precisely stopped at any required position. In the sixth embodiment, a locking mechanism 72 has similar structures with the locking mechanism 24 disclosed in the second embodiment. However, since an end of each of the cords 5*a*, 6*a* is connected to one of spring boxes 74 provided in the middle rail 8, instead of being connected to a fixed seat, the window frame, or a wall of the building, the base 721 of the locking mechanism 72 though also has an upper member 721*a* and a lower member 721*b*, the lower member 721*b* is not necessary to have a separated chamber.

Figure 41:
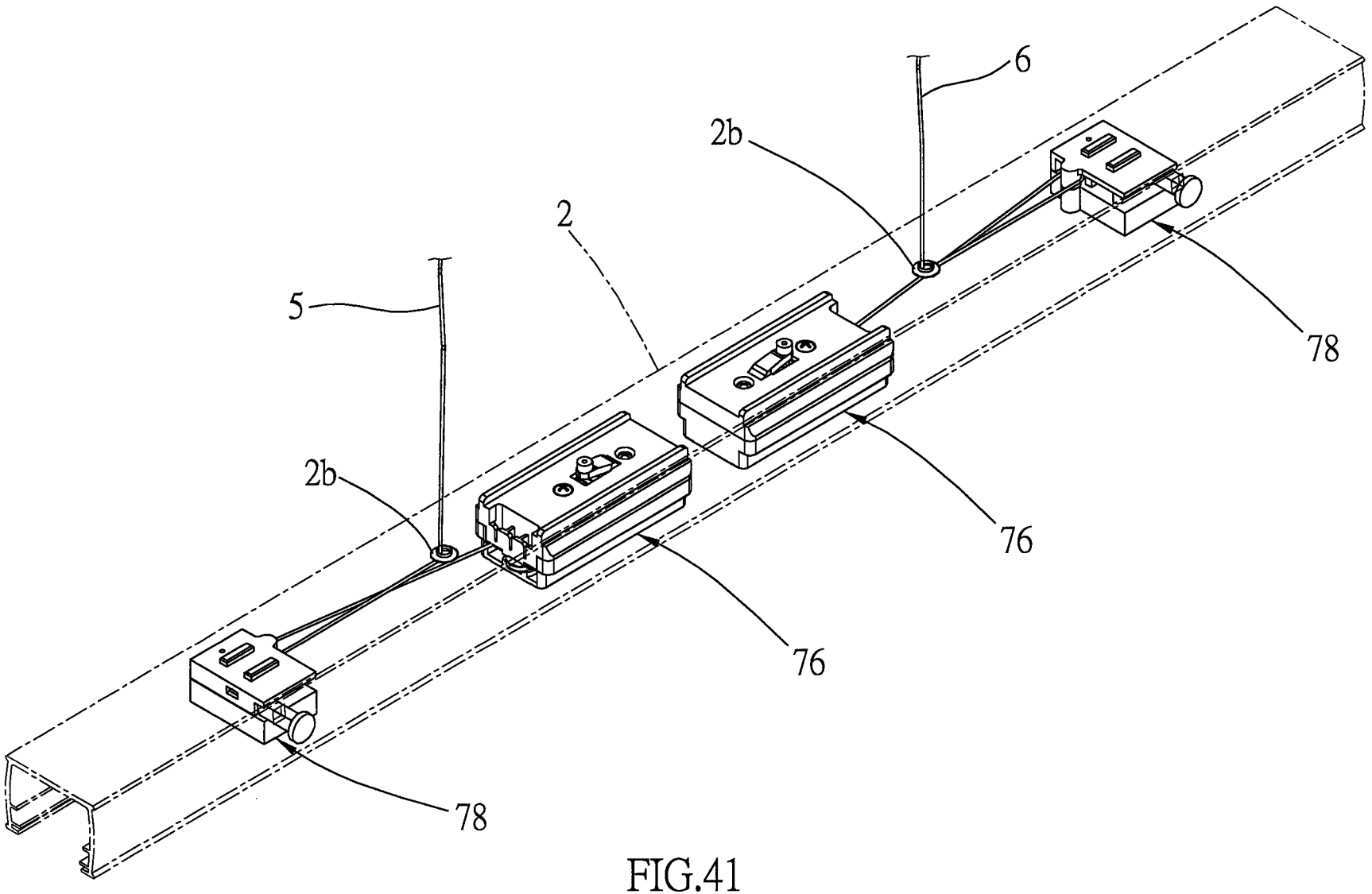
FIG. 41 is an exploded view, showing two sets of locking mechanisms of a seventh embodiment of the present disclosure and two spring boxes installed in the bottom rail.
Figure 42:
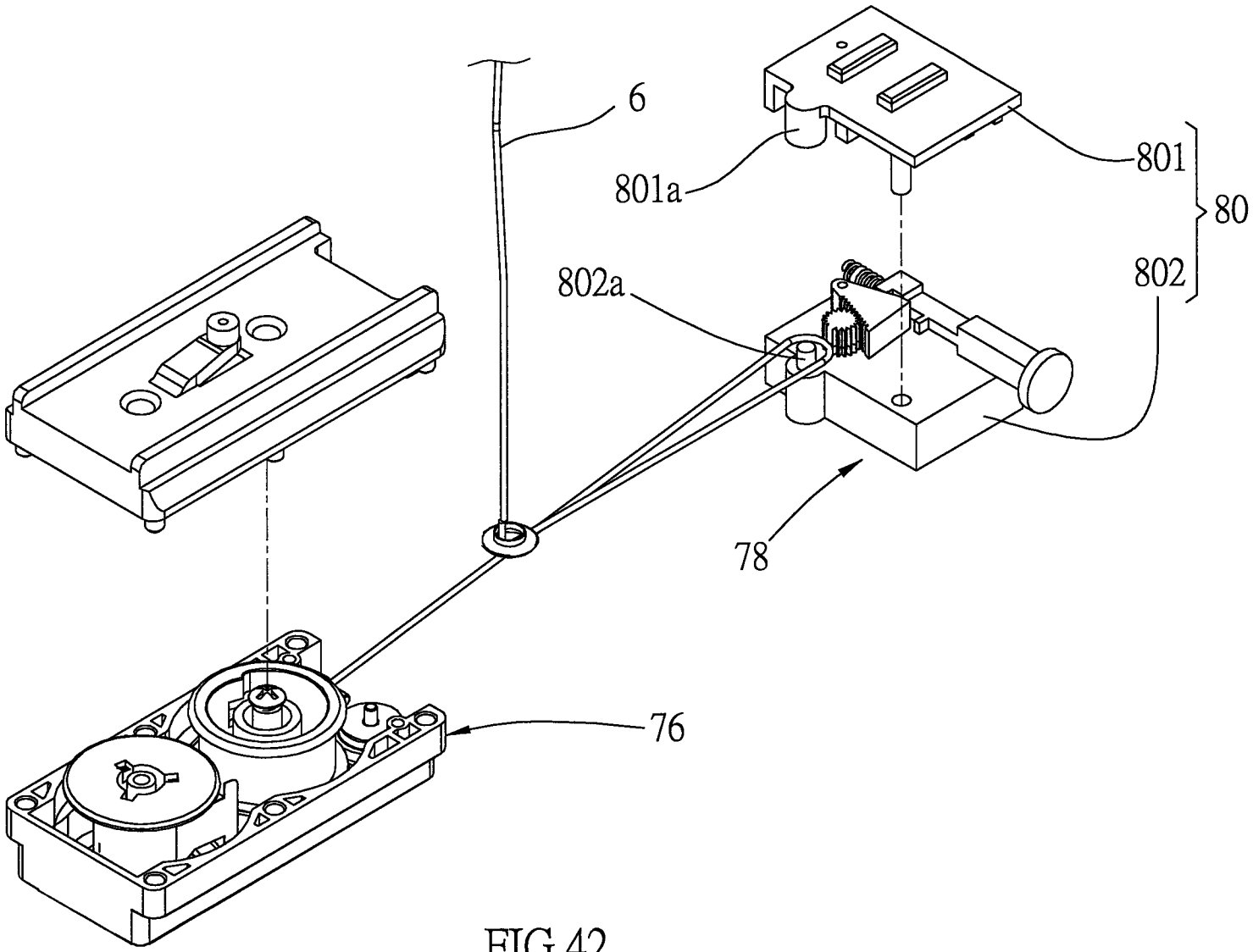
FIG. 42 is a perspective exploded view of one of the two sets of locking mechanisms and one of the spring boxes illustrated in FIG. 41.
Figure 43:
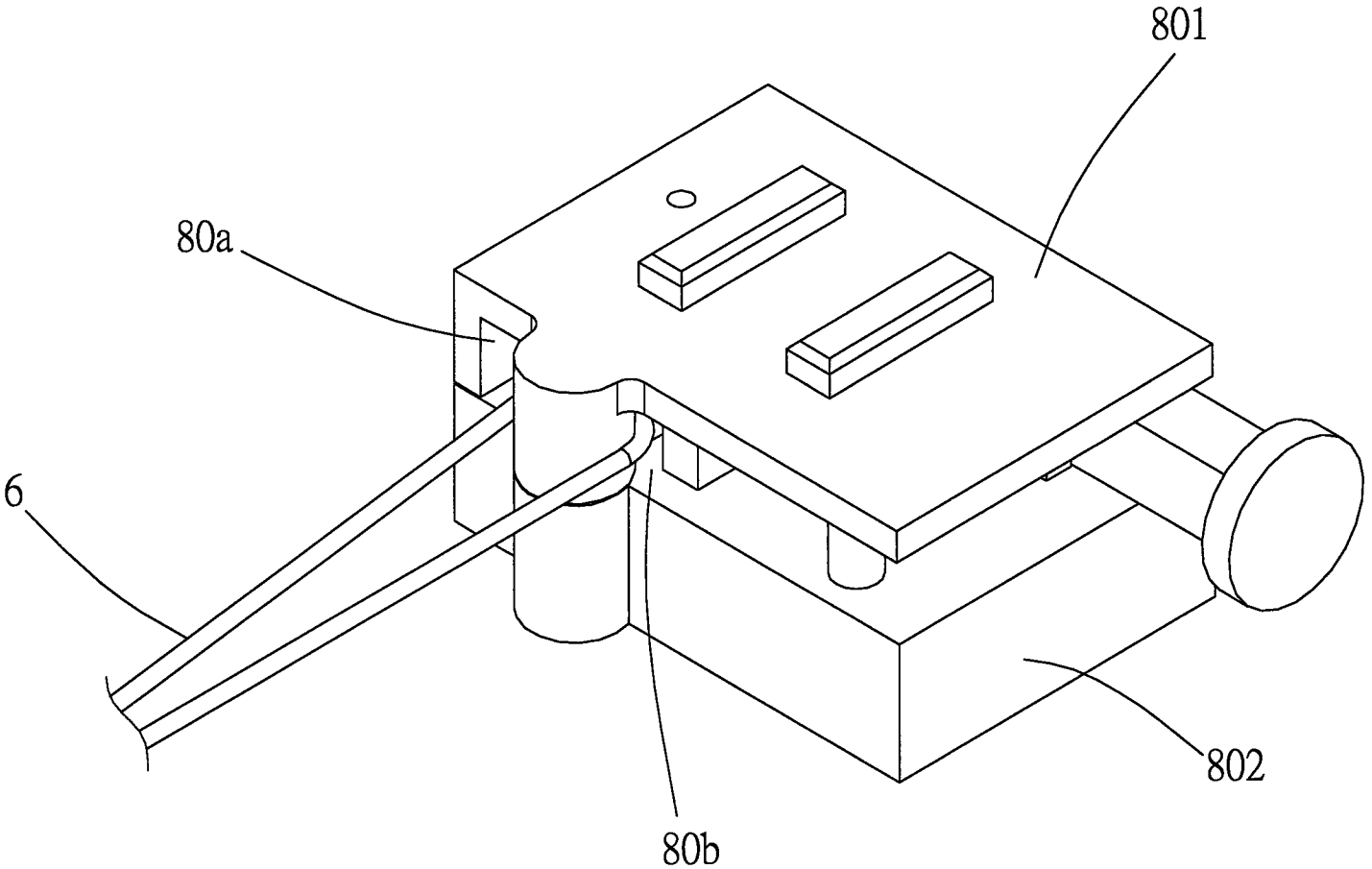
FIG. 43 is a relation diagram of the cord and the base of one of the two sets of locking mechanisms shown in FIG. 41, showing the first opening and the second opening of the base are provided on the same side.

In each of the aforementioned embodiments, the first opening and the second opening are provided on two sides of the base. However, in practice, the first opening and the second opening could be provided on the same side of the base. In a seventh embodiment of the present disclosure shown in FIG. 41, two spring boxes 76 and two sets of locking mechanisms 78 are provided in the bottom rail 2, and an end of each of the cords 5, 6 is connected to one of the spring boxes 76 after passing through one of the through holes 2*b* on the top surface of the bottom rail 2 and winding around one set of the locking mechanisms 78. As shown in FIG. 42 and FIG. 43, though the base 80 of the locking mechanism 78 of the current embodiment is also formed by an upper member 801 and a lower member 802, the upper member 801 further has a tube 801*a* provided on a bottom surface thereof, and the lower member 802 further has an engaging post 802*a* provided on a side thereof. The first opening 80*a* and the second opening 80*b* of the base 80 are formed on two sides of where the engaging post 802*a* is inserted into the tube 801*a*. The cord 6 winds around (i.e., changes its direction) through the tube 801*a*, and passes through the first opening 80*a* and the second opening 80*b*. With the aforementioned structures, when the bottom rail 2 is moved toward the headrail 1, the cord 6 would be moved relative to the locking mechanism 78 toward the first opening 80*a* of the base 80. On the contrary, when the bottom rail 2 is moved away from the headrail 1, the cord 6 would be moved relative to the base 80 toward the second opening 80*b*, whereby the bottom rail 2 could be smoothly moved downward.

Figure 44:
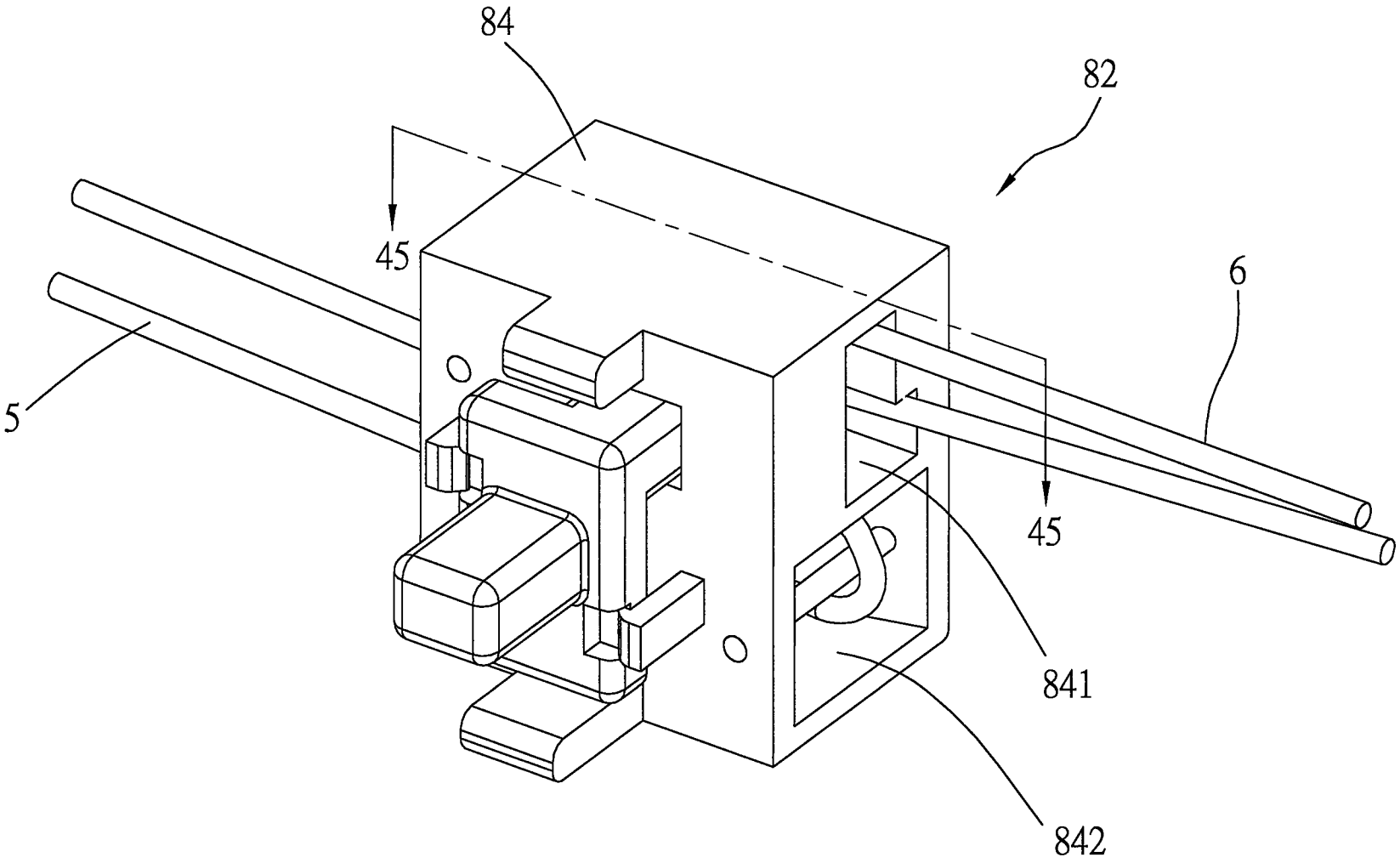
FIG. 44 is an exploded view, showing the locking mechanism of an eighth embodiment of the present disclosure.
Figure 45:
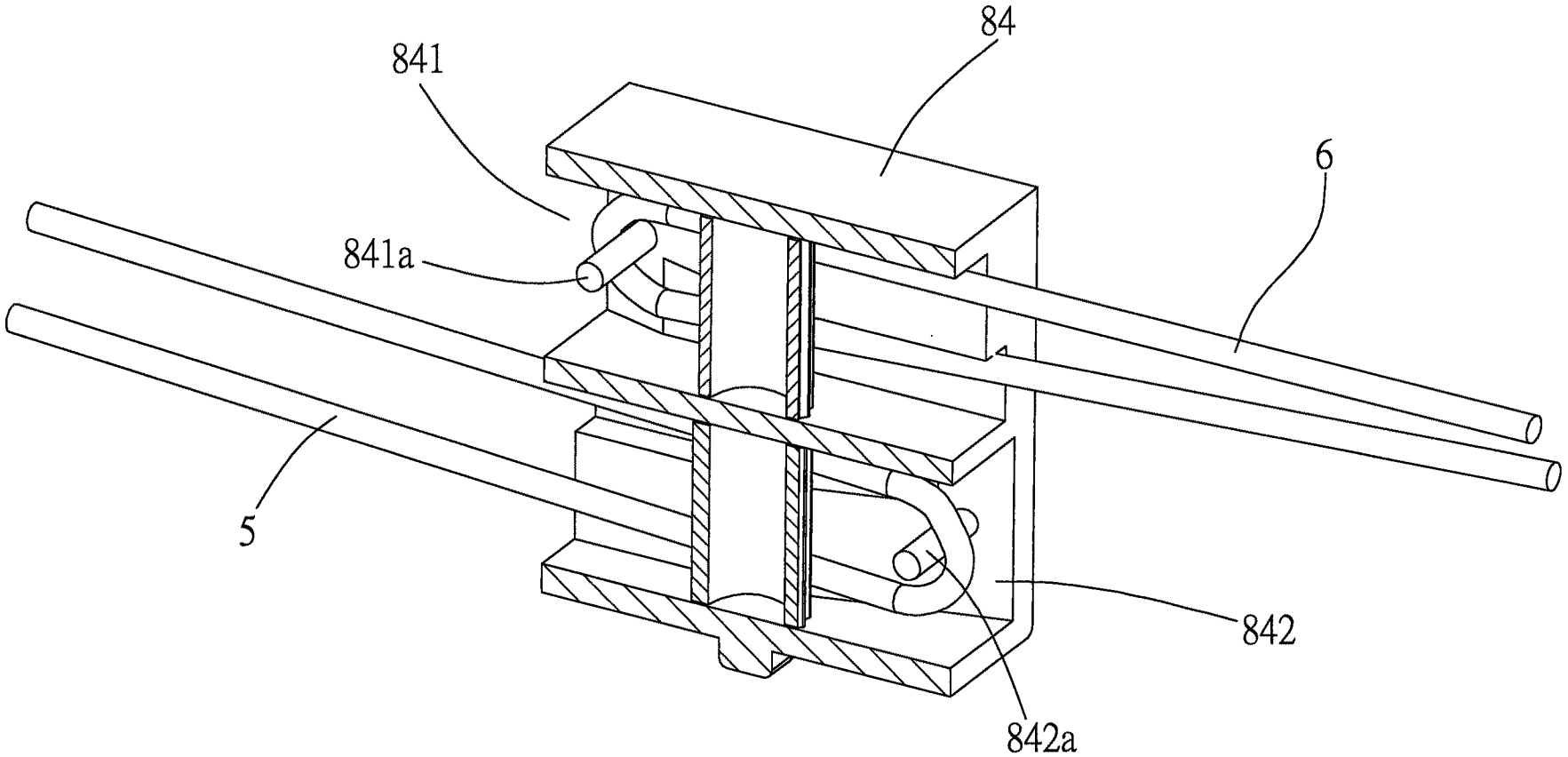
FIG. 45 is a sectional view along the 45-45 line in FIG. 44.

In addition, a locking mechanism 82 of an eighth embodiment of the present disclosure is shown in FIG. 44 and FIG. 45, which has similar structures with the locking mechanism 56 disclosed in the fifth embodiment. A base 84 of the eighth embodiment is also provided with two cord holes 841, 842 individually on an upper part and a lower part thereof. However, the base 84 further has cord posts 841*a*, 842*a*, each of which is individually provided in one of the cord holes 841, 842, and each of the cords 5, 6 does not directly pass through one of the cord holes 841, 842. Instead, each of the cords 5, 6 goes out from the same side opening after winding around one of the cord posts 841*a*, 842*a*. In other words, the first opening and the second opening are provided on the same side of the base, and the effect would be the same of that of the aforementioned embodiments.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A locking mechanism for a window covering, wherein the window covering includes a fixed rail and a movable rail; the movable rail is adapted to be moved relative to the fixed rail along at least one cord; the locking mechanism is provided in the movable rail, comprising:

a base, which has a first opening and a second opening communicating with each other, wherein the first opening and the second opening are adapted to be passed through by the at least one cord; and a locking unit, which includes at least one stopping member provided in the base, wherein the at least one stopping member is movable between a first position and a second position, and is adapted to be moved along with a movement of the movable rail; when the movable rail is not being moved, the stopping member is located at the first position, where the stopping member is adapted to restrict the at least one cord from moving relative to the base; when the movable rail is being moved in a direction, the at least one cord drives the stopping member to shift away from the first position, and therefore the at least one cord is allowed to move relative to the base toward the first opening.

2. The locking mechanism of claim 1, further comprising a pressing member, which is operable to move the stopping member to the second position, where the stopping member is adapted to allow the at least one cord to move relative to the base toward the second opening when the movable rail is being moved in an opposite direction.

3. The locking mechanism of claim 2, wherein the locking unit comprises a toothed surface, and the stopping member comprises a gear; a part of the gear meshes with the toothed surface, and another part of the gear is adapted to contact the at least one cord; when the stopping member is located at the first position, the another part of the gear is adapted to tightly abut against the at least one cord; the gear is adapted to be rotated along the toothed surface to leave the first position by the at least one cord which is moving relative to the base toward the first opening when the movable rail is being moved.

4. The locking mechanism of claim 3, further comprising a reversion member, wherein the base comprises an upper member, a lower member engaging with the upper member, a first protrusion, and a second protrusion; the first protrusion and the second protrusion are fixedly located between the upper member and the lower member; the toothed surface of the locking unit is formed on a side of the first protrusion; the gear is located between the upper member and the lower member, and is confined in a space between the first protrusion and the second protrusion; the reversion member exerts a pushing force onto the pressing member through the gear, which urges the pressing member to move toward an original position where the pressing member is when the pressing member is not operated.

5. The locking mechanism of claim 4, wherein the upper member has a through hole and a blind hole respectively provided on two sides thereof; the pressing member has an extended portion passing through the through hole, wherein an end of the extended portion abuts against the gear, while another end thereof is located outside of the base; the reversion member comprises a spring and a pushing member, which are both provided in the blind hole; the spring pushes against the pushing member to move the pushing member outward, so that a part of the pushing member abuts against the gear.

6. The locking mechanism of claim 4, wherein the lower member has a separated chamber; the at least one cord of the window covering comprises two cords; a space between the upper member and the lower member is adapted to be passed through by one of the cords, and the separated chamber is adapted to be passed through by the other one of the cords.

7. The locking mechanism of claim 4, wherein the toothed surface of the locking unit has a first end and a second end, and the toothed surface is provided in a tilted manner, so that the space between the first protrusion and the second protrusion has a larger room on a side near the reversion member than on another side near the pressing member; when the stopping member is located at the first position, the gear is near the first end of the toothed surface; when the stopping member is located at the second position, the gear is near the second end of the toothed surface.

8. The locking mechanism of claim 3, wherein the base comprises an upper member and a lower member engaging with each other; the locking unit comprises a swing member pivotally provided between the upper member and the lower member; the toothed surface is provided on a side of the swing member.

9. The locking mechanism of claim 8, wherein the pressing member comprises an extended portion; a part of the extended portion extends into a space between the upper member and the lower member, and the extended portion has a protruded portion and a recessed portion provided on the part thereof extending into the space between the upper member and the lower member; another part of the extended portion is located outside of the base; when the pressing member is not being operated, the swing member abuts against the protruded portion of the extended portion, so that the stopping member is located at the first position; when the pressing member is being operated and moved, the swing member is moved back into the recessed portion of the extended portion, so that the stopping member is located at the second position, where the stopping member is adapted to allow the at least one cord to move relative to the base toward the second opening.

10. The locking mechanism of claim 8, further comprising a reversion member provided between the upper member and the lower member, wherein the reversion member exerts a pushing force onto the pressing member, which urges the pressing member to move toward an original position where the pressing member is when the pressing member is not operated.

11. The locking mechanism of claim 8, wherein the lower member has a separated chamber; the at least one cord of the window covering includes two cords; a space between the upper member and the lower member is adapted to be passed through by one of the cords, and the separated chamber is adapted to be passed through by the other one of the cords.

12. The locking mechanism of claim 2, wherein the locking unit comprises a toothed surface; the stopping member comprises a gear; a space between the toothed surface and the gear is adapted to be passed through by one of the at least one cord; when the stopping member is located at the first position, the gear meshes with the toothed surface, and abuts against the corresponding cord; the gear is adapted to be pushed to leave the first position by the corresponding cord which is moved relative to the base toward first opening when the movable rail is being moved.

13. The locking mechanism of claim 12, wherein the base is provided with a first passage and a second passage; the first passage respectively forms the first opening and the second opening on side surfaces of the base; the first passage has the toothed surface provided on a bottom surface thereof; the second passage and the first passage intersect and communicate with each other; the locking unit comprises a contact block, which is movably provided in the second passage, and abuts against the gear.

14. The locking mechanism of claim 13, wherein the base is provided with a third passage; the third passage and the second passage intersect and communicate with each other; the pressing member comprises an extended portion provided in the third passage; the extended portion has a protruded portion and a recessed portion; when the pressing member is not pressed, the protruded portion pushes and abuts against the contact block located below, which forces the gear to stay at the first position; when the pressing member is operated and moved, the recessed portion of the extended portion allows the contact block to move upward, which allows the gear to move to the second position, where the gear is adapted to allow the cord to move relative to the base toward the second opening.

15. The locking mechanism of claim 14, further comprising a reversion member, wherein the third passage has an enclosed end; the reversion member is provided in the third passage, wherein an end of the reversion member abuts against the enclosed end, and another end thereof abuts against the pressing member, which urges the pressing member to move toward an original position where the pressing member is when the pressing member is not operated.

16. The locking mechanism of claim 12, wherein the base comprises a lower member, which has a recessed chamber; the toothed surface is provided on a side wall of the recessed chamber; the locking unit comprises a sway member pivotally connected to the lower member, wherein the sway member sways in the recessed chamber; an end of the sway member is connected to the gear, and an opposite end thereof is connected to the pressing member; when the pressing member is not operated, the gear is located at the first position; when the pressing member is operated, the gear is movable to the second position.

17. The locking mechanism of claim 16, further comprising a reversion member provided in the recessed chamber, wherein the reversion member exerts a pushing force onto the sway member, which urges the pressing member to move toward an original position where the pressing member is when the pressing member is not operated.

18. The locking mechanism of claim 1, wherein the window covering is installed in a window frame; an end of the at least one cord is fixedly connected to the fixed rail, while another end thereof is fixedly connected to the window frame after passing through the base.

19. The locking mechanism of claim 1, wherein the window covering further comprises a spring box provided in the movable rail; an end of the at least one cord is fixedly connected to the fixed rail, while another end thereof is connected to a reel of the spring box after passing through the base.

20. The locking mechanism of claim 2, wherein an upper part and a lower part of the base each has a cord hole going through two side walls thereof; each of the cord holes respectively forms the first opening and the second opening on the two side walls; positions of the first openings on the upper part and the lower part of the base stagger; the at least one cord comprises two cords, each of which passes through one of the cord holes; the locking unit comprises two non-slip structures, each of which is respectively formed on a wall of one of the cord holes; the at least one stopping member comprises two stopping members, each of which respectively comprises a roller provided in one of the cord holes; the pressing member comprises two pushing rods, each of which goes into the base, with an end thereof pushing against the roller located in one of the cord holes; when the pressing member is not operated, the gear is located at the first position; when the pressing member is operated and moved, each of the pushing rods pushes the corresponding roller toward the second position, whereby each of the cords is movable relative to the base toward the second opening.

21. The locking mechanism of claim 20, further comprising a reversion member provided between the base and the pressing member, wherein the reversion member exerts a pushing force onto the pressing member, which urges the pressing member to move toward an original position where the pressing member is when the pressing member is not operated.

22. The locking mechanism of claim 1, wherein the first opening and the second opening of the base are provided on different sides of the base.

23. The locking mechanism of claim 1, wherein the first opening and the second opening of the base are provided on the same side of the base.

* * * * *